US012022959B2

(12) United States Patent
Mullet et al.

(10) Patent No.: US 12,022,959 B2
(45) Date of Patent: Jul. 2, 2024

(54) SEATING SYSTEM

(71) Applicant: Current Products Corp., Pensacola, FL (US)

(72) Inventors: Willis Jay Mullet, Pensacola, FL (US); Richard Scott Hand, Pensacola, FL (US); Phillip Dugger, Pensacola, FL (US); Phil Gurvitz, Pensacola, FL (US); Wade Tyson Earnest, Pensacola, FL (US); Brian Nielsen, Pensacola, FL (US); Marcel Mullet, Pensacola, FL (US); Ethan Bloodworth, Cantonment, FL (US); Tyler Fortson, Pensacola, FL (US)

(73) Assignee: Current Products Corp., Pensacola, FL (US)

( * ) Notice: Subject to any disclaimer, the term of this patent is extended or adjusted under 35 U.S.C. 154(b) by 0 days.

(21) Appl. No.: 17/955,866

(22) Filed: Sep. 29, 2022

(65) Prior Publication Data

US 2023/0103963 A1 Apr. 6, 2023
US 2023/0284785 A9 Sep. 14, 2023

Related U.S. Application Data

(60) Provisional application No. 63/251,360, filed on Oct. 1, 2021.

(51) Int. Cl.
*A47C 7/44* (2006.01)

(52) U.S. Cl.
CPC ..... *A47C 7/444* (2018.08); *A47C 7/4454* (2018.08)

(58) Field of Classification Search
CPC ... A47C 7/4454; A47C 7/444; A47C 1/03279; A47C 1/03274; A47C 1/03277;
(Continued)

(56) References Cited

U.S. PATENT DOCUMENTS 349,907 A * 9/1886 Shults ..... A47C 7/444 297/292
2,143,098 A * 1/1939 Wohlk ..... A47C 1/03294 297/343

(Continued)

FOREIGN PATENT DOCUMENTS

EP 1327400 4/2014
WO WO-9304613 A1 * 3/1993 ..... A47C 3/023

OTHER PUBLICATIONS

Haute Juice—Set of 4 Chrome Tubular Cantilever Wire Vintage Arm Chairs Dining Chairs—Mar. 10, 2015.
International Search Report—PCT/US22/45206—Jan. 18, 2023.

*Primary Examiner* — Milton Nelson, Jr.
(74) *Attorney, Agent, or Firm* — BrownWinick Law Firm; Christopher A. Proskey

(57) ABSTRACT

In one or more embodiments, a dining chair is provided having a frame, a seat operably connected to the frame, a backrest operably connected to the frame, a reclining mechanism, and a counterbalance assembly positioned within the backrest, among other components. The backrest is configured to move between an upright position and a reclined position. In one or more arrangements, the counterbalance assembly is configured to provide a counterbalance force to move the backrest to the upright position in absence of an opposing force.

32 Claims, 111 Drawing Sheets

(58) Field of Classification Search
CPC ..... A47C 7/441; A47C 7/44; A47C 7/402; A47C 1/03294
USPC ..... 297/303.3, 301.3, 301.4, 296, 298, 297/188.07, 218.5, 218.1, 218.3, 301.7, 297/301.1, 300.2, 300.4, 291, 293, 292, 297/289, 343
See application file for complete search history.

(56) References Cited

U.S. PATENT DOCUMENTS 3,000,668 A * 9/1961 Croy ..... A47C 1/03272 297/320
3,072,436 A * 1/1963 Moore ..... A47C 1/03274 297/316
3,174,797 A * 3/1965 Neufeld ..... A47C 31/11 297/218.4
3,337,266 A * 8/1967 Burns ..... A47C 1/03274 297/320
3,567,280 A * 3/1971 Bradshaw ..... A47C 1/03294 297/343
4,703,974 A 11/1987 Brauning
4,911,500 A 3/1990 Saiger
4,938,530 A 7/1990 Snyder et al.
5,108,149 A * 4/1992 Ambasz ..... A47C 7/443 297/297
5,335,966 A 8/1994 Vogtherr
5,370,445 A * 12/1994 Golynsky ..... A47C 3/026 297/303.3
5,971,475 A * 10/1999 Lawson ..... A47C 1/0355 297/68
7,021,712 B2 * 4/2006 Spendlove ..... A47C 7/445 297/285
D659,444 S 5/2012 James
8,256,845 B2 9/2012 Wang
2008/0252124 A1 * 10/2008 Chen ..... A47C 7/443 297/301.4
2009/0195040 A1 8/2009 Birkbeck
2010/0237680 A1 9/2010 Pedersen
2013/0001994 A1 1/2013 Wu

* cited by examiner

FIG. 18A
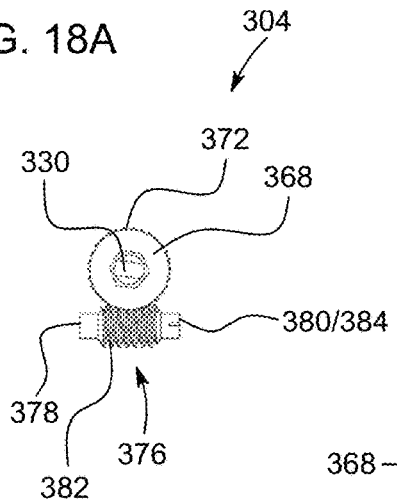
FIG. 18C
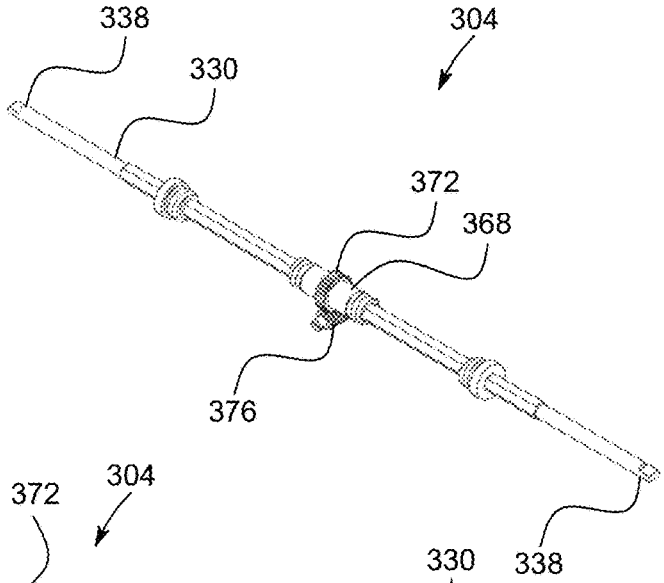
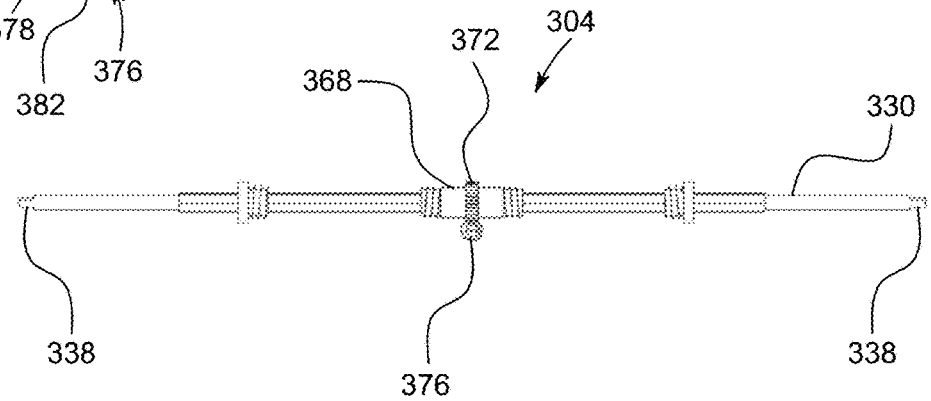
FIG. 18B

SEATING SYSTEM

CROSS-REFERENCE TO RELATED APPLICATIONS

The present application claims priority to U.S. Provisional Application 63/251,360 titled SEATING SYSTEM and filed on Oct. 1, 2021, the entirety of which is hereby incorporated by reference herein, including any figures, tables, drawings, and other information.

FIELD OF THE DISCLOSURE

This disclosure relates generally to furniture. More specifically, and without limitation, this disclosure is directed to chairs.

OVERVIEW OF THE DISCLOSURE

Many chairs can be uncomfortable to use for extended periods of time due to their inability to properly support an occupant in both upright and reclined positions. Many chairs, such as office chairs, have backrests with reclining mechanisms to permit an occupant to sit with the backrest of the chair in a reclined position. However, such reclining mechanisms tend to be bulky external devices which are not aesthetically pleasing and, as such, may not be desirable for use in certain settings (e.g., in a dining room setting).

Therefore, for all the reasons stated above, and the reasons stated below, there is a need in the art for a seating system having a compact reclining mechanism concealed within the chair that is configured to support an occupant in upright and reclined positions.

It is an object of the disclosure to provide a seating system that improves upon the prior art.

Another object of the disclosure is to provide a seating system having a compact internal reclining mechanism configured to support an occupant in upright and reclined positions.

Yet another object of the disclosure is to provide a seating system that is strong, robust, and durable.

Another object of the disclosure is to provide a seating system that is comfortable. Yet another object of the disclosure is to provide a seating system that is easy and intuitive to use.

Another object of the disclosure is to provide a seating system that is easy to manufacture.

Yet another object of the disclosure is to provide a seating system that is cost effective.

Another object of the disclosure is to provide a seating system that is high quality.

Yet another object of the disclosure is to provide a seating system that has a long useful life.

Another object of the disclosure is to provide a seating system that is that is aesthetically pleasing.

These and other objects, features, or advantages of the disclosure will become apparent from the specification, figures, and claims.

BRIEF DESCRIPTION OF THE DRAWINGS

FIG. 18A is an elevation view of the counterbalance assembly, the view showing components of the counterbalance assembly in accordance with one or more arrangements; the view also showing the worm gear with helical features.

FIG. 18B is a front elevation view of the counterbalance assembly, the view showing components of the counterbalance assembly in accordance with one or more arrangements; the view also showing the worm gear of the counterbalance assembly.

FIG. 18C is a front perspective view of the counterbalance assembly, the view showing components of the counterbalance assembly in accordance with one or more arrangements; the view also showing the worm gear of the counterbalance assembly.

SUMMARY OF THE DISCLOSURE

Figure 1:
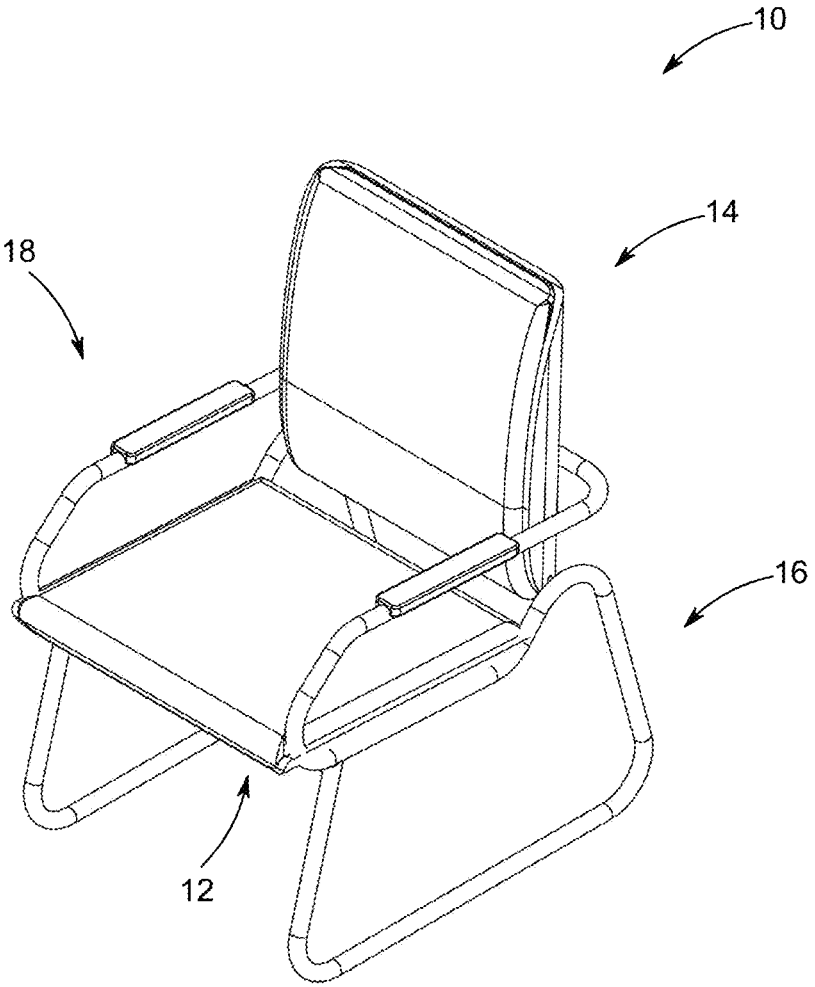
FIG. 1 is a front perspective view of the dining chair in accordance with one or more arrangements, the view showing the dining chair having a seat assembly, a backrest, a frame, and arm covers.
Figure 2:
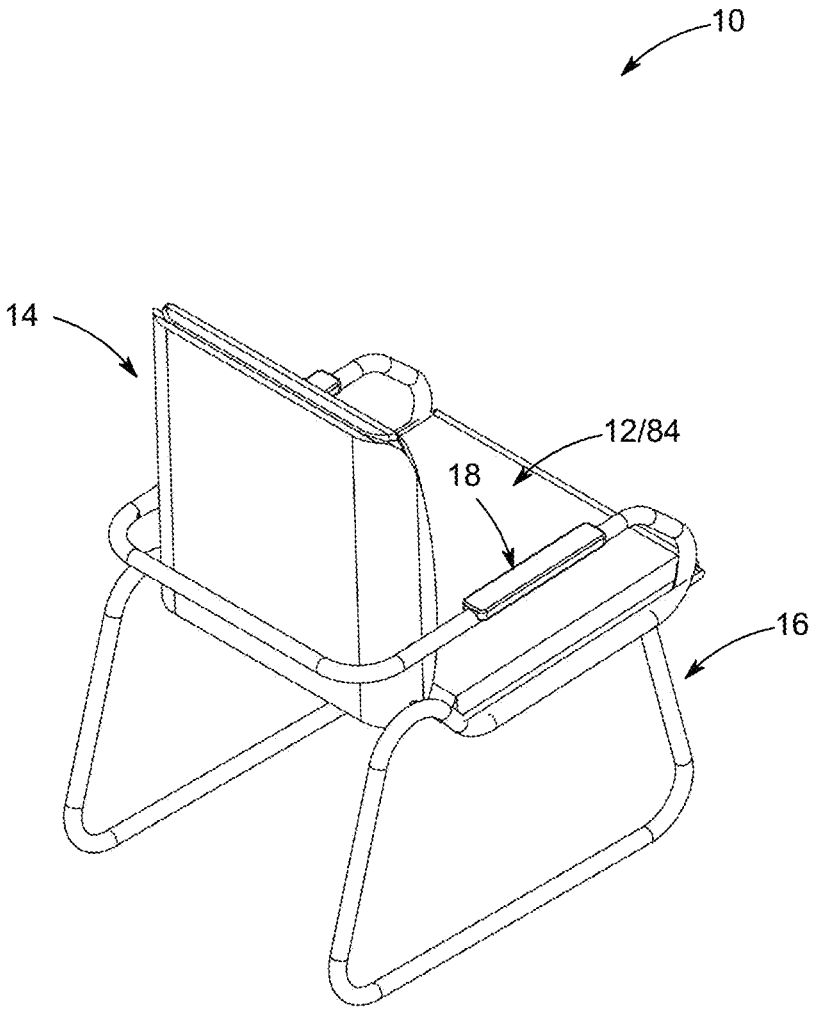
FIG. 2 is a back perspective view of the dining chair in accordance with one or more arrangements, the view showing the dining chair having a seat assembly, a backrest, a frame, and arm covers.
Figure 3:
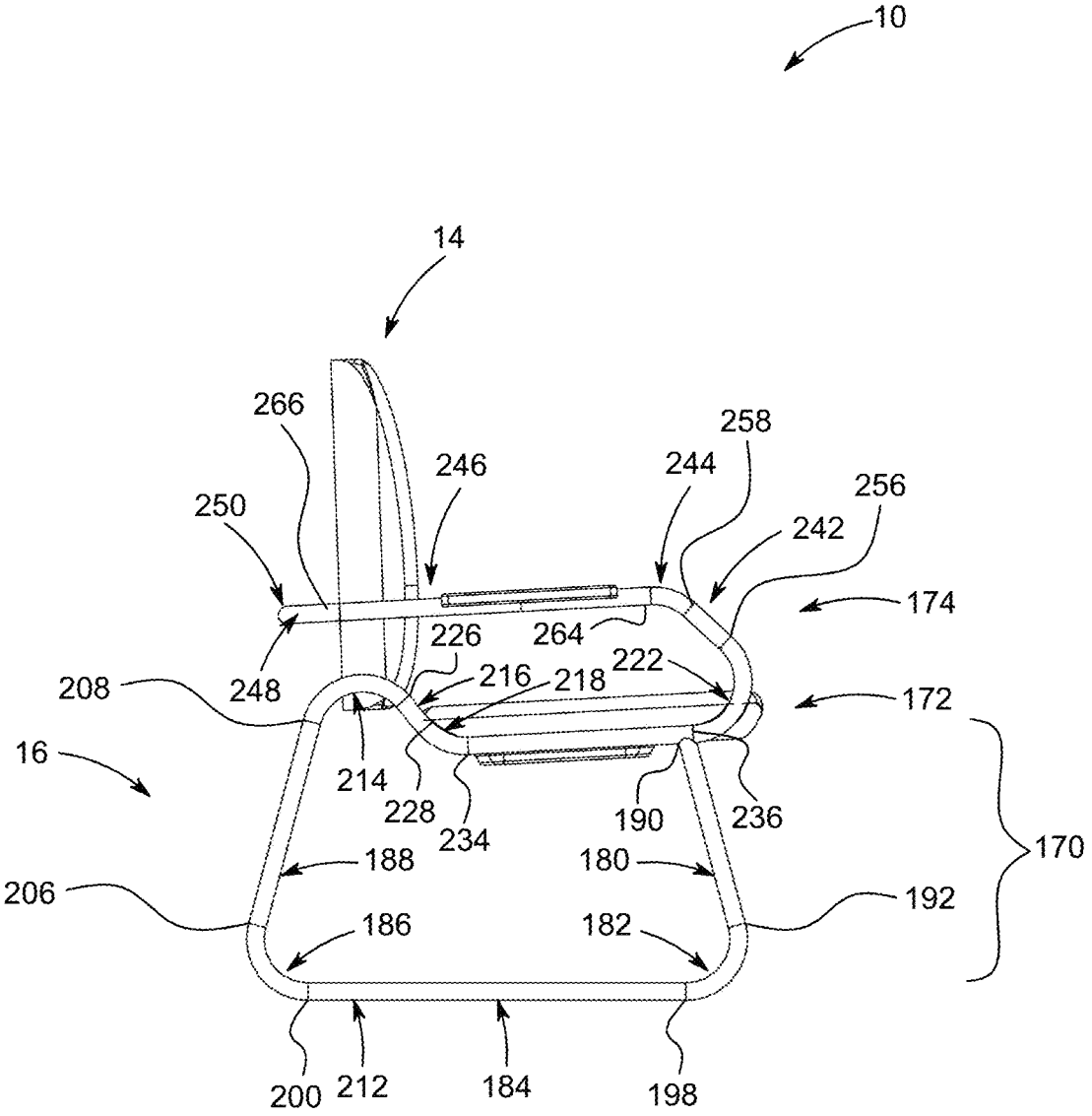
FIG. 3 is a right elevation view of the dining chair in accordance with one or more arrangements, the view showing the dining chair having a seat assembly, a backrest, and a frame; the view also showing the frame having a base section, a seat support section, and arm support section. The view showing the dining chair in an upright position.
Figure 4:
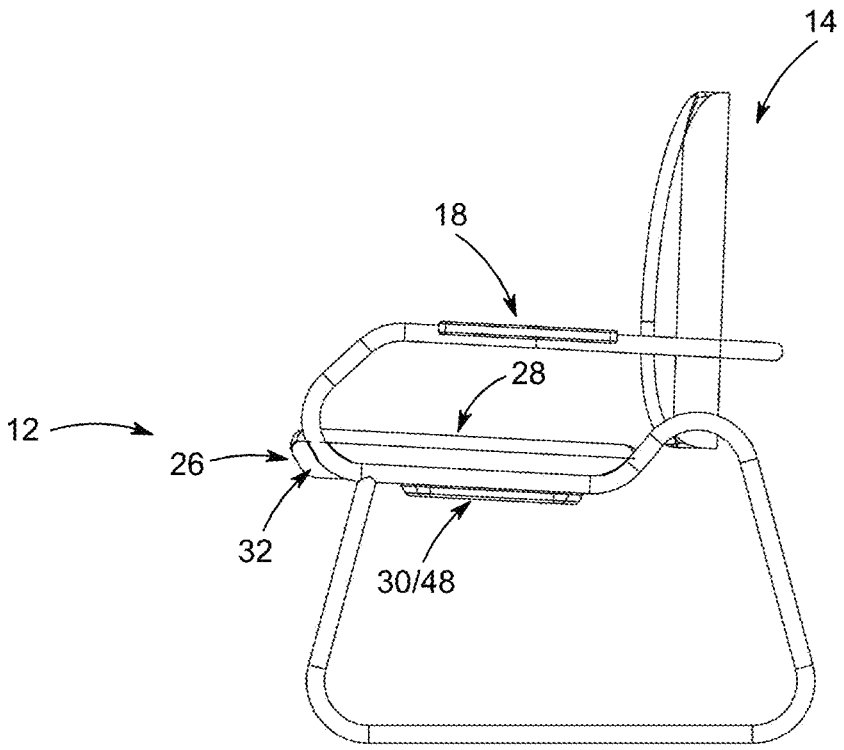
FIG. 4 is a left elevation view of the dining chair in accordance with one or more arrangements, the view showing the dining chair having a backrest, arm covers, a seat assembly; the view also showing the lower support member, cushion, and upper seat member of the seat assembly.
Figure 5:
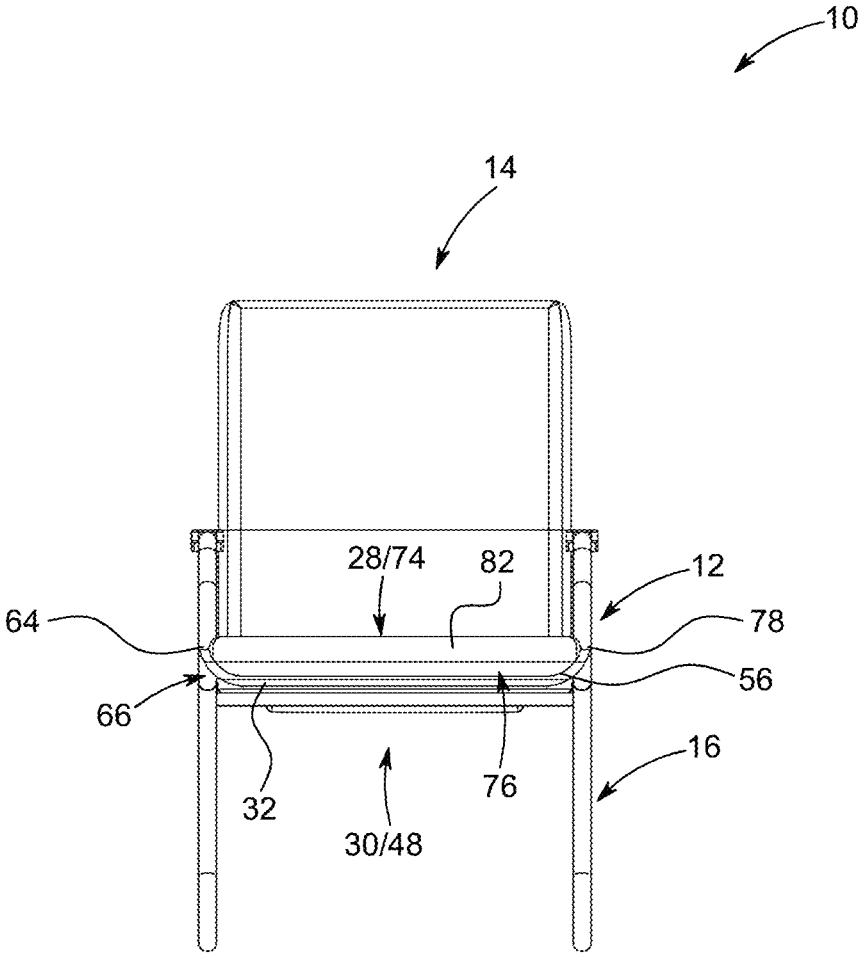
FIG. 5 is a front elevation view of the dining chair in accordance with one or more arrangements, the view showing the dining chair having a seat assembly with an upper seat member, a cushion, a backrest, and a frame.
Figure 6:
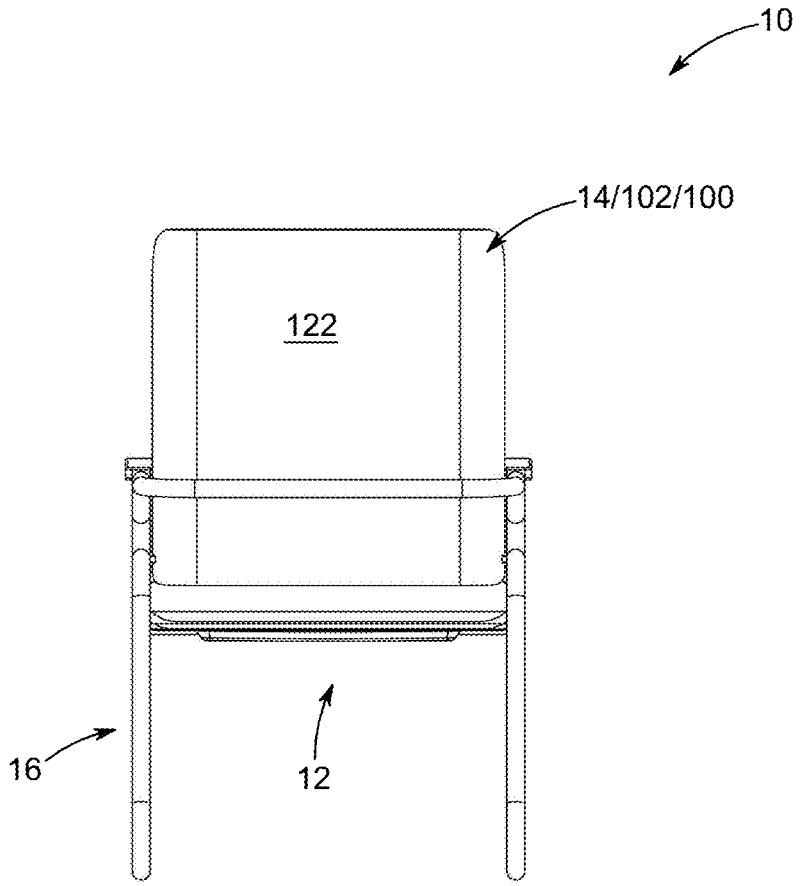
FIG. 6 is a back elevation view of the dining chair in accordance with one or more arrangements, the view showing the dining chair having a frame, a backrest, and a backrest support assembly; the view also showing the backrest support assembly having a rear support member and rear surface.
Figure 7:
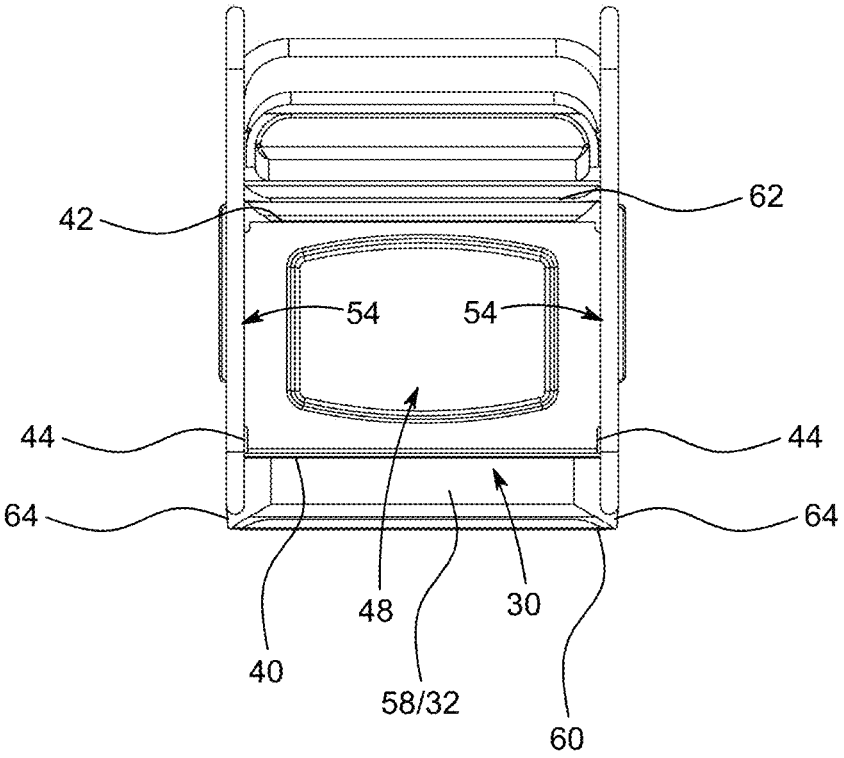
FIG. 7 is a bottom elevation view of the dining chair in accordance with one or more arrangements, the view showing the dining chair having an upper seat member with a front edge, a backrest edge, and side edges. The view also showing a lower seat member with a front edge, a backrest edge, side edges, center indent, and connection members.
Figure 8:
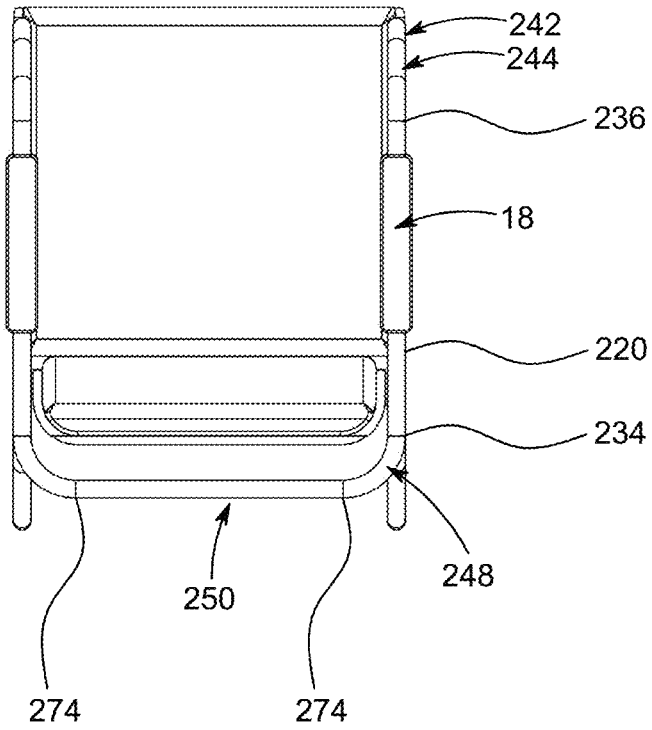
FIG. 8 is a top elevation view of the dining chair in accordance with one or more arrangements, the view showing the dining chair having an armrest and arm support section with a front sloped section, front bend, front vertical section, rear bend, and rear crossbar.
Figure 9:
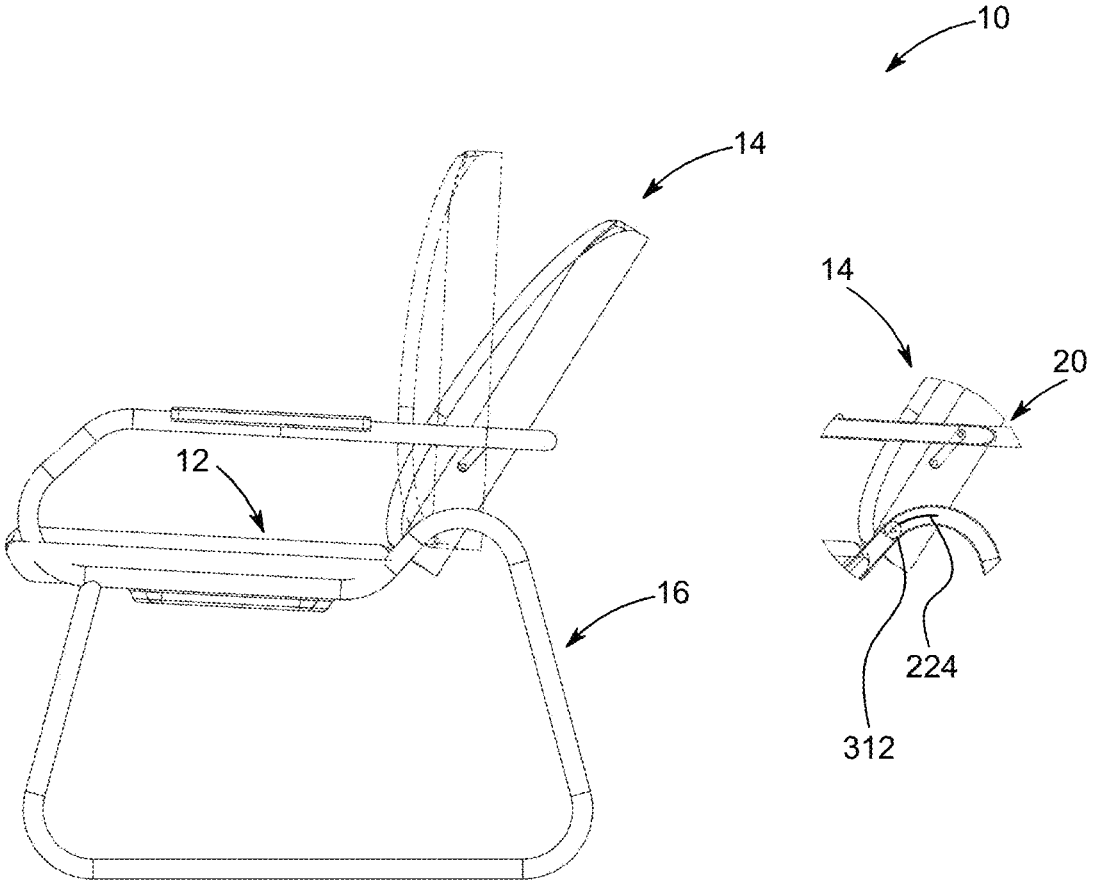
FIG. 9 is a left elevation view of the dining chair in accordance with one or more arrangements, the view showing the dining chair having a seat, a backrest, a frame, and a reclining assembly with a lower guide assembly and a slotted track. The view also showing the dining chair in a reclined position.
Figure 10:
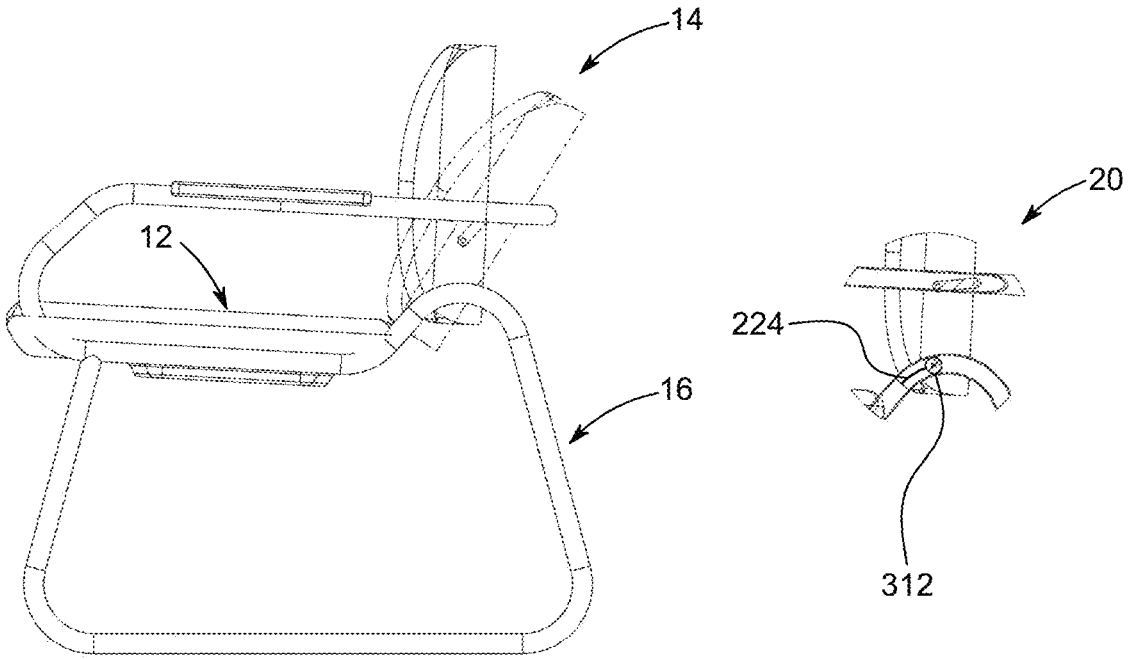
FIG. 10 is a left elevation view of the dining chair in accordance with one or more arrangements, the view showing the dining chair having a seat, a backrest, a frame, and a reclining assembly with a lower guide assembly and a slotted track. The view also showing the dining chair in an upright position.
Figure 11:
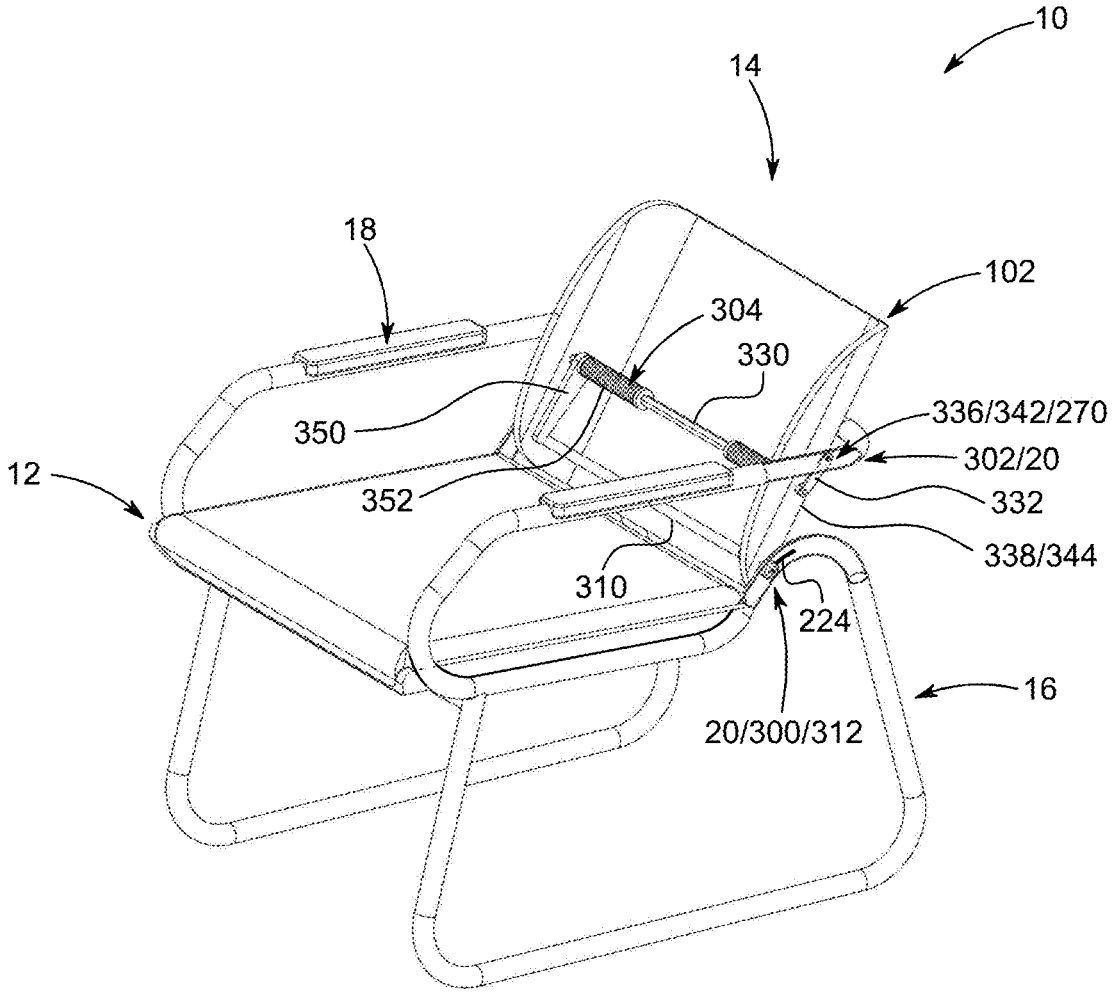
FIG. 11 is a front perspective view of the dining chair in accordance with one or more arrangements, the view showing the dining chair having a reclining assembly, a counterbalance assembly, an upper guide assembly, and a lower guide assembly. The view also showing the dining chair in a reclined position.
Figure 12:
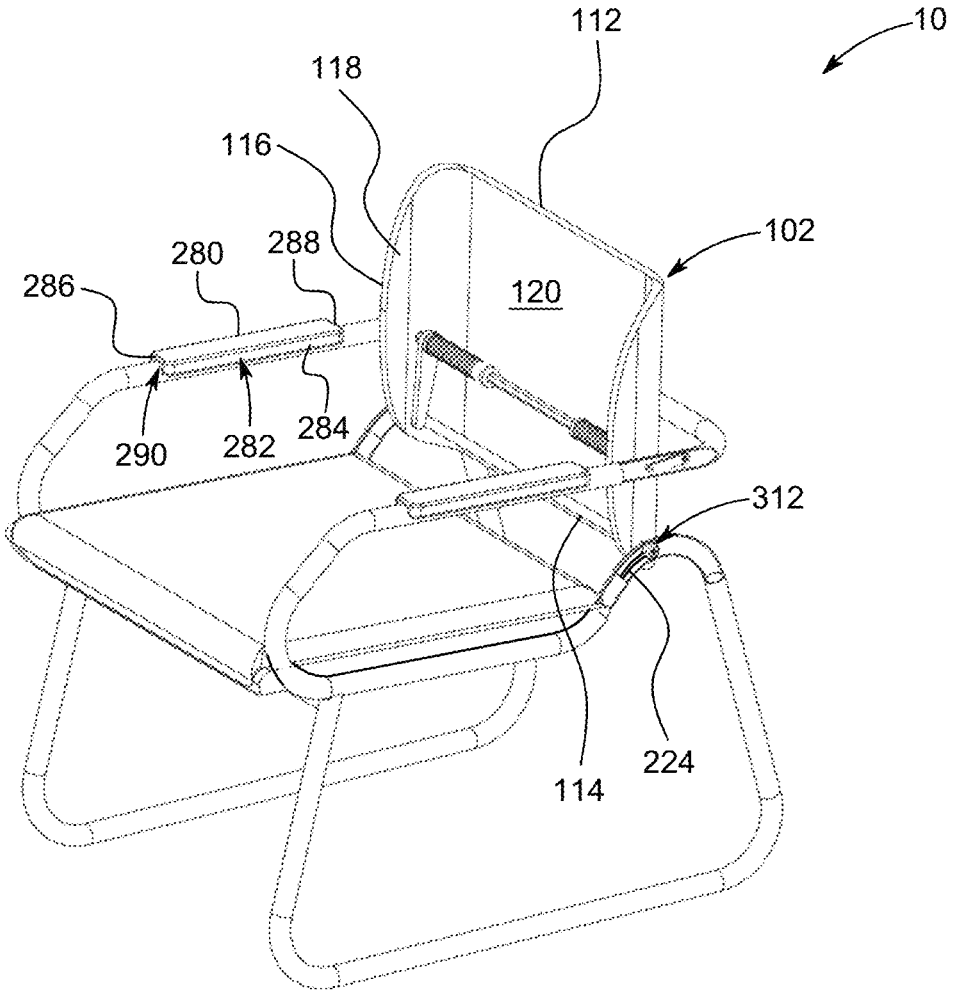
FIG. 12 is a front perspective view of the dining chair in accordance with one or more arrangements, the view showing the dining chair having arm covers with a top, a bottom, opposing sides, a front end, a backrest end, and a recessed cylindrical channel. The view also showing the dining chair having a rear support member, the view showing the dining chair in an upright position.
Figure 13:
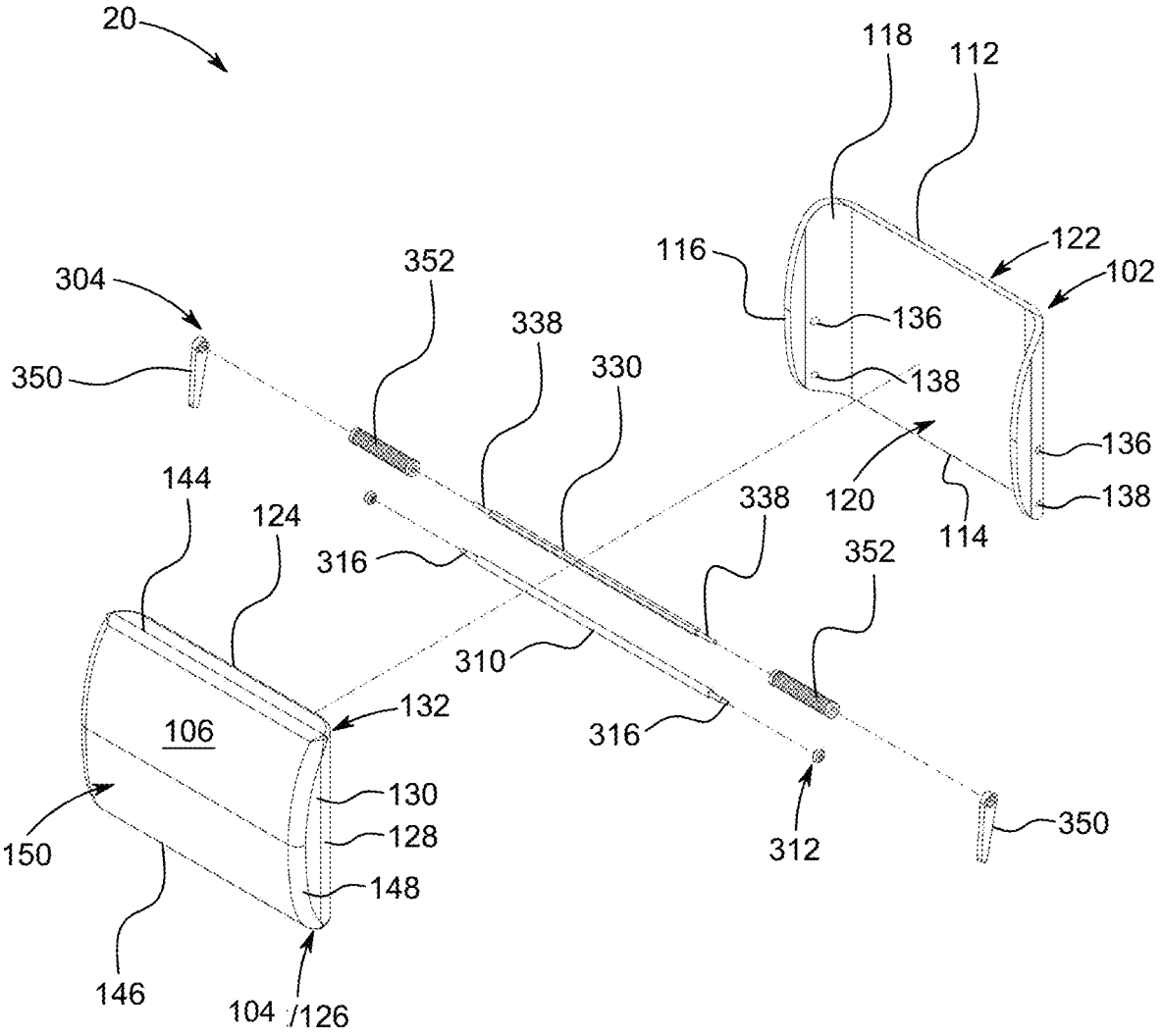
FIG. 13 is a front perspective exploded view of the reclining assembly, the view showing components of the reclining assembly in accordance with one or more arrangements.

In one or more embodiments, a seating system is provided having a frame, a seat operably connected to the frame, a backrest operably connected to the frame, and a counterbalance assembly, among other components. The backrest has a hollow interior. The counterbalance assembly is positioned within the hollow interior of the backrest. The backrest is configured to move between an upright position and a reclined position relative to the frame. The counterbalance assembly is configured to provide a counterbalance force to the backrest.

In one or more arrangements, the counterbalance assembly is configured to move the backrest to the upright position in absence of an opposing force. In one or more arrangements, the counterbalance assembly includes at least one torsion spring. In one or more arrangements, the counterbalance assembly includes a pair of torsion springs, with one torsion spring positioned adjacent each side of the backrest.

In one or more arrangements, the backrest is operably connected to the frame by a reclining mechanism configured to move the backrest between an upright position and a reclined position relative to the frame. In one or more arrangements, the reclining mechanism includes an upper guide assembly and a lower guide assembly. The upper guide assembly is configured to move an upper end of the backrest upward and forward when the backrest is moved to the upright position. The upper guide assembly is configured to move the upper end of the backrest downward and rearward when the backrest is moved to the reclined position. The reclining mechanism includes a lower guide assembly. The lower guide assembly is configured to move a lower end of the backrest upward and rearward when the backrest is moved to the upright position. The lower guide assembly is configured to move the lower end of the backrest downward and forward when the backrest is moved to the reclined position.

In one or more arrangements, the upper guide assembly includes a pair of links connected to opposite sides of the backrest. The pair of links operably connects the backrest to the frame. The counterbalance assembly is configured to rotate the pair of links to move the backrest between the upright position and the reclined position.

In one or more arrangements, the lower guide assembly includes a lower axle that extends through the backrest from side to side. The lower guide assembly includes a pair of rollers connected to opposite ends of the lower axle. The pair of rollers are configured to move along a slotted track within the frame.

In one or more arrangements, the seating system includes an access assembly with a hook bracket, receiving bracket, and hinge mechanism. The access assembly is configured to allow a user access to the counterbalance assembly.

DETAILED DESCRIPTION OF THE DISCLOSURE

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, backrest, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "either A or B". As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected, or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually, or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of chairs. However, the embodiments are not so limited. It is appreciated that the embodiments may be adapted for use in other applications which may be improved by the disclosed structures, arrangements and/or methods. The system is merely shown and described as being used in in the context of chairs for ease of description and as one of countless examples.

System 10:

With reference to the figures, a seating system 10 (or simply system 10) is presented. The system 10 is formed of any suitable size, shape, and design and is configured to hold and support an occupant in a seated position as well as facilitate movement between an upright position and a reclined position. In the arrangement shown, as one example, system 10 includes the following component pieces: a seat 12, a backrest 14, a frame 16, arm covers 18, and a reclining mechanism 20, among other components.

Seat 12:

Seat 12 is formed of any suitable size, shape, and design and is configured to provide a surface for seating of an occupant thereupon. In the arrangement shown, as one example, seat 12 includes a seat assembly 26 and a cushion 28 among other components. In this example arrangement, seat assembly 26 is configured to operably connect with frame 16 and support cushion 28 on a top surface of seat assembly 26.

Seat Assembly 26:

Seat assembly 26 is formed of any suitable size, shape, and design and is configured to provide a surface for seating of an occupant thereupon. In the arrangement shown, as one example, seat assembly 26 includes a lower support member 30 and an upper seat member 32.

Lower support member 30 is formed of any suitable size, shape, and design and is configured to operably connect with frame 16 and support upper seat member 32. In the arrangement shown, as one example, lower support member 30 has a generally rectangular planar shaped top 56 and bottom 58 extending between a front edge 40, a back edge 42, and opposing side edges 44. In this example arrangement, lower support member 30 has an outer perimeter positioned in an upper plane and a center indent 48, in which lower support member 30 extends downward to a lower plane. Center indent 48 forms a recess in an upper surface of lower support member 30 to accommodate flexing of webbing 70 (not shown) of upper seat member 32. Center indent 48 also provide structural rigidity to seat assembly 26.

In this example arrangement, lower support member 30 includes flanges extending outward from opposing side edges 44 to form connection members 54. In one or more arrangements, connection members 54 are configured engage frame 16 in a manner to hold seat 12 in place on the frame 16. Additionally or alternatively, in one or more arrangements, connection members 54 and frame 16 may include holes (not shown) to facilitate connection of connection members 54 of seat 12 to frame 16, for example using bolts. However, embodiments are not so limited. Rather, it is contemplated that in various arrangements, connection members 54 may be attached to frame 16 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Upper seat member 32 is formed of any suitable size, shape, and design and is configured to operably connect with lower support member 30 and cushion 28 and provide a surface to support cushion 28. In the arrangement shown, as one example, upper seat member 32 has a generally rectangular planar shape extending between a front edge 60, a backrest edge 62, and opposing side edges 64. In this example arrangement, upper seat member 32 has contoured side portions 66 that curve upward proximate to opposing side edges 64. However, the embodiments are not so limited. Rather, it is contemplated that in various arrangements, various portions of upper seat member 32 may be contoured for comfort and/or aesthetic appearance.

In one or more arrangements, upper seat member 32 is connected to lower support member 30 by fasteners (not shown) through holes (not shown) in lower support member 30. However, the embodiments are not so limited. Rather, it is contemplated that in various arrangements, upper seat member 32 may be attached to lower support member 30 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

In one or more arrangements, upper seat member 32 has a rectangular opening 68 (not shown) in a center portion of upper seat member 32 and webbing 70 extending across opening 68. Webbing 70 provides a strong seating base while offering some give to provide a more comfortable seating surface.

Cushion 28:

Cushion 28 is formed of any formed of any suitable size, shape, and design and is configured to comfortably support an occupant sitting thereon. In the arrangement shown, as one example, cushion 28 has a generally cuboid shape having a top 74, a bottom 76, and sides 78. In this example arrangement, cushion 28 includes a foam core 82 covered by upholstery material 84 on at least one side.

Foam Core 82:

Foam core 82 is formed of any suitable size, shape, and design and is configured to provide comforting support when seated upon. In one or more arrangements, foam core 82 is also configured to prevent water from becoming trapped within the foam core 82. For instance, in some various arrangements, foam core 82 may be comprised of one or more foams (e.g., reticulated foam, polyurethane foam, open cell rubber and/or any other foam material), feathers, fibers, polyester, batting and/or any other fill material for cushions.

Upholstery Material 84:

Upholstery material 84 is formed of any formed of any suitable size, shape, and design and is configured to provide a comfortable seating surface and aesthetically pleasing appearance. In some various arrangements, upholstery material 84 may include but is not limited to, for example, natural materials such as cotton, silk, wool, linen, and/or leather, or synthetic material such as polyester, polypropylene, nylon, acrylic, rayon, vinyl, and/or synthetic leathers, and/or any other upholstery material.

In one or more arrangements, bottom 76 of cushion 28 is attached to a top 56 of upper seat member 32 of seat assembly 26. It is contemplated that in various arrangements, cushion 28 may be attached to upper seat member 32 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

Backrest 14:

The backrest 14 is formed of any suitable size, shape, and design and is configured to provide a surface to provide backrest support for an occupant seated on seat 12. In the arrangement shown, as one example, backrest 14 includes a backrest support assembly 100 and a cushion 106 among other components.

Backrest Support Assembly 100:

Backrest support assembly 100 is formed of any suitable size, shape, and design and is configured to provide a backrest rest surface for an occupant seated on seat 12. In the arrangement shown, as one example, backrest support assembly 100 includes a rear support member 102 and a front support member 104 that form a hollow interior 108 when joined together.

Rear Support Member 102 and Front Support Member 104:

Rear support member 102 and front support member 104 are formed of any suitable size, shape, and design and are configured to form a hollow interior 108 and provide a forward surface suitable for operation as a backrest rest. In the arrangement shown, as one example, rear support member 102 has a generally rectangular planar shape having a front surface 120 and a rear surface 122 extending between an upper edge 112, a lower edge 114, and opposing side edges 116. In this example arrangement, rear support member 102 has contoured side portions 118 that curve forward proximate to side edges 116. In the arrangement shown, rear support member 102 includes an upper set of holes 136 and a lower set of holes 138 positioned in side portions 118 to facilitate connection with reclining mechanism 20.

In one or more arrangements, front support member 104 has a front surface 130 and rear surface 132 extending between an upper edge 124, lower edge 126, and opposing side edges 128.

In this example arrangement, front support member 104 has a complementary shape to rear support member 102 so that upper edge 124, lower edge 126, and side edges 128 align with upper edge 112, lower edge 114, and opposing side edges 116 of rear support member 102 when front support member 104 and rear support member 102 are connected together. In this example arrangement, rear surface 132 of front support member 104 includes a recess (not shown) to form hollow interior 108 when front support member 104 and rear support member 102 are connected together.

Cushion 106:

In the arrangement shown, backrest 14 includes a cushion 106 connected to front surface 130 of front support member 104. Cushion 106 is formed of any formed of any suitable size, shape, and design and is configured to provide a comfortable backrest support surface for an occupant of system 10. In the arrangement shown, as one example, cushion 106 has a generally rectangular shape, when viewed from the front, having a top 144, a bottom 146, opposing sides 148, a front surface 150, and a backrest surface 152 (not shown). In this example arrangement, front surface 150 of cushion 106 has an outward curved shape when viewed from the side. In this example arrangement, cushion 106 includes a foam core 82 covered by upholstery material 84 on at least one side as discussed with reference to cushion 28. As described with reference to cushion 28, cushion 106 may be attached to front support member 104 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

In one or more arrangements, front support member 104 is connected to rear support member 102 by fasteners (not shown) through holes (not shown) in front support member 104 and/or rear support member 102. However, the embodiments are not so limited. Rather, it is contemplated that in various arrangements, front support member 104 may be attached to rear support member 102 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Additionally or alternatively, in one or more arrangements front support member 104 and cushion 106 of backrest 14 may be connected to rear support member 102 of backrest 14 by one or more magnetic components 158 (e.g. magnetic and/or ferric materials). Use of magnetic components 158 to facilitate connection between front support member 104 and rear support member 102 may be useful, for example, to facilitate easy removal of front support member 104 and cushion 106 for adjustment or maintenance of one or more components of counterbalance assembly 304 positioned within hollow interior 108. For example, in one or more arrangements, it may be desirable to facilitate easy removal of front support member 104 and cushion 106 for adjustment of tensioner assembly 348 of counterbalance assembly 304 to provide a desired amount of resistance force to backrest 14 when a user reclines. In one or more arrangements, front support member 104 and/or rear support member 102 have features 160 (e.g., protrusions) configured to hold the magnetic components 158 connected to front support member 104 in close proximity to the magnetic components 158 connected to rear support member 102 when front support member 104 and rear support member 102 are connected together, thereby ensuring a strong magnetic bond.

Frame 16:

Frame 16 is formed of any suitable size, shape, and design and is configured to operably connect with and seat 12, backrest 14, and reclining mechanism 20 of system 10 to provide seating for an occupant of system 10. In the arrangement shown, as one example, frame 16 is a tubular chair frame having a base section 170, a seat support section 172, and an arm support section 174, among other components. In the example arrangement shown, frame 16 is formed of cylindrical shaped tube(s). However, the arrangements are not so limited. Rather, it is contemplated that frame 16 may be formed of materials of any type including but not limited to, for example, tubing, pipes, rods, wires, bars, structural stock, and/or any other type of material and may have various shapes including but not limited to, for example, round, triangular, square, pentagonal, hexagonal, heptagonal, octagonal, flat or rectangular, rebar, angled, tee, channel, I-beam, H-beam, wide flange, or any other shape.

Base Section 170:

Base Section 170 of frame 16 is formed of any suitable size, shape, and design and is configured to provide stable support of system 10 on a floor. In the arrangement shown, as one example, base section 170 includes front legs 180, lower front corners 182, side bars 184, lower rear corners 186, and rear legs 188, among other components.

In this example arrangement, front legs 180 have a generally elongated tube shape extending from upper ends 190, connected to seat support section 172, to lower ends 192 connected to lower front corners 182. In this example arrangement, lower front corners 182 have a generally elongated tube shape extending from lower ends 192 and curving rearward before connecting to front ends 198 of side bars 184. In this example arrangement, side bars 184 each have an elongated tube shape extending from front end 198, where side bars 184 are connected to lower front corner 182, to a rear end 200, where side bars 184 are connected to lower rear corner 186. In one or more arrangements, side bars 184 may include one or more drain holes 212 positioned in a lower side of side bars 184 to facilitate draining of fluid that enters or condenses inside of frame 16. In this example arrangement, lower rear corners 186 have a generally elongated tube shape extending from rear ends 200 of side bars 184 and curving upward before connecting to lower ends 206 of rear legs 188. In this example arrangement, rear legs 188 have an elongated tube shape extending from lower ends 206, where rear legs 188 are connected to lower rear corners 186, to upper ends 208, where rear legs 188 connect with seat support section 172.

Seat Support Section 172:

Seat support section 172 of frame 16 is formed of any suitable size, shape, and design and is configured to support and facilitate connection of frame 16 with seat 12, while operably connecting arm support section 174 to base section 170. In the arrangement shown, as one example, seat support section 172 includes upper rear corners 214, rear sloped sections 216, center corners 218, side bars 220, and upper front corners 222, among other components.

In this example arrangement, upper rear corners 214 have a generally elongated tube shape extending from upper ends 208 of rear legs 188 and curving upward and forward and then downward and forward before connecting to upper ends 226 of rear sloped sections 216. In this example arrangement, upper rear corners 214 include a slotted track 224 positioned on an inner side of upper rear corners 214. As discussed in more detail with reference to reclining mechanism 20, slotted track 224 is configured to facilitate guiding a lower end of backrest 14 along a designated path when being moved from an upright position to a reclined position.

In this example arrangement, rear sloped sections 216 have a generally elongated tube shape extending downward at an angle from upper ends 226, where rear sloped sections 216 connect to upper rear corners 214 to lower ends 228, where rear sloped sections 216 connect to center corners 218. In this example arrangement, center corners 218 have a generally elongated tube shape extending from lower ends 228 of rear sloped sections 216 and curving forward to rear ends 234 of side bars 220. In this example arrangement, side bars 220 each have an elongated tube shape extending from rear ends 234, where side bars 220 are connected to center corners 218, to a front end 236 of side bars 220, where side bars 220 are connected to upper front corners 222. In this example arrangement, upper front corners 222 have a generally elongated tube shape extending from front ends 236 of side bars 220 and curving upward and forward and then slightly rearward before connecting to lower ends 256 of front sloped section 242 of arm support section 174.

Arm Support Section 174:

Arm support section 174 of frame 16 is formed of any suitable size, shape, and design and is configured to provide an arm rest for an occupant seated in seat 12 while operably connecting backrest 14 with frame 16. In the arrangement shown, arm support section 174 includes front sloped sections 242, front bends 244, a pair of arms 246, rear bends 248, and a rear crossbar 250 connected between rear bends 248.

In this example arrangement, front sloped sections 242 each have a contoured elongated shape extending rearward at an angle from a lower end 256, where front sloped sections 242 connect to upper front corners 222 of seat support section 172, to an upper end 258, where front sloped sections 242 connect to front bend 244. In this example arrangement, front bends 244 have a generally elongated tube shape extending from upper end 258 of front sloped sections 242 and curving rearward before connecting to front end 264 of arms 246. In this example arrangement, arms 246 each have an elongated tube shape extending from front end 264 to rear ends 266, where arms 246 are connected to rear bends 248. In this example arrangement, arms 246 include holes 270 located proximate to rear ends 266 and extending sideways through arms 246 to facilitate connection with reclining mechanism 20. In this example arrangement, rear bends 248 connect arms 246 to rear crossbar 250. In this example arrangement, rear bends 248 have a generally elongated tube shape extending from rear end 266 of arms 246 and curving inward before connecting to opposing ends 274 of rear crossbar 250. In this example arrangement, rear crossbar 250 has an elongated tube shape extending between the opposing ends 274 to operably connect right and left sides of the frame 16 together.

In one or more arrangements shown, components of frame 16 are illustrated as separate components and/or sections that are connected together. However, the embodiments are not so limited. Rather, it is contemplated that, in one or more arrangements, frame 16 may be formed as a unitary frame, for example, formed by bending a single tube.

Arm Covers 18:

In the arrangement shown, system 10 includes arm covers 18 positioned on top of arms 246. Arm covers 18 are formed of any suitable size, shape, and design and are configured to connect with arms 246 and provide comfortable arm rests for an occupant seated in seat 12 while providing an aesthetically pleasing appearance. In the arrangement shown, as one example, arm covers 18 each have a generally elongated rectangular shape having a top 280, a bottom 282, and opposing sides 284 extending between a front end 286 and a backrest end 288. In this example arrangement, arm covers 18 each have a recessed cylindrical channel 290 formed in bottom 282 and extending from front end 286 to backrest end 288. In this example arrangement, recessed cylindrical channels 290 are configured to fit over arms 246.

In one or more arrangements, arm covers 18 are connected to arms 246 by a set of fasteners 292 (not shown) such as bolts which extend through holes (not shown) in arms 246 and connect with arm covers 18. As another example, in one or more arrangements, fasteners 292 may include connectors extending upward from arms 246 and are configured to be received and connect with receivers formed in bottom 282 of arm covers 18. For instance, bottom 282 may include keyhole shaped openings having a wide portion and a narrow portion. Such openings may be configured to receive a head of connectors of arms 246 and lock with the connectors by sliding arm covers 18 so the head is positioned in the narrow portion, thereby connecting arm covers 18 to arms 246. In one or more arrangements, the keyhole shaped opening may have a J-shape or L-shape, for example, to prevent arm are covers 18 from being disconnected from arms 246 via movement or arm covers 18 in a single direction.

However, embodiments are so limited. Rather, it is contemplated that in various arrangements, arm covers 18 may be connected to arms 246 of frame 16 using various methods or means including but not limited to, for example, screws, bolts, clamps, pins, rivets, welding, snap connectors, interconnects (e.g., slide connectors, rotational connectors, or any other type of interconnect), friction fit connectors, adhesives, chemical bonding, and/or any other process or means that results in a permanent of semi-permanent connection.

Materials:

In the arrangement shown, upper seat member 32 of seat assembly 26 of seat 12 and rear support member 102 of backrest support assembly 100 of backrest 14 and arm covers 18 are formed of a wooden material, which provides an aesthetically pleasing appearance. However, the embodiments are not so limited. Rather, it is contemplated that in various arrangements, upper seat member 32, rear support member 102, arm covers 18 and/or various other components of seating system 10 may be formed of various natural or synthetic materials including but not limited to metals, woods, plastics, composites, laminins, of any other material.

Reclining Mechanism 20:

Reclining mechanism 20 is formed of any suitable size, shape, and design and is configured to facilitate connection of backrest 14 with frame 16 and facilitate movement of backrest 14 between up upright position and a reclined position. In the arrangement shown, as one example, reclining mechanism 20 is configured to recline backrest 14 by moving an upper edge 112/124 of backrest 14 downward and rearward while also moving lower edge 114/126 of backrest 14 downward and forward. In the arrangement shown, as one example, reclining mechanism 20 includes a lower guide assembly 300, an upper guide assembly 302, and a counterbalance assembly 304.

Lower Guide Assembly 300:

Lower guide assembly 300 is formed of any suitable size, shape, and design and is configured to connect with and guide a lower portion of backrest 14 along slotted track 224 in frame 16 when backrest 14 is moved from an upright position to a reclined position.

In one or more arrangements shown, as one example, lower guide assembly 300 includes a lower axle 310 and a pair of rollers 312 among other components. In this example arrangement, lower axle 310 has an elongated cylindrical shape extending between opposing ends 316. In this example arrangement, lower axle 310 extends through lower set of holes 138 in side portions 118 of rear support member 102 of backrest 14. In this example arrangement, lower axle 310 extends outward from the sides of backrest 14 through slotted track 224 in frame 16 to connect with rollers 312 positioned within frame 16 at opposing ends 316 of lower axle 310.

Figures 14A, 14B, 14C:
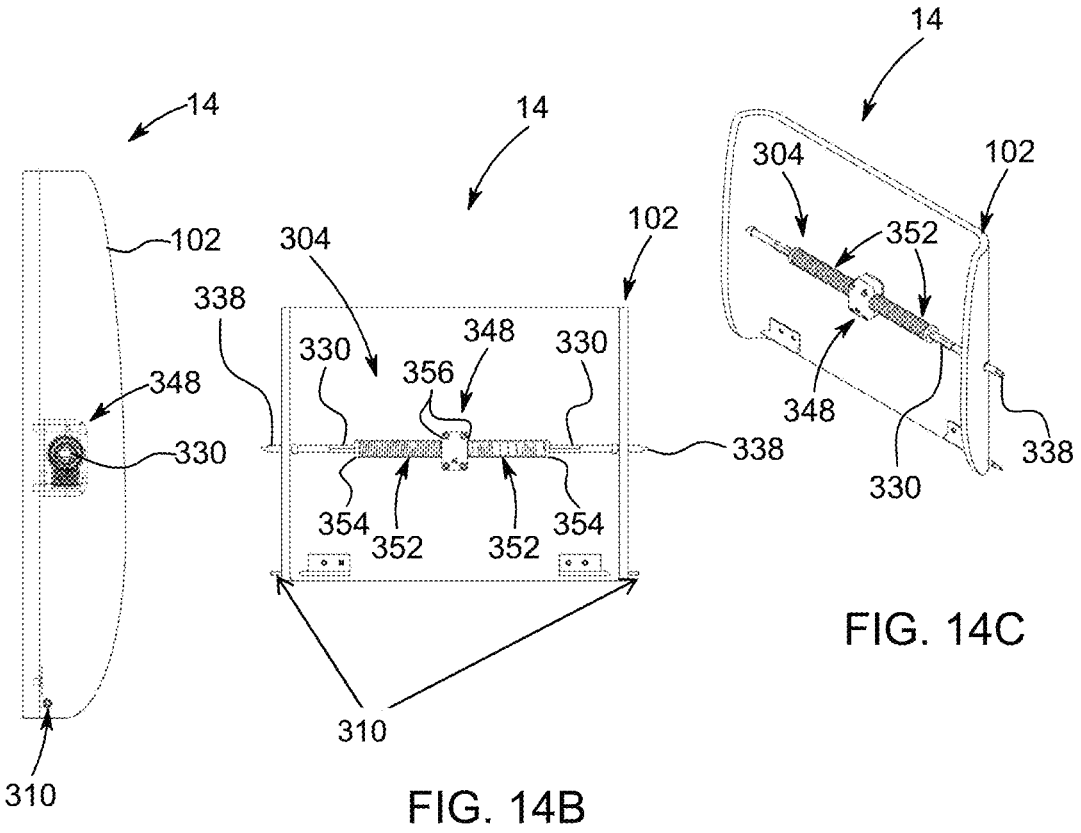
FIG. 14A is a section view of the reclining assembly, the view showing components of the reclining assembly in accordance with one or more arrangements.
FIG. 14B is a front elevation of the reclining assembly, the view showing components of the reclining assembly in accordance with one or more arrangements.
FIG. 14C is a front perspective view of the reclining assembly, the view showing components of the reclining assembly in accordance with one or more arrangements.
Figure 15A:
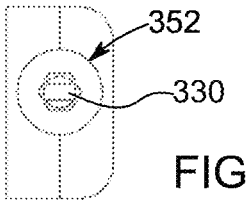
FIG. 15A is an elevation view of the counterbalance assembly, the view showing components of the counterbalance assembly in accordance with one or more arrangements.
Figure 15C:
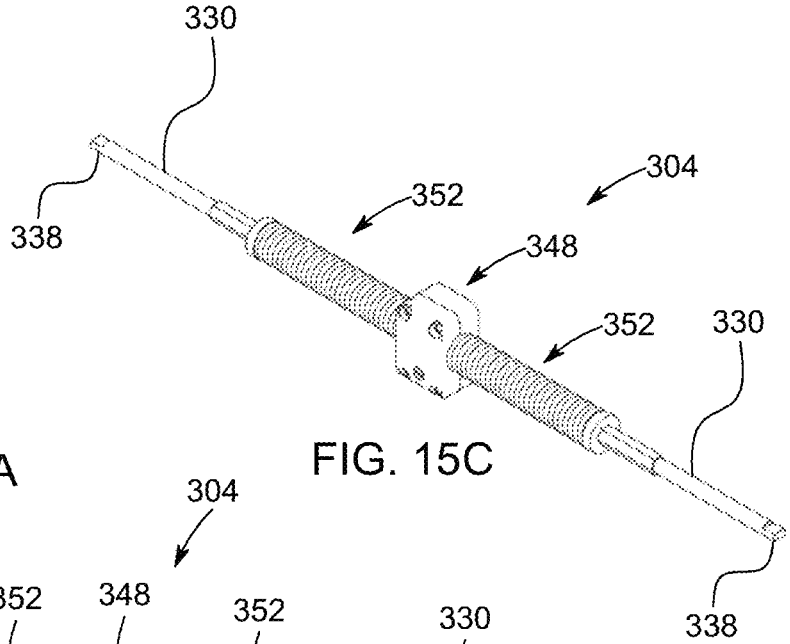
FIG. 15C is a front perspective view of the counterbalance assembly, the view showing components of the counterbalance assembly in accordance with one or more arrangements.
Figure 15B:
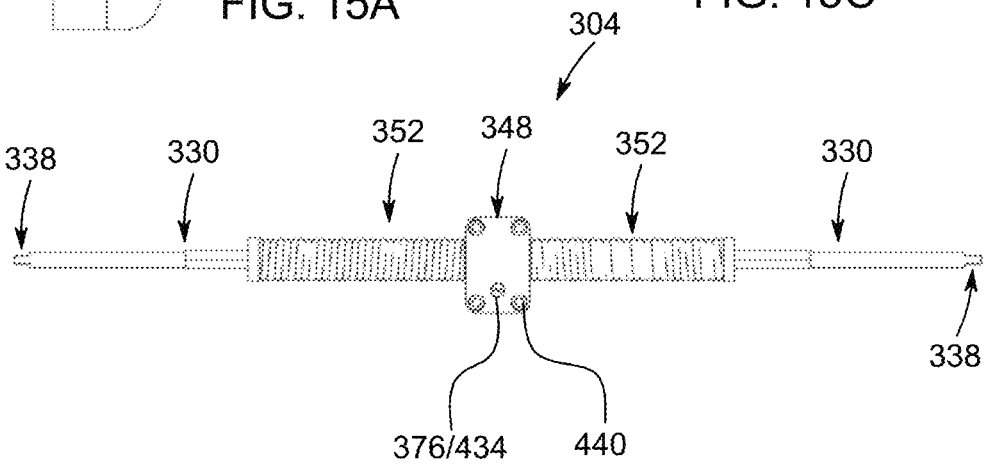
FIG. 15B is a front elevation view of the counterbalance assembly, the view showing components of the counterbalance assembly in accordance with one or more arrangements.
Figure 16A:
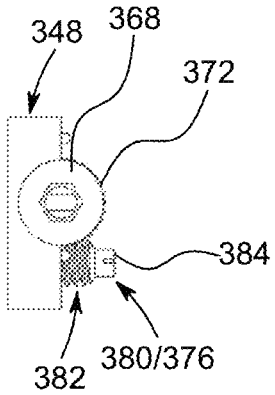
FIG. 16A is an elevation view of the counterbalance assembly, the view showing components of the counterbalance assembly in accordance with one or more arrangements; the view also showing the worm gear with helical features.
Figure 16C:
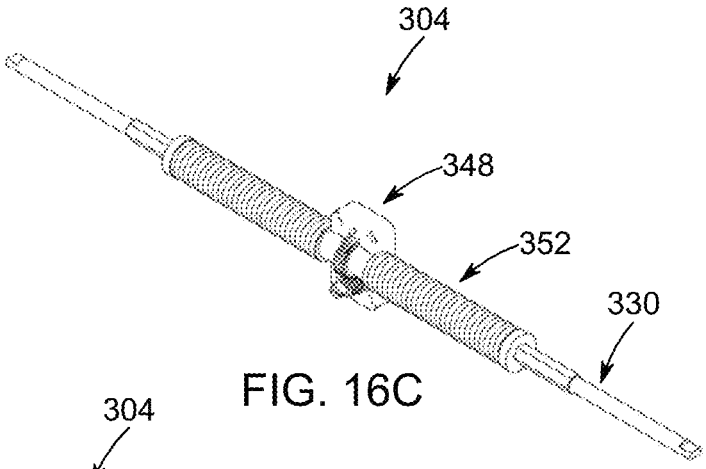
FIG. 16C is a front perspective view of the counterbalance assembly, the view showing components of the counterbalance assembly in accordance with one or more arrangements; the view also showing the tensioner assembly of the counterbalance assembly.
Figure 16B:
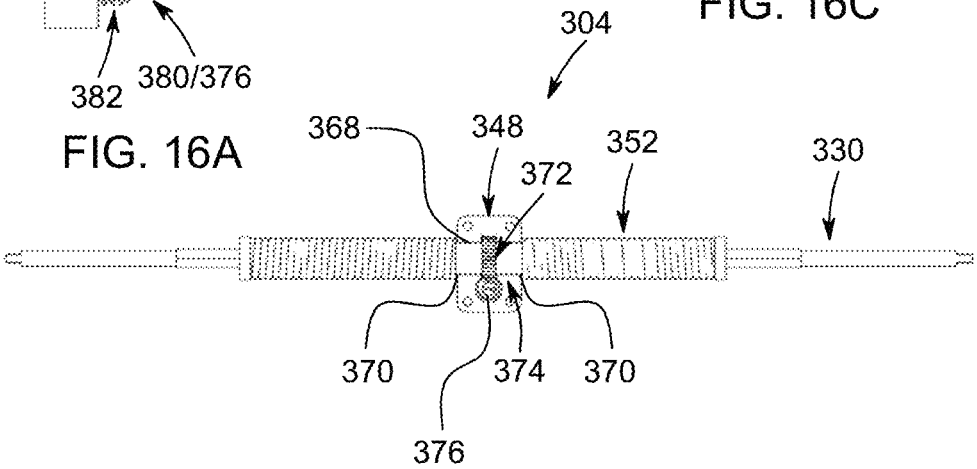
FIG. 16B is a front elevation view of the counterbalance assembly, the view showing components of the counterbalance assembly in accordance with one or more arrangements; the view also showing the worm gear of the counterbalance assembly.
Figure 17:
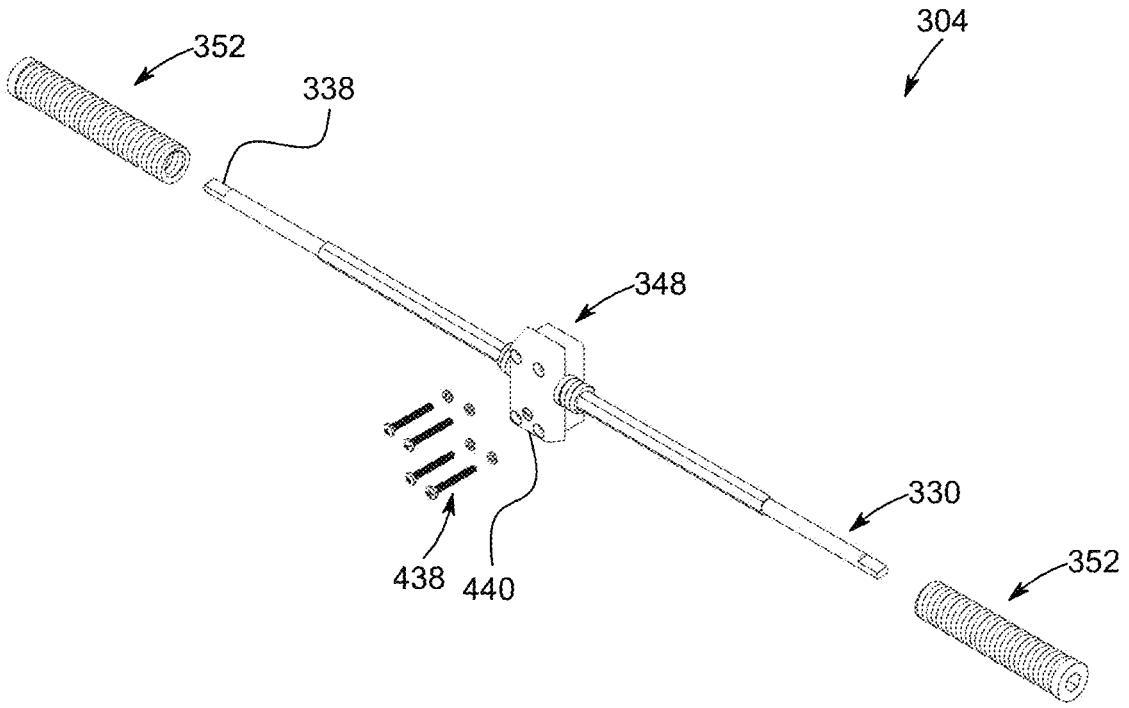
FIG. 17 is a front perspective view of the tensioner assembly in accordance with one or more arrangements, the view showing the housing with holes and the torsion springs assembly.
Figure 19:
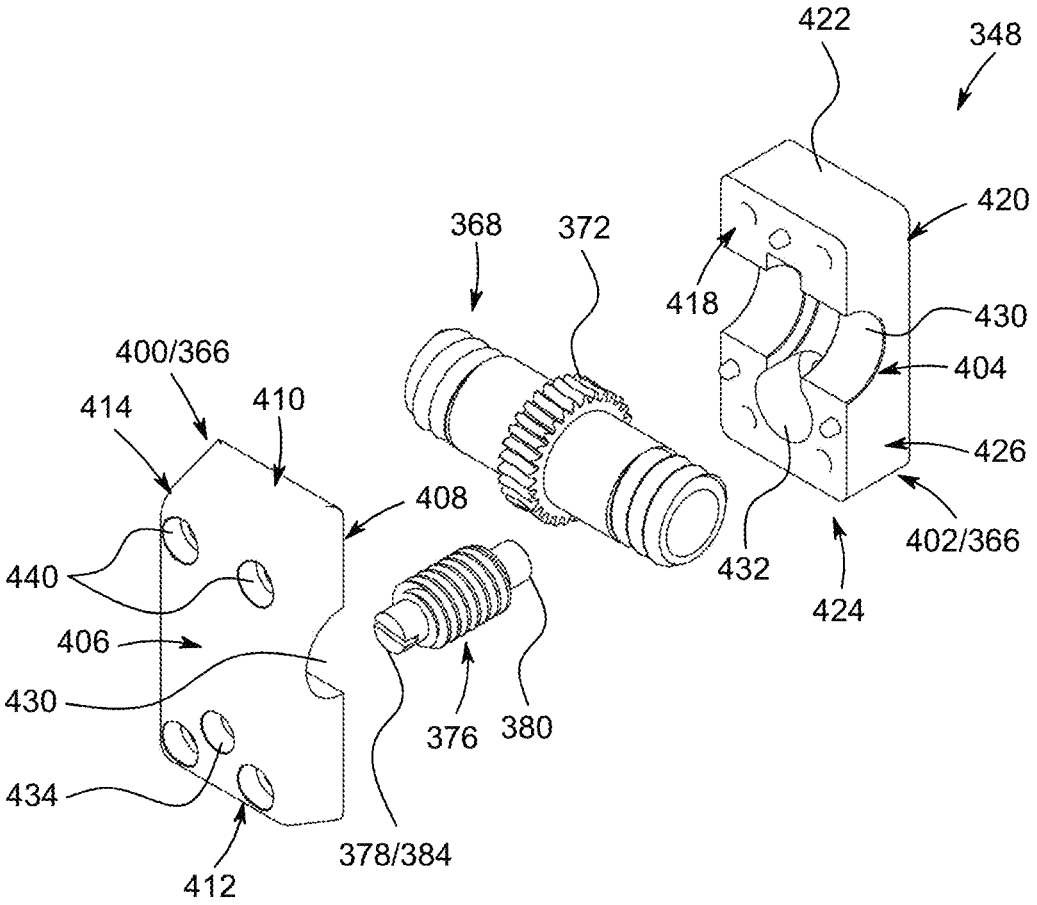
FIG. 19 is an exploded perspective view of the tensioner assembly in accordance with one or more arrangements, the view showing the tube with teeth. The view also showing the housing with a front plate and a back plate.
Figure 20:
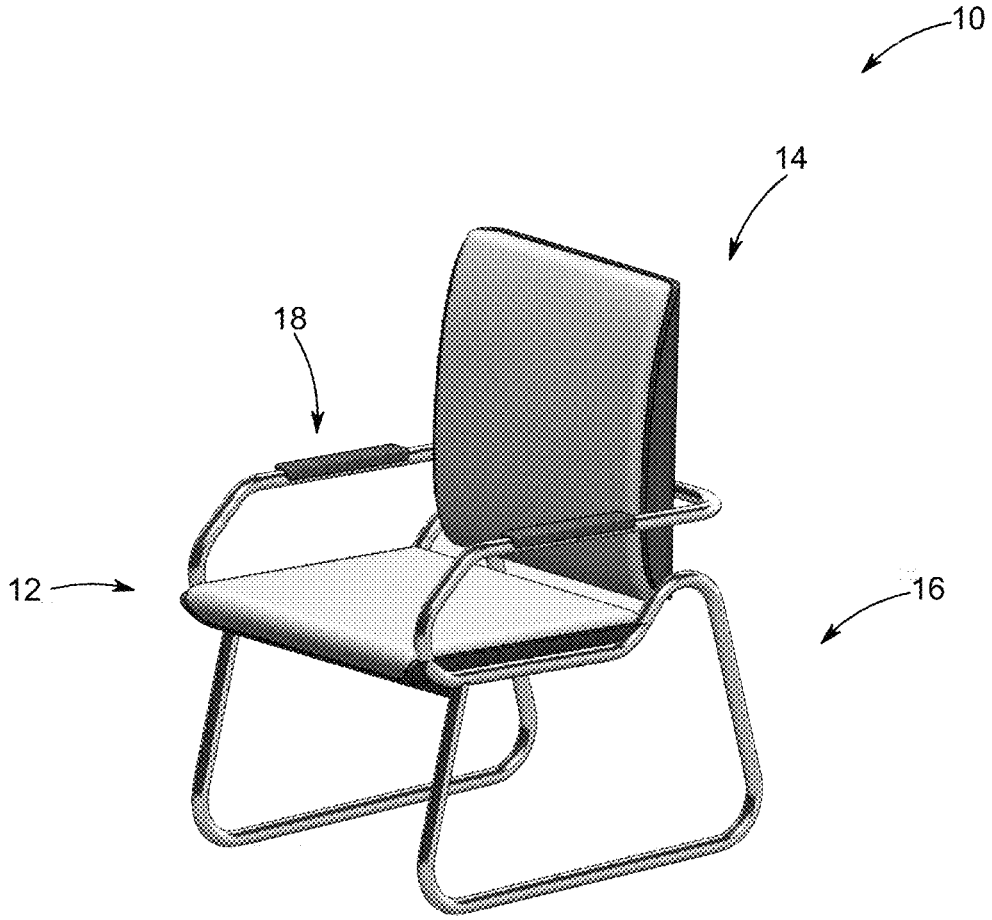
FIG. 20 is a front perspective view of the dining chair in accordance with one or more arrangements, the view showing the dining chair having a backrest, a frame, a seat, and arm covers. The view also showing the dining chair in an upright position.
Figure 21:
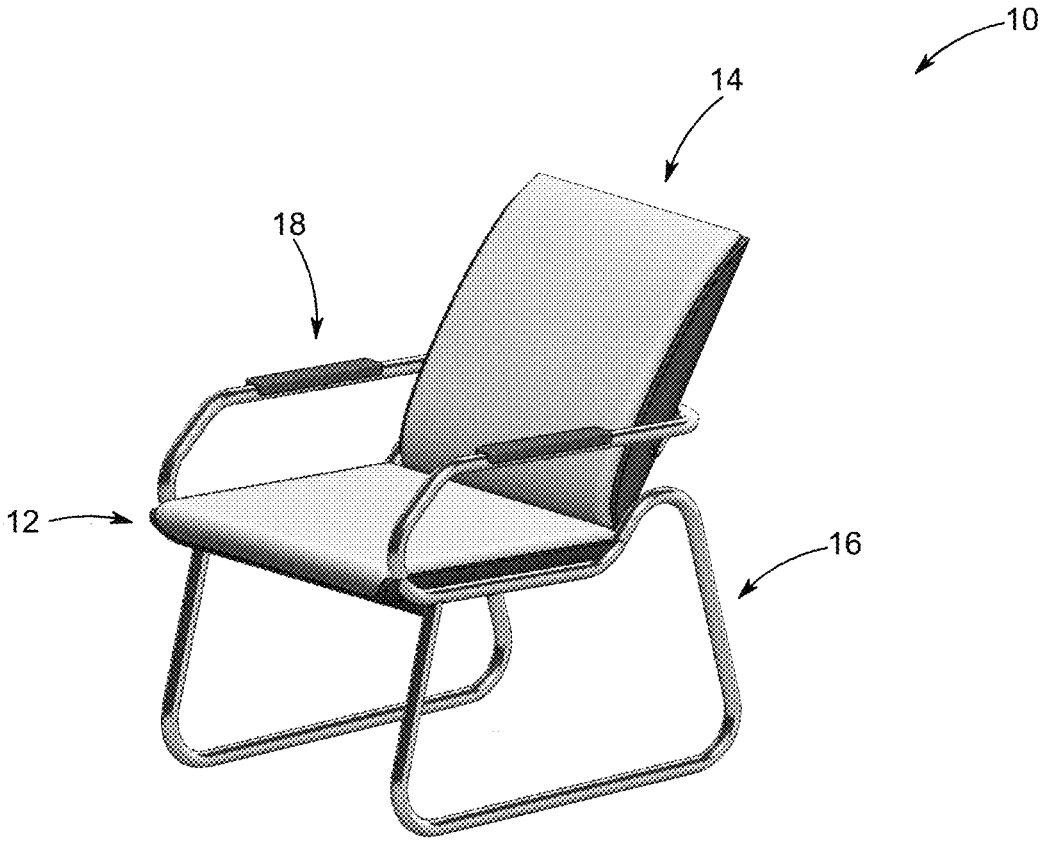
FIG. 21 is a front perspective view of the dining chair in accordance with one or more arrangements, the view showing the dining chair having a backrest, a seat, a frame, and arm covers. The view also showing the dining chair in a reclined position.
Figure 22:
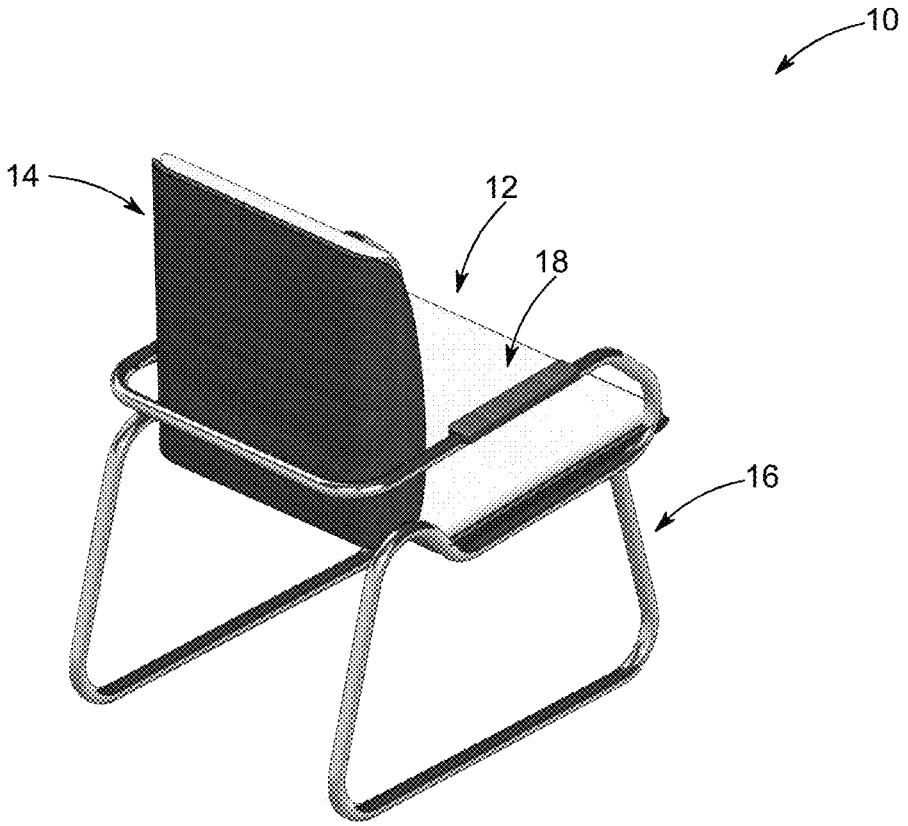
FIG. 22 is a back perspective view of the dining chair in accordance with one or more arrangements, the view showing the dining chair having a backrest, a seat, a frame, and arm covers. The view also showing the dining chair in an upright position.
Figure 23:
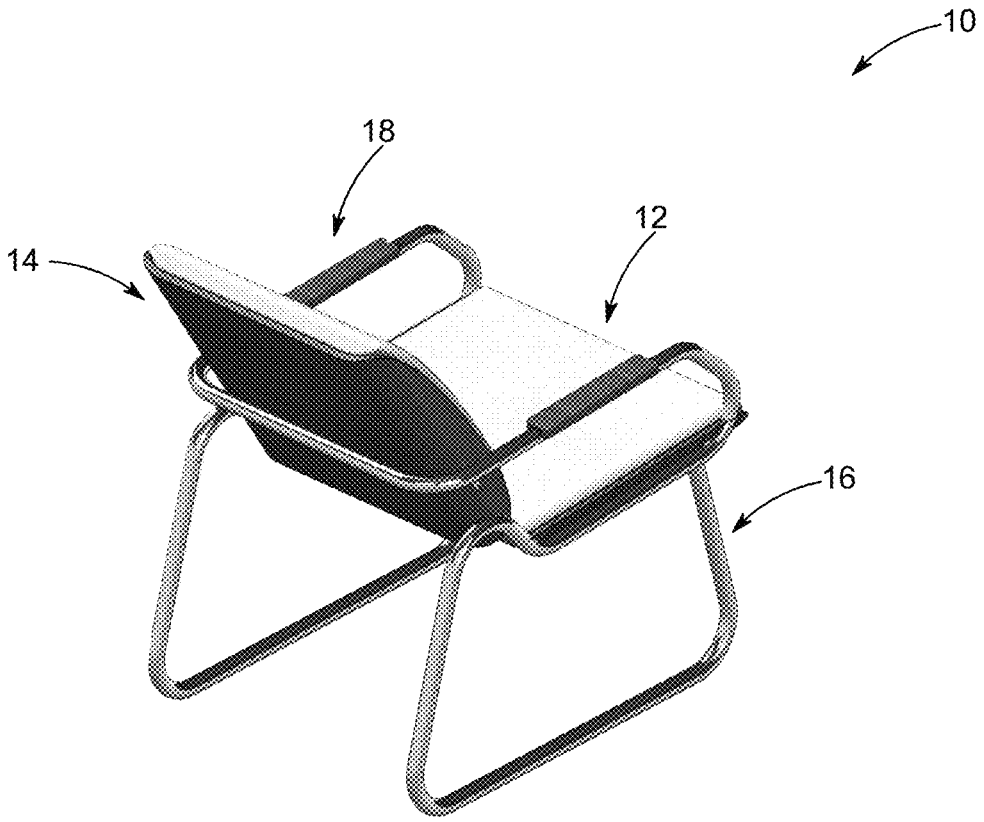
FIG. 23 is a back perspective view of the dining chair in accordance with one or more arrangements, the view showing the dining chair having a backrest, a seat, a frame, and arm covers. The view also showing the dining chair in a reclined position.
Figure 24:
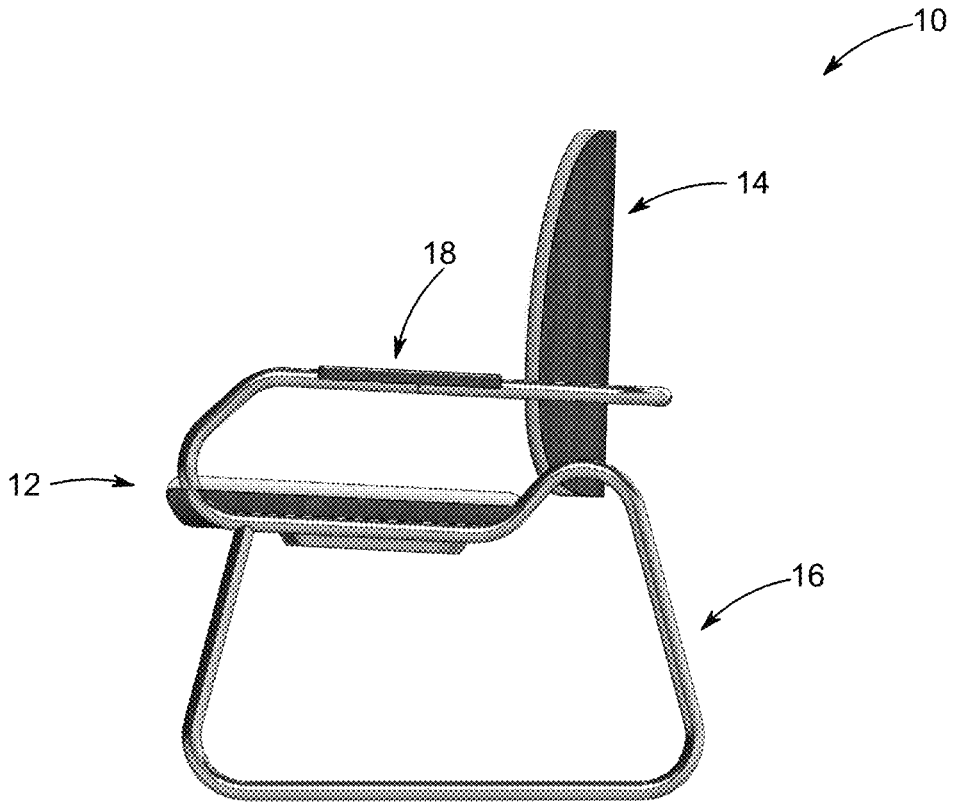
FIG. 24 is a left elevation view of the dining chair in accordance with one or more arrangements, the view showing the dining chair having a backrest, a seat, a frame, and arm covers. The view also showing the dining chair in an upright position.
Figure 25:
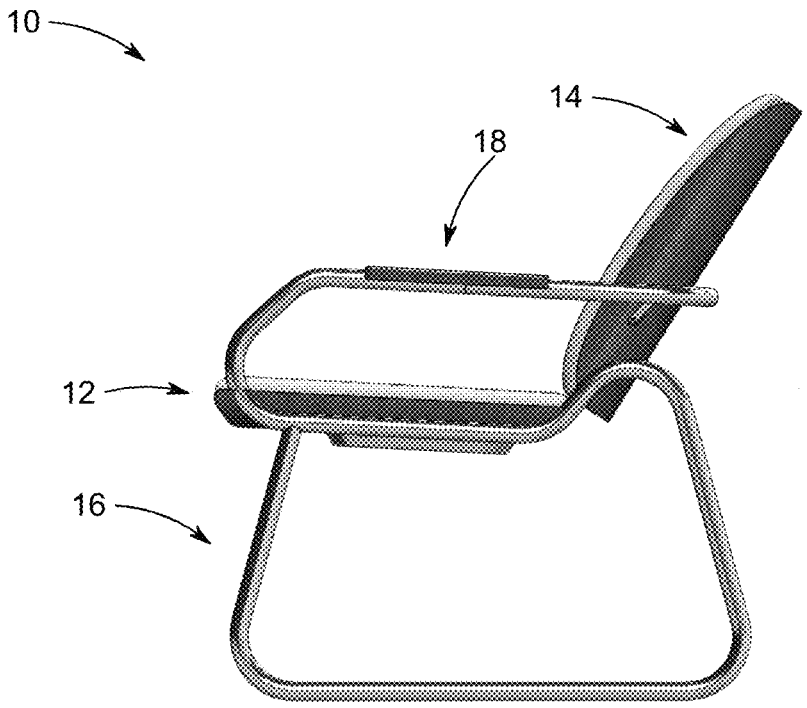
FIG. 25 is a left elevation view of the dining chair in accordance with one or more arrangements, the view showing the dining chair having a backrest, a seat, a frame, and arm covers. The view also showing the dining chair in a reclined position.
Figure 26:
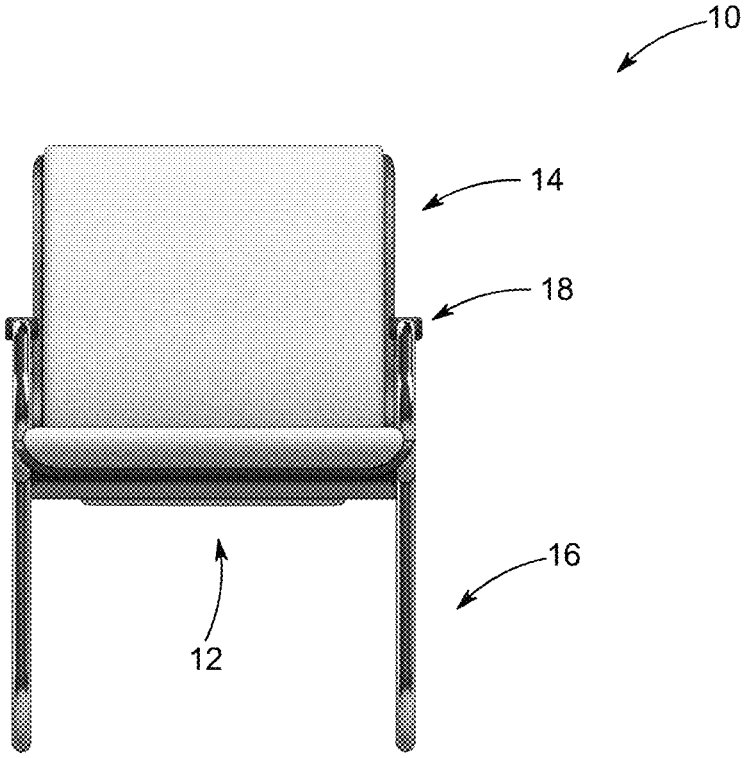
FIG. 26 is a front elevation view of the dining chair in accordance with one or more arrangements, the view showing the dining chair having a backrest, a seat, a frame, and arm covers. The view also showing the dining chair in a reclined position.
Figure 27:
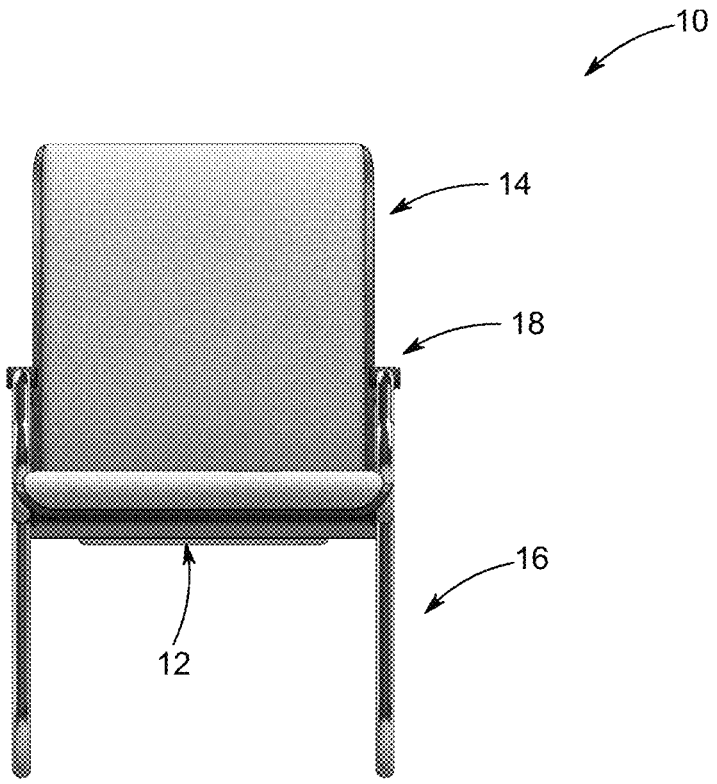
FIG. 27 is a front elevation view of the dining chair in accordance with one or more arrangements, the view showing the dining chair having a backrest, a seat, a frame, and arm covers. The view also showing the dining chair in an upright position.
Figure 28:
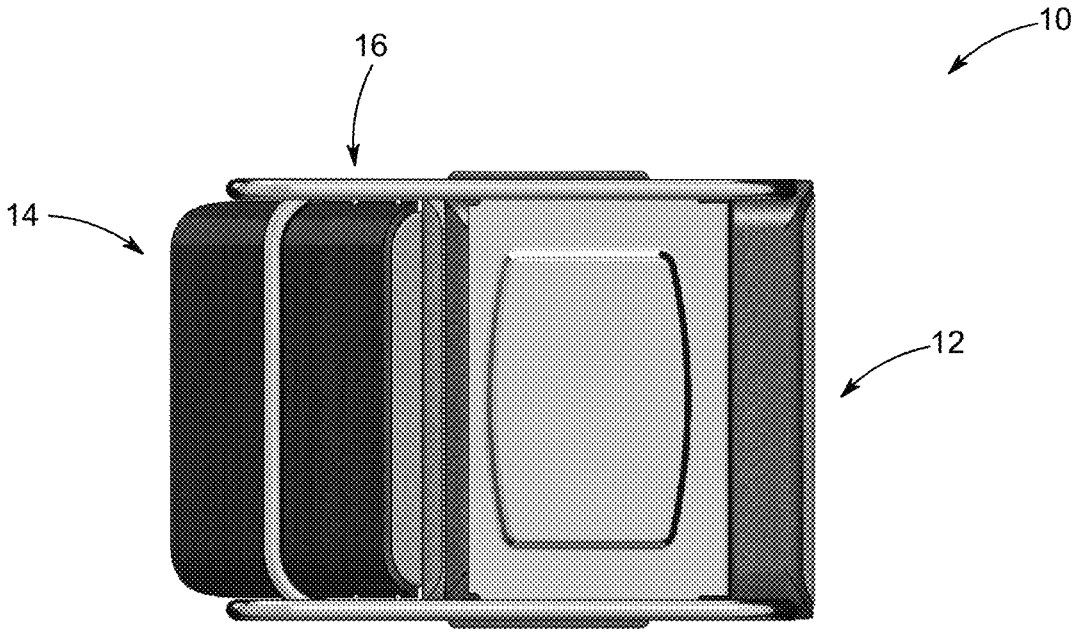
FIG. 28 is a bottom elevation view of the dining chair in accordance with one or more arrangements, the view showing the dining chair having a backrest, a seat, and a frame. The view also showing the dining chair in a reclined position.
Figure 29:
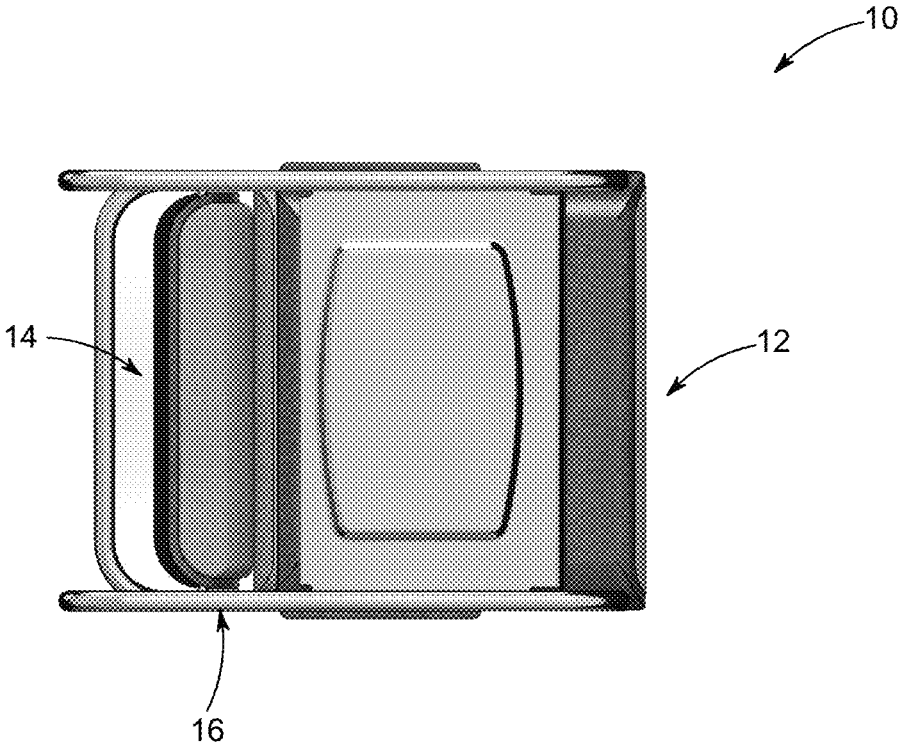
FIG. 29 is a bottom elevation view of the dining chair in accordance with one or more arrangements, the view showing the dining chair having a backrest, a seat, and a frame. The view also showing the dining chair in an upright position.
Figure 30:
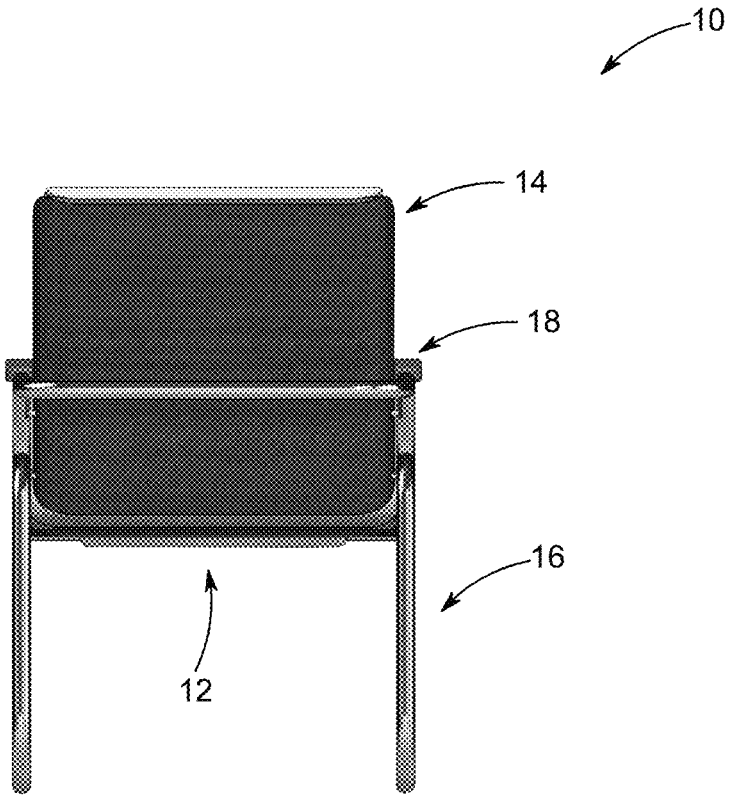
FIG. 30 is a back elevation view of the dining chair in accordance with one or more arrangements, the view showing the dining chair having a backrest, a seat, a frame, and arm covers.
Figure 31:
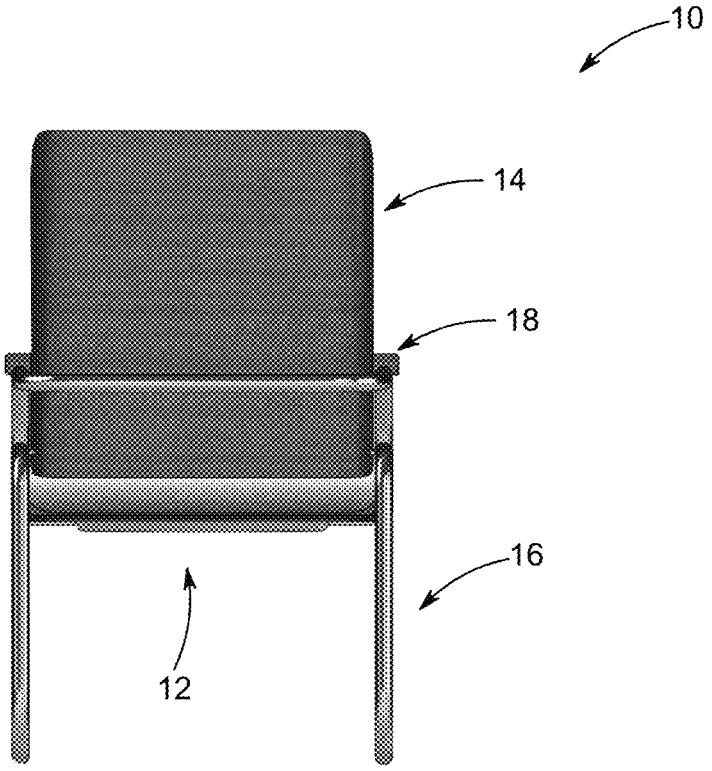
FIG. 31 is a back elevation view of the dining chair in accordance with one or more arrangements, the view showing the dining chair having a backrest, a seat, a frame, and arm covers.
Figure 32:
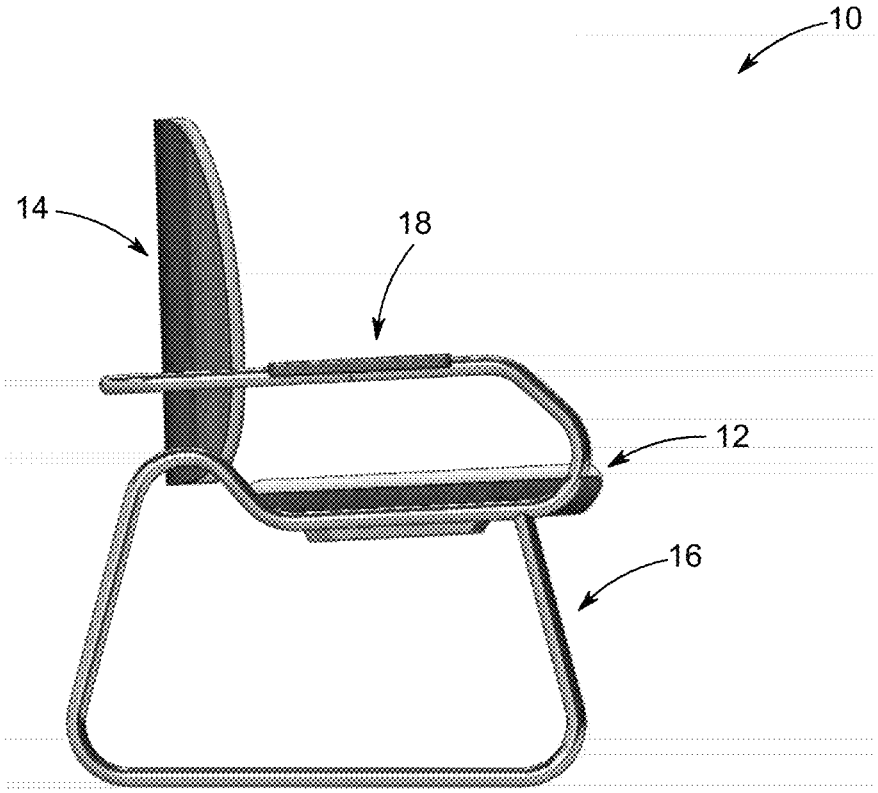
FIG. 32 is a right elevation view of the dining chair in accordance with one or more arrangements, the view showing the dining chair having a backrest, a seat, a frame, and arm covers. The view also showing the dining chair in an upright position.
Figure 33:
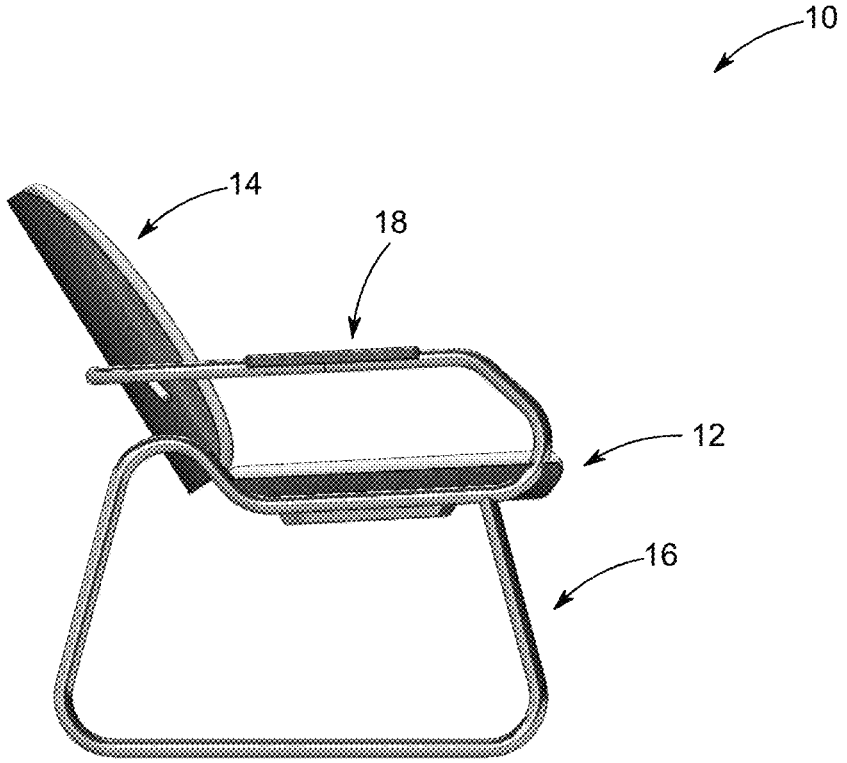
FIG. 33 is a right elevation view of the dining chair in accordance with one or more arrangements, the view showing the dining chair having a backrest, a seat, a frame, and arm covers. The view also showing the dining chair in a reclined position.
Figure 34:
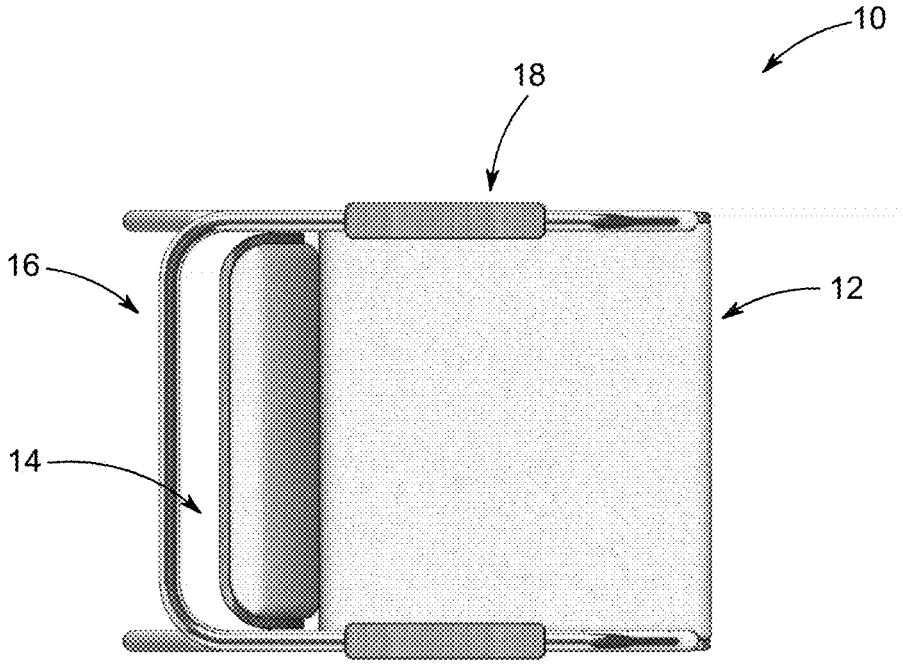
FIG. 34 is a top elevation view of the dining chair in accordance with one or more arrangements, the view showing the dining chair having a backrest, a seat, a frame, and arm covers. The view also showing the dining chair in an upright position.
Figure 35:
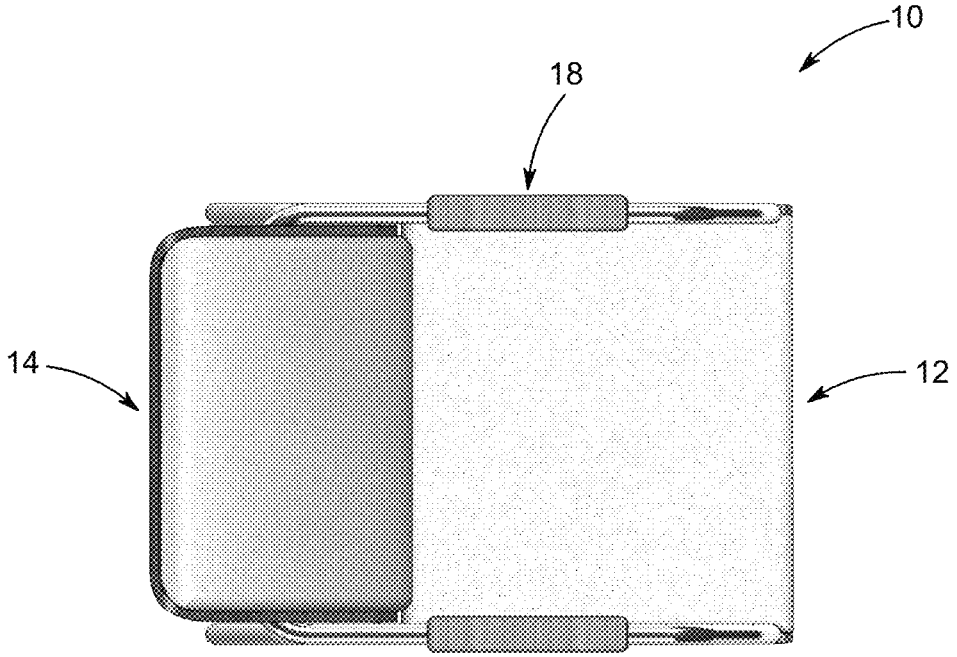
FIG. 35 is a top elevation view of the dining chair in accordance with one or more arrangements, the view showing the dining chair having a backrest, a seat, and arm covers. The view also showing the dining chair in a reclined position.
Figure 36:
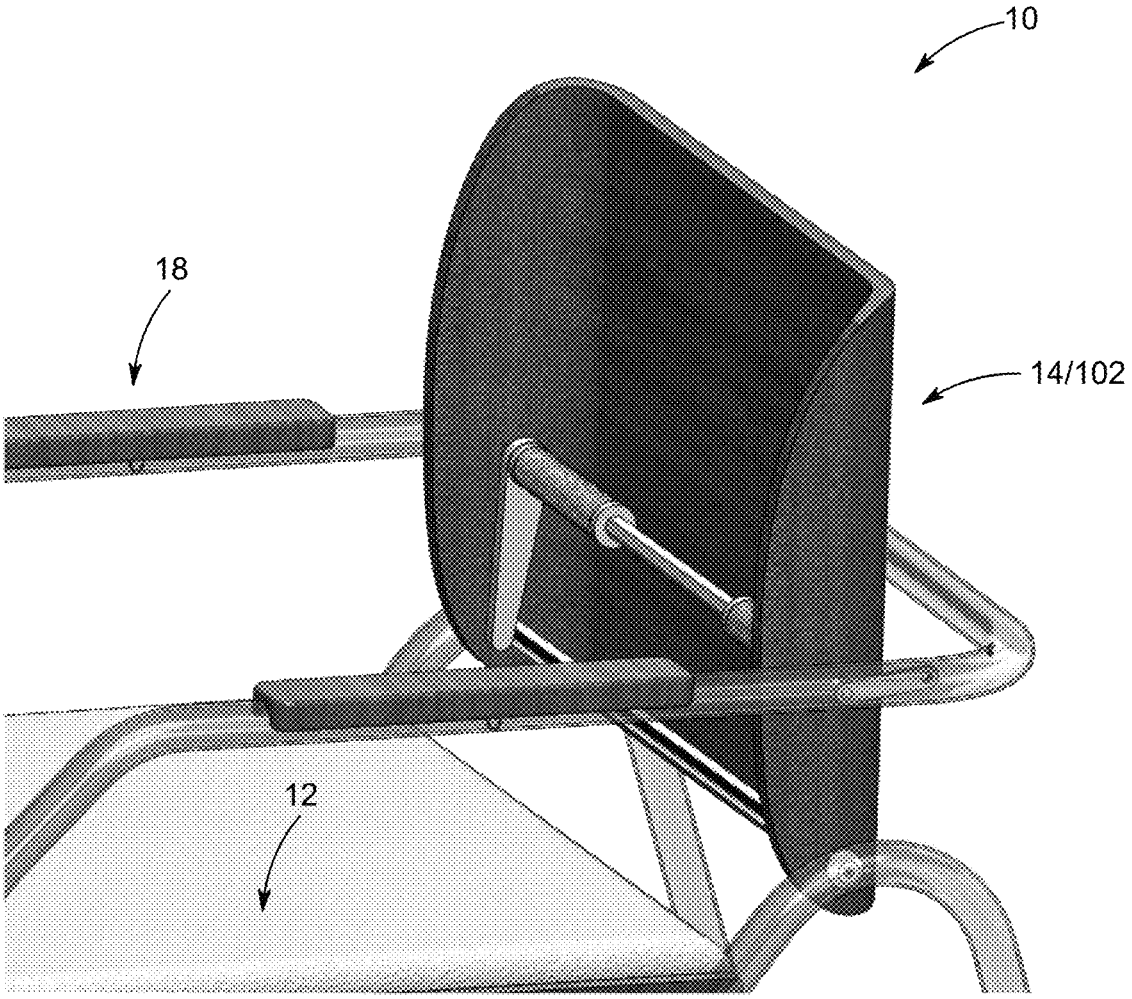
FIG. 36 is a front perspective view of the dining chair in accordance with one or more arrangements, the view showing the dining chair having a backrest, a frame, and arm covers. The view also showing the reclining assembly. The view also showing the dining chair in an upright position.
Figure 37:
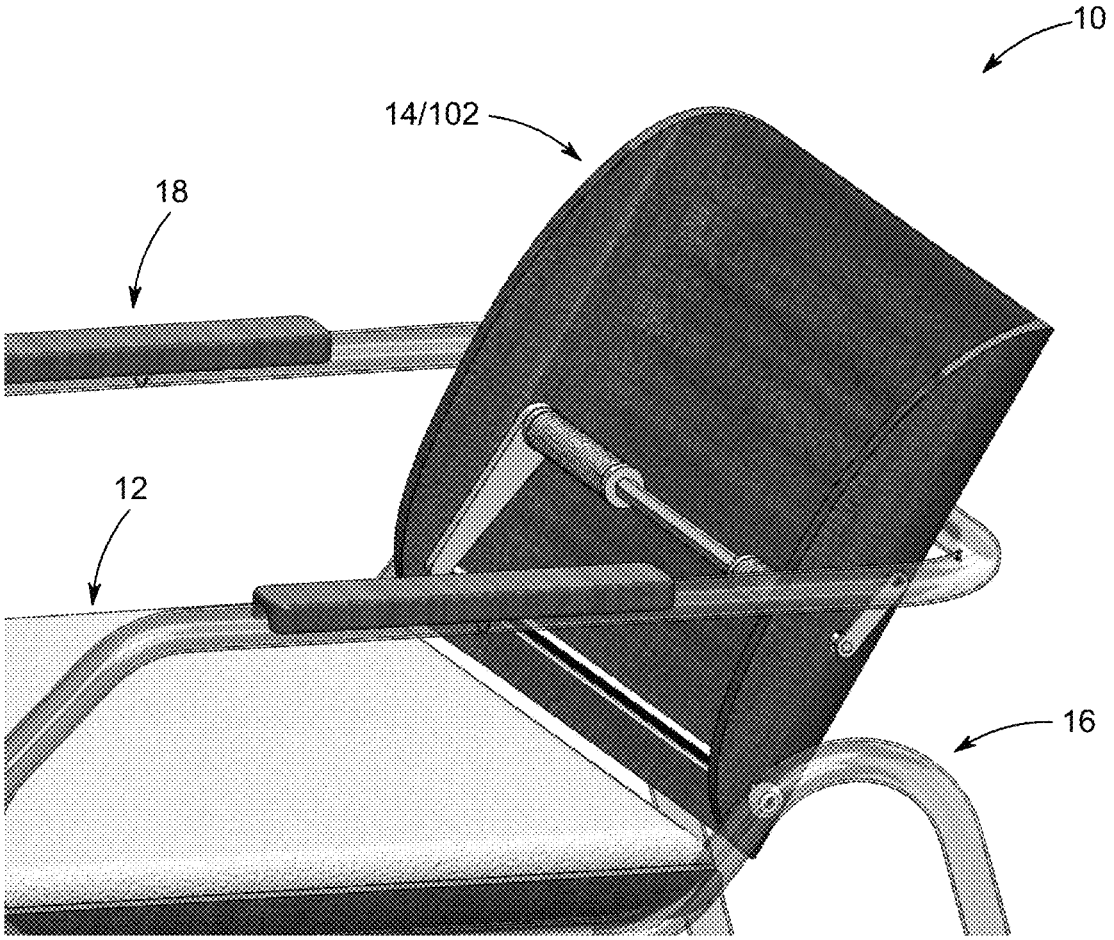
FIG. 37 is a front perspective view of the dining chair in accordance with one or more arrangements, the view showing the dining chair having a backrest, a frame, and arm covers. The view also showing the reclining assembly. The view also showing the dining chair in a reclined position.
Figure 38:
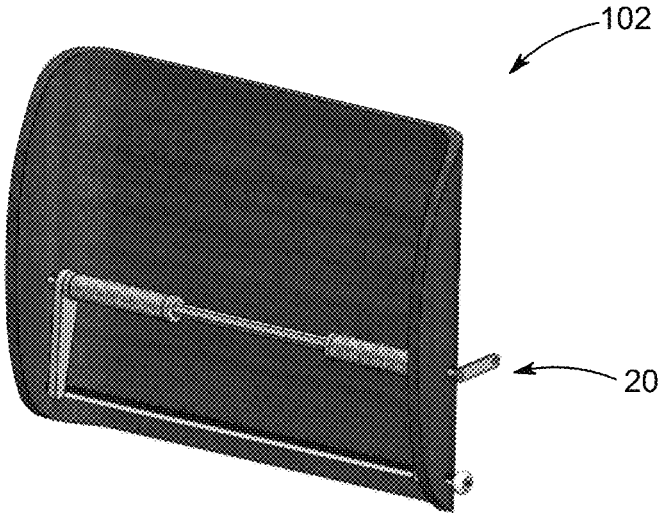
FIG. 38 is a front perspective view of the dining chair in accordance with one or more arrangements, the view showing the dining chair having a backrest and a reclining assembly. The view also showing the dining chair in an upright position.
Figure 39:
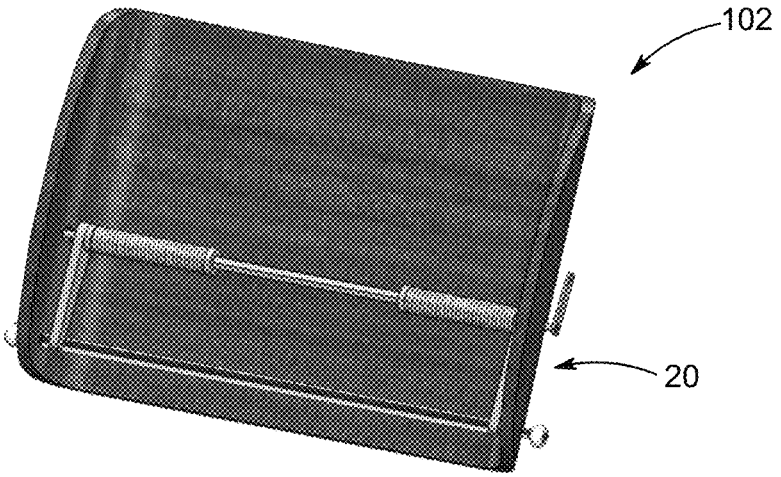
FIG. 39 is a front perspective view of the dining chair in accordance with one or more arrangements, the view showing the dining chair having a backrest and a reclining assembly. The view also showing the dining chair in a reclined position.
Figure 40:
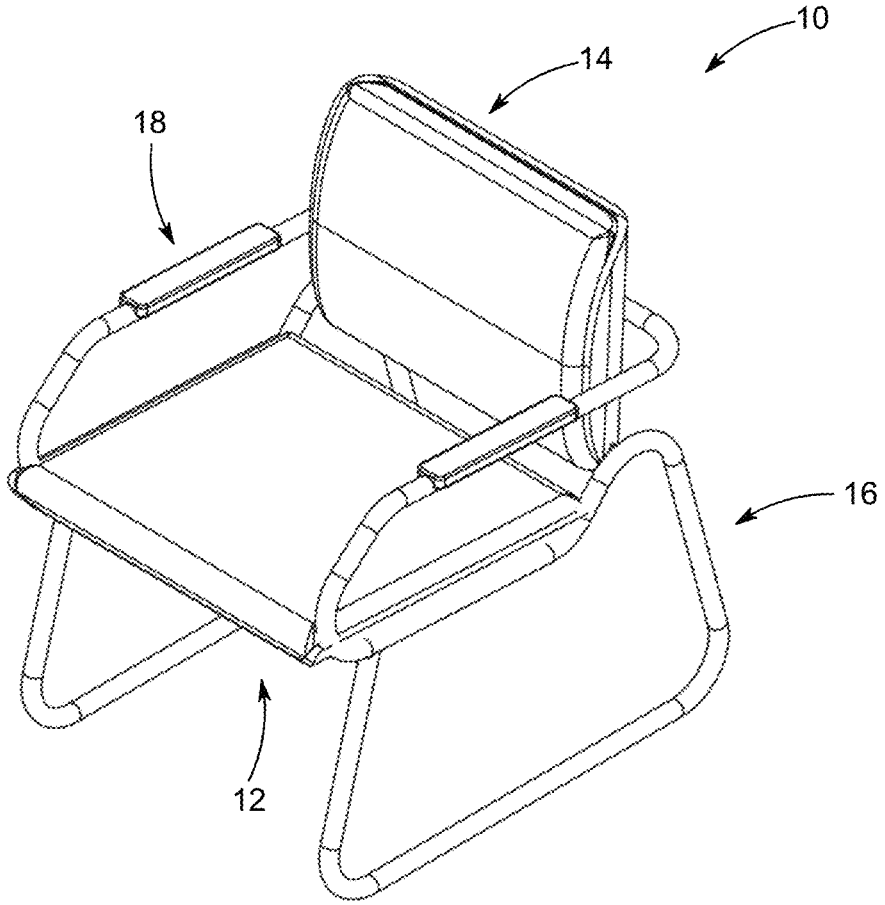
FIG. 40 is a front perspective view of the dining chair in accordance with one or more arrangements, the view showing the dining chair having a backrest, a frame, a seat, and arm covers. The view also showing the dining chair in an upright position.
Figure 41:
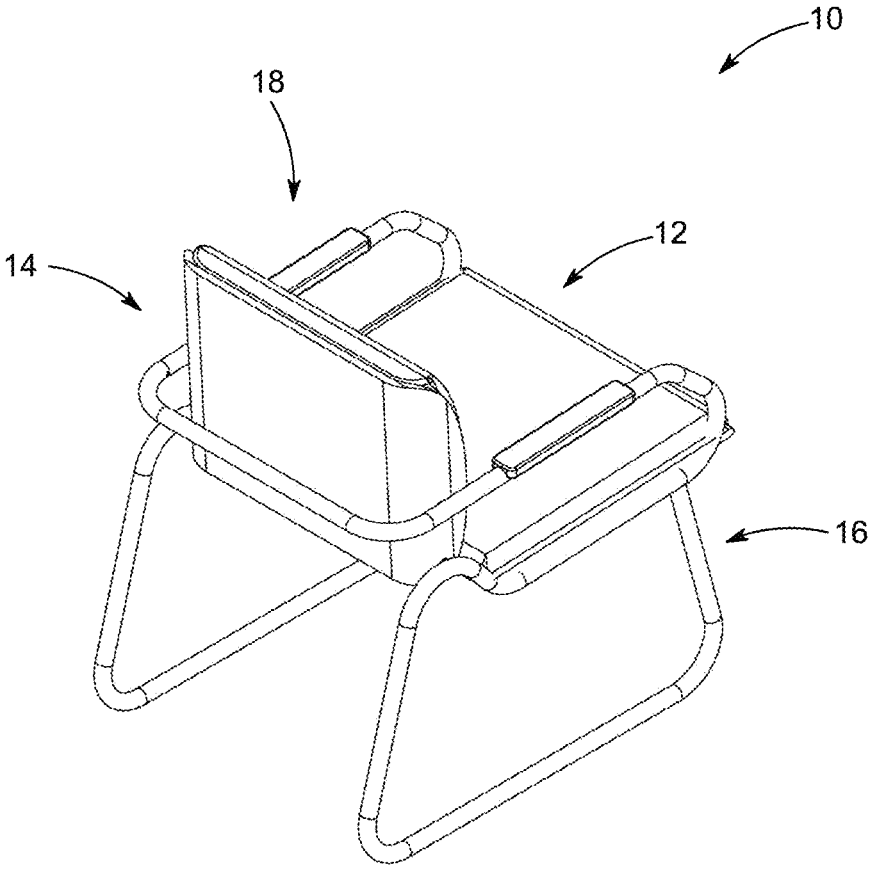
FIG. 41 is a back perspective view of the dining chair in accordance with one or more arrangements, the view showing the dining chair having a backrest, a frame, a seat, and arm covers. The view also showing the dining chair in an upright position.
Figure 42:
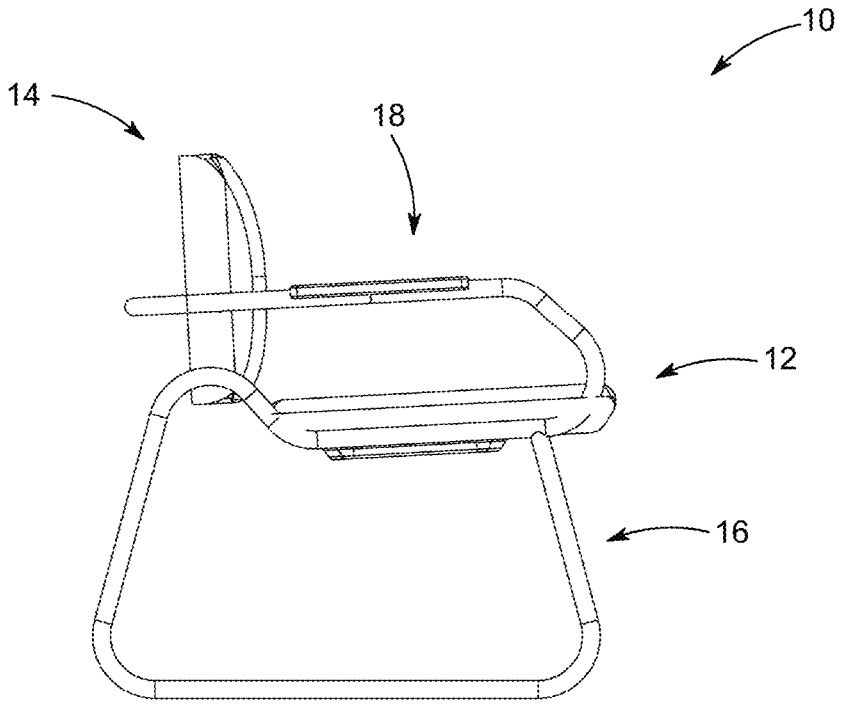
FIG. 42 is a right elevation view of the dining chair in accordance with one or more arrangements, the view showing the dining chair having a backrest, a seat, a frame, and arm covers. The view also showing the dining chair in an upright position.
Figure 43:
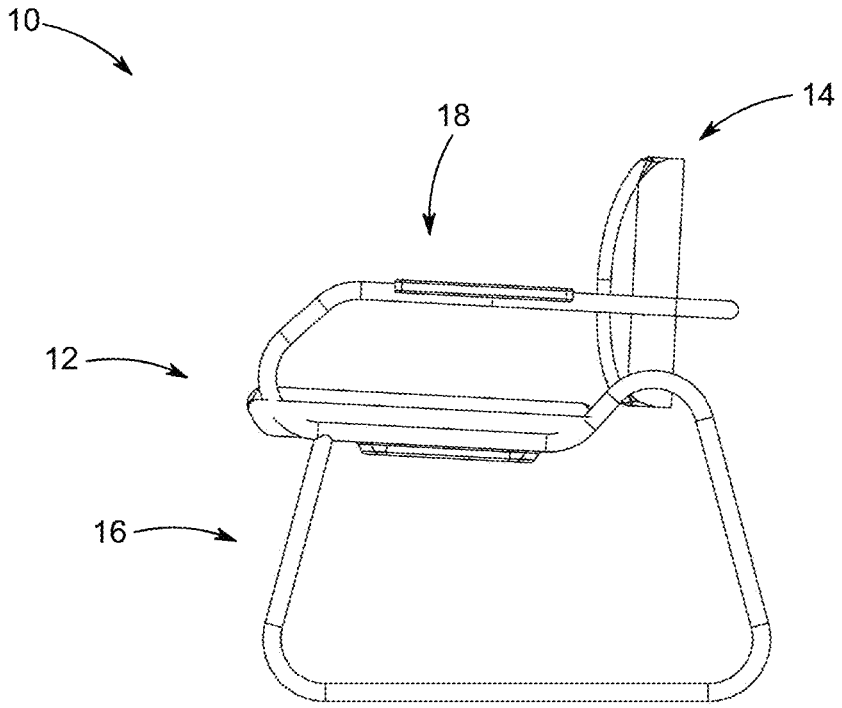
FIG. 43 is a left elevation view of the dining chair in accordance with one or more arrangements, the view showing the dining chair having a backrest, a seat, a frame, and arm covers. The view also showing the dining chair in an upright position.
Figure 44:
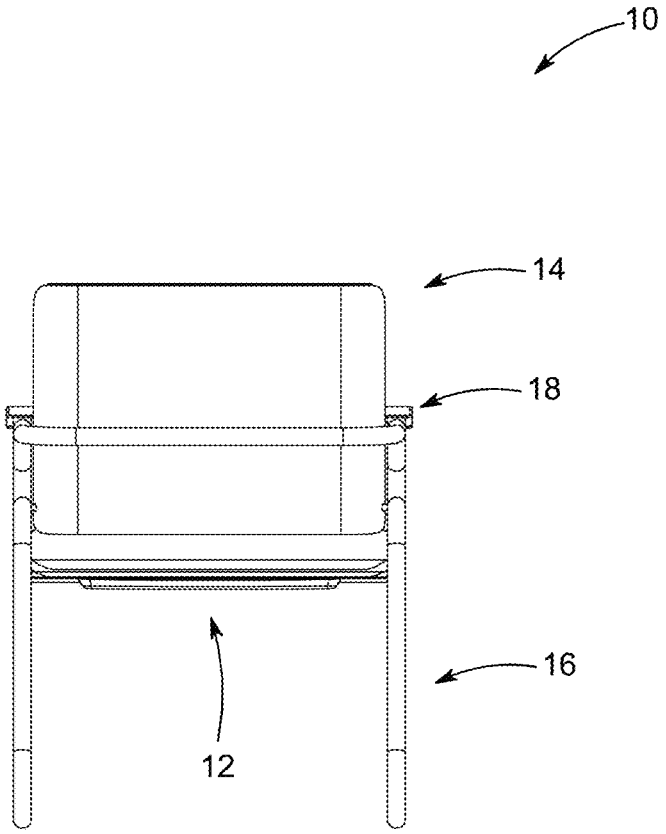
FIG. 44 is a back elevation view of the dining chair in accordance with one or more arrangements, the view showing the dining chair having a backrest, a seat, a frame, and arm covers.
Figure 45:
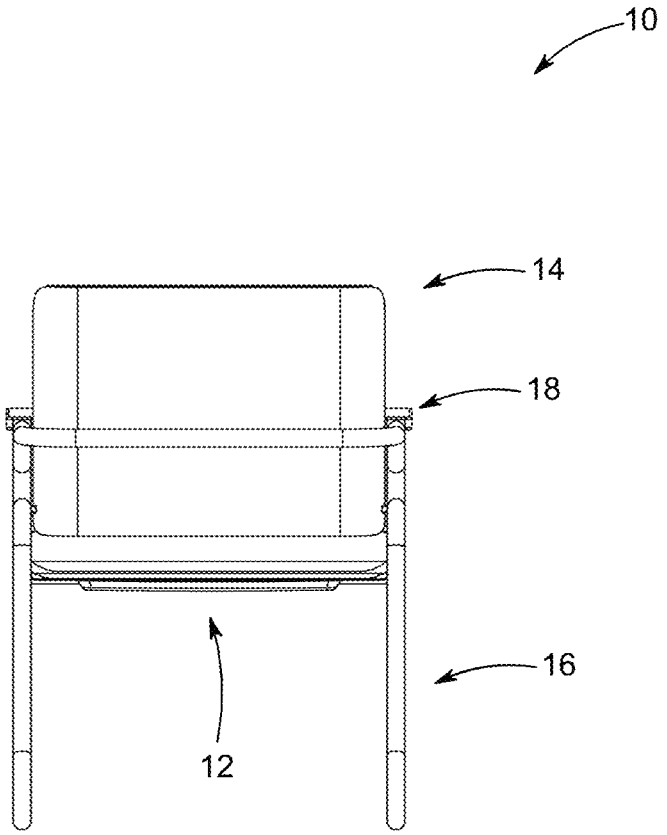
FIG. 45 is a back elevation view of the dining chair in accordance with one or more arrangements, the view showing the dining chair having a backrest, a seat, a frame, and arm covers.
Figure 46:
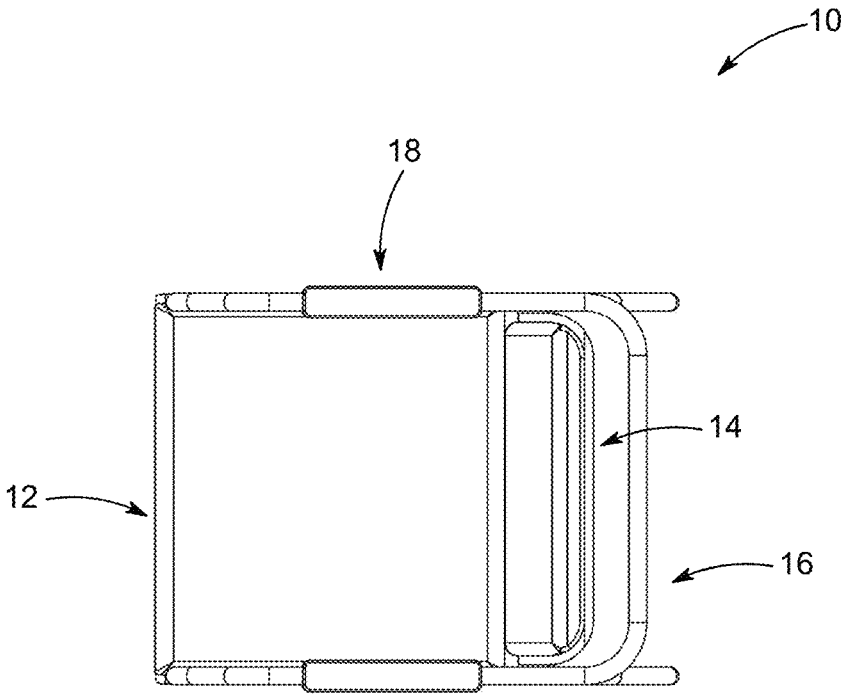
FIG. 46 is a top elevation view of the dining chair in accordance with one or more arrangements, the view showing the dining chair having a backrest, a seat, a frame, and arm covers. The view also showing the dining chair in an upright position.
Figure 47:
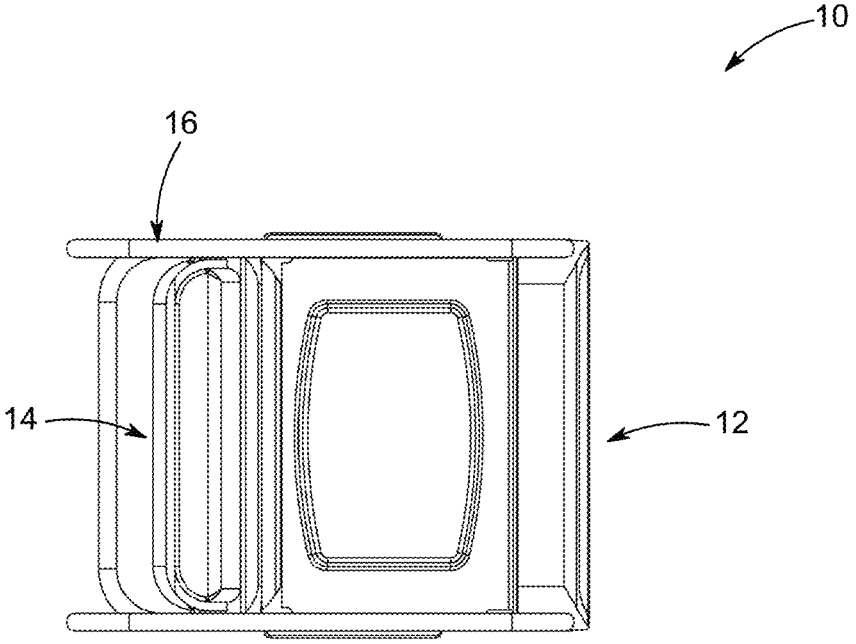
FIG. 47 is a bottom elevation view of the dining chair in accordance with one or more arrangements, the view showing the dining chair having a backrest, a seat, and a frame.
Figure 48:
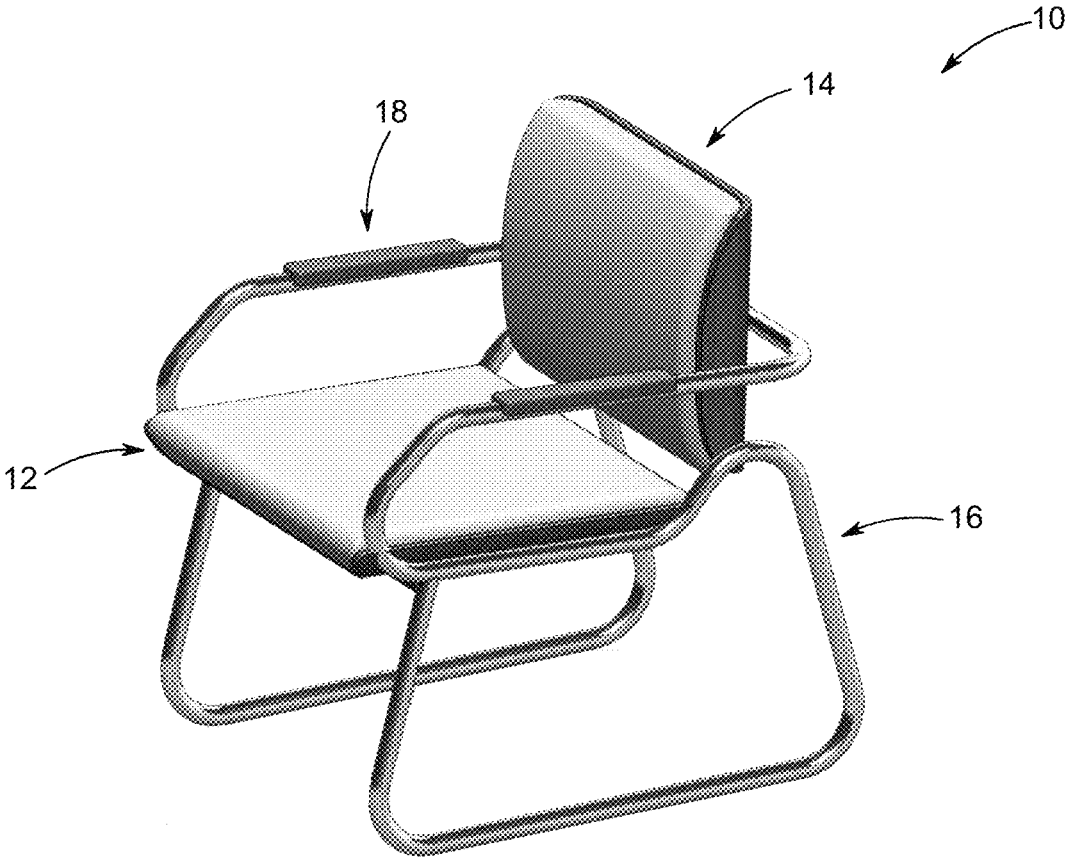
FIG. 48 is a front perspective view of the dining chair in accordance with one or more arrangements, the view showing the dining chair having a backrest, a seat, a frame, and arm covers. The view also showing the dining chair in an upright position.
Figure 49:
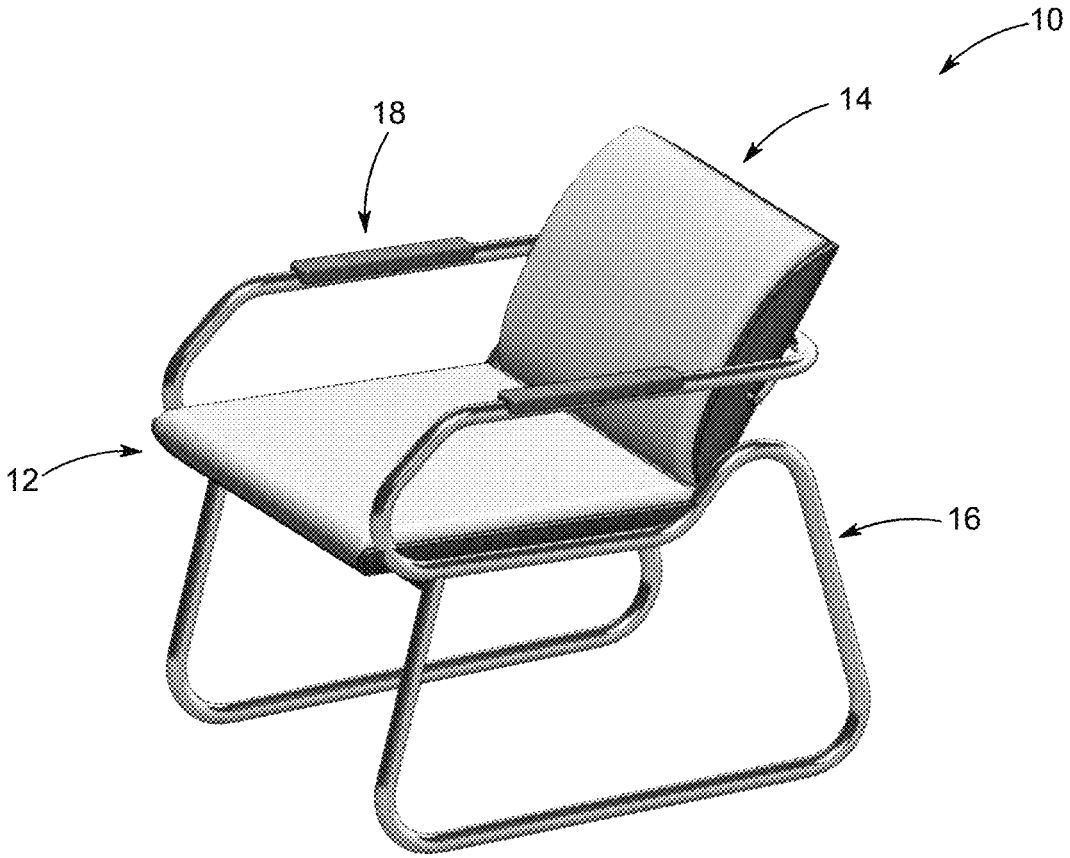
FIG. 49 is a front perspective view of the dining chair in accordance with one or more arrangements, the view showing the dining chair having a backrest, a seat, frame, and arm covers. The view also showing the dining chair in a reclined position.
Figure 50:
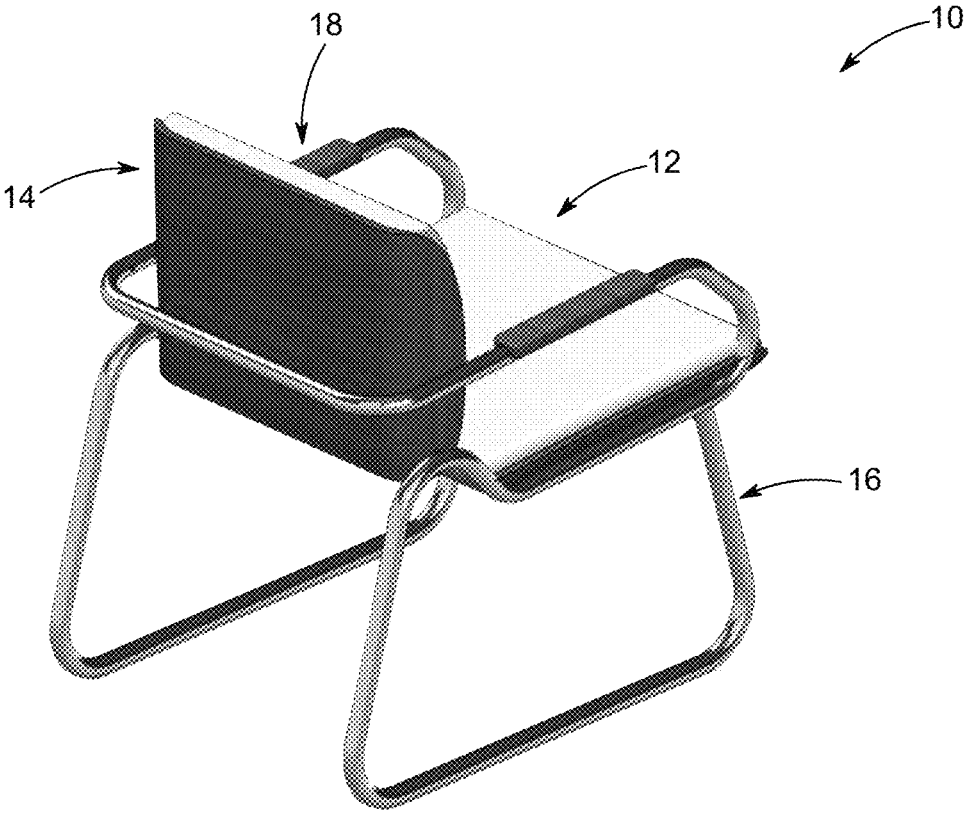
FIG. 50 is a back perspective view of the dining chair in accordance with one or more arrangements, the view showing the dining chair having a backrest, a seat, a frame, and arm covers. The view also showing the dining chair in an upright position.
Figure 51:
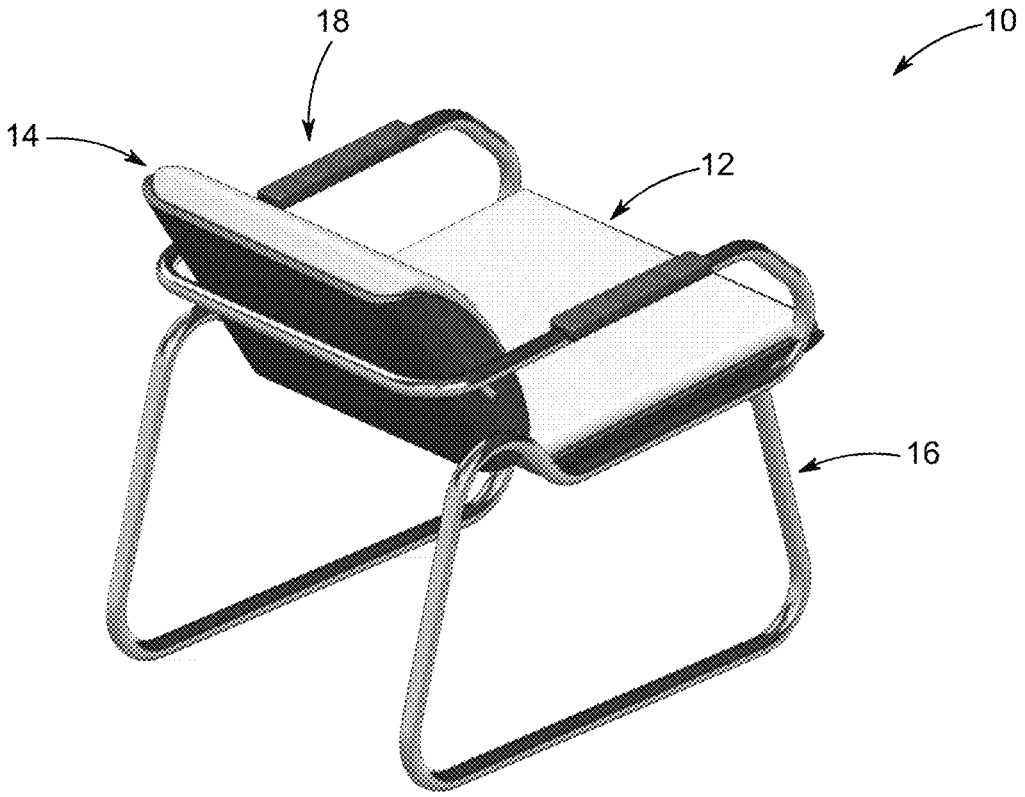
FIG. 51 is a back perspective view of the dining chair in accordance with one or more arrangements, the view showing the dining chair having a backrest, a seat, a frame, and arm covers. The view also showing the dining chair in a reclined position.
Figure 52:
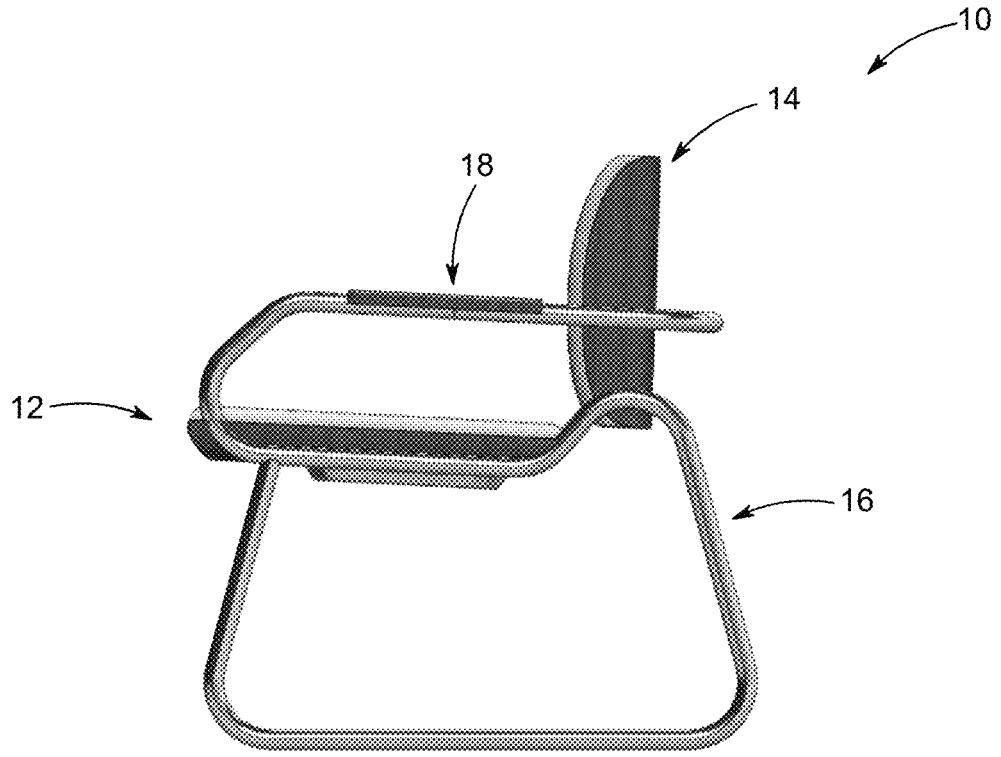
FIG. 52 is a left elevation view of the dining chair in accordance with one or more arrangements, the view showing the dining chair having a backrest, a seat, a frame, and arm covers. The view also showing the dining chair in an upright position.
Figure 53:
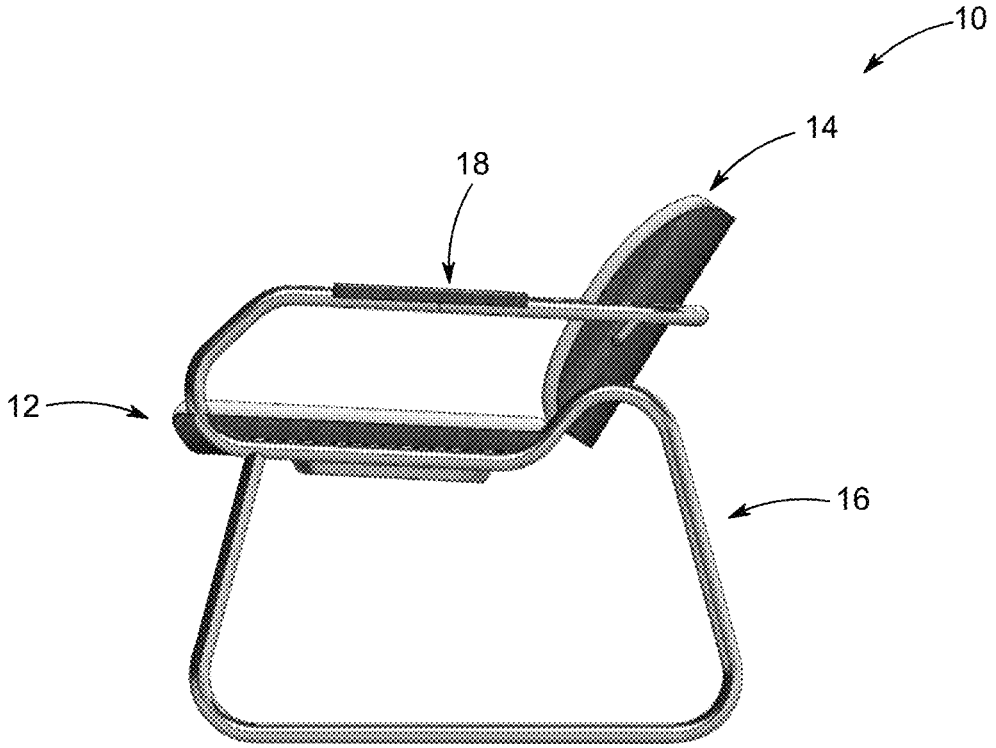
FIG. 53 is a left elevation view of the dining chair in accordance with one or more arrangements, the view showing the dining chair having a backrest, a seat, a frame, and arm covers. The view also showing the dining chair in a reclined position.
Figure 54:
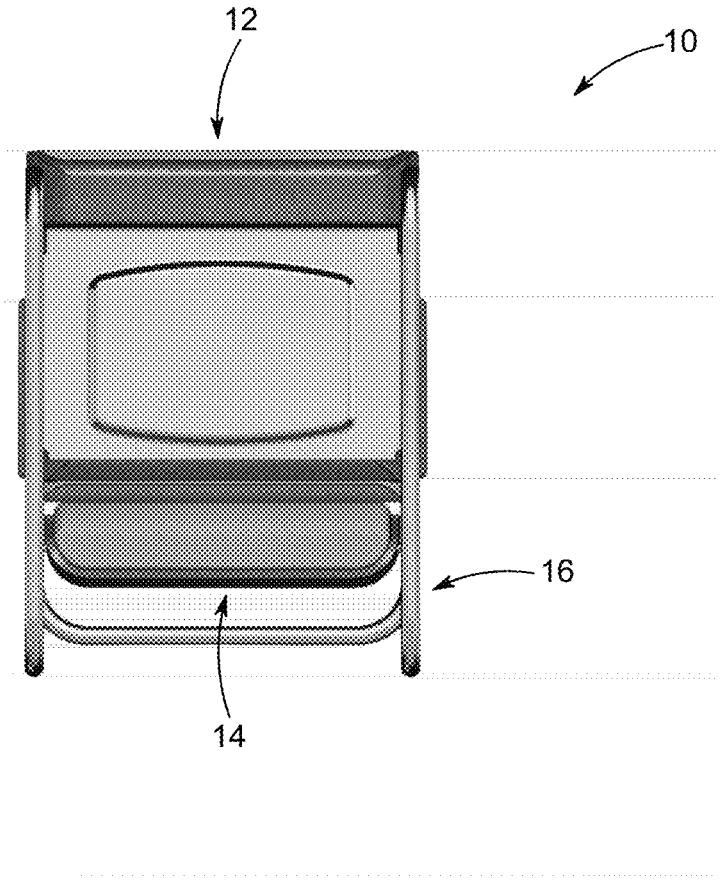
FIG. 54 is a bottom elevation view of the dining chair in accordance with one or more arrangements, the view showing the dining chair having a backrest, a seat, and a frame. The view also showing the dining chair in an upright position.
Figure 55:
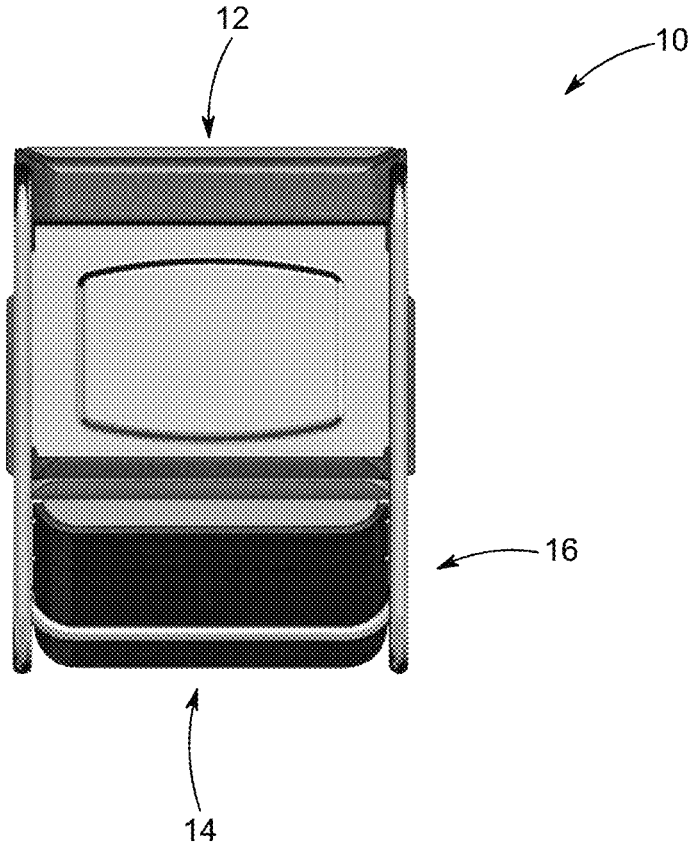
FIG. 55 is a bottom elevation view of the dining chair in accordance with one or more arrangements, the view showing the dining chair having a backrest, a seat, and a frame. The view also showing the dining chair in a reclined position.
Figure 56:
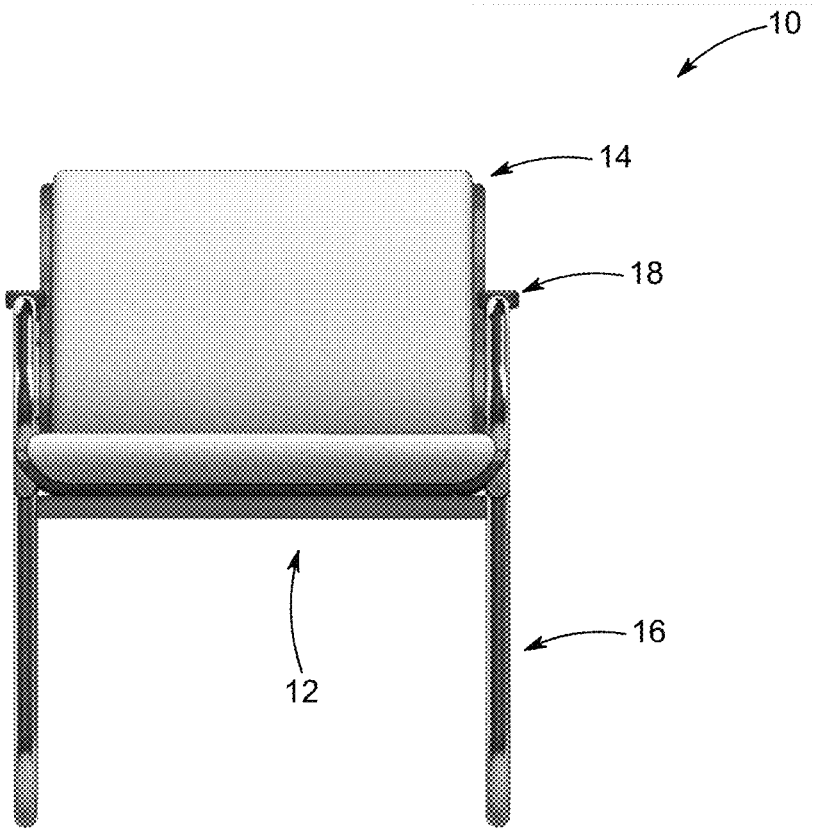
FIG. 56 is a front elevation view of the dining chair in accordance with one or more arrangements, the view showing the dining chair having a backrest, a seat, a frame, and arm covers. The view also showing the dining chair in a reclined position.
Figure 57:
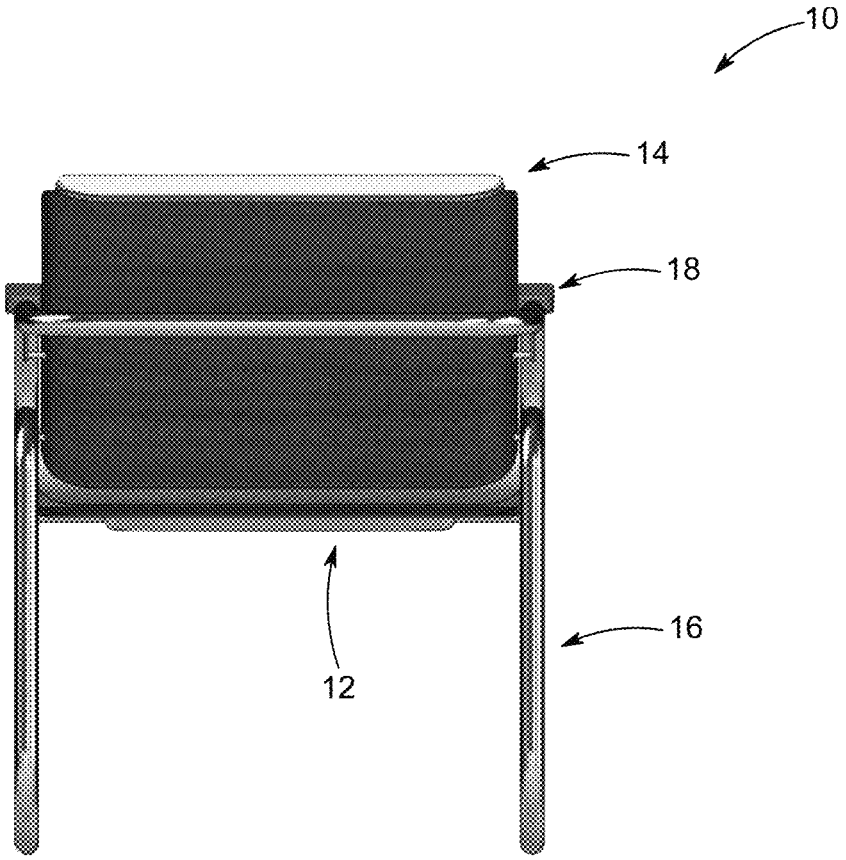
FIG. 57 is a back elevation view of the dining chair in accordance with one or more arrangements, the view showing the dining chair having a backrest, a seat, a frame, and arm covers. The view also showing the dining chair in a reclined position.
Figure 58:
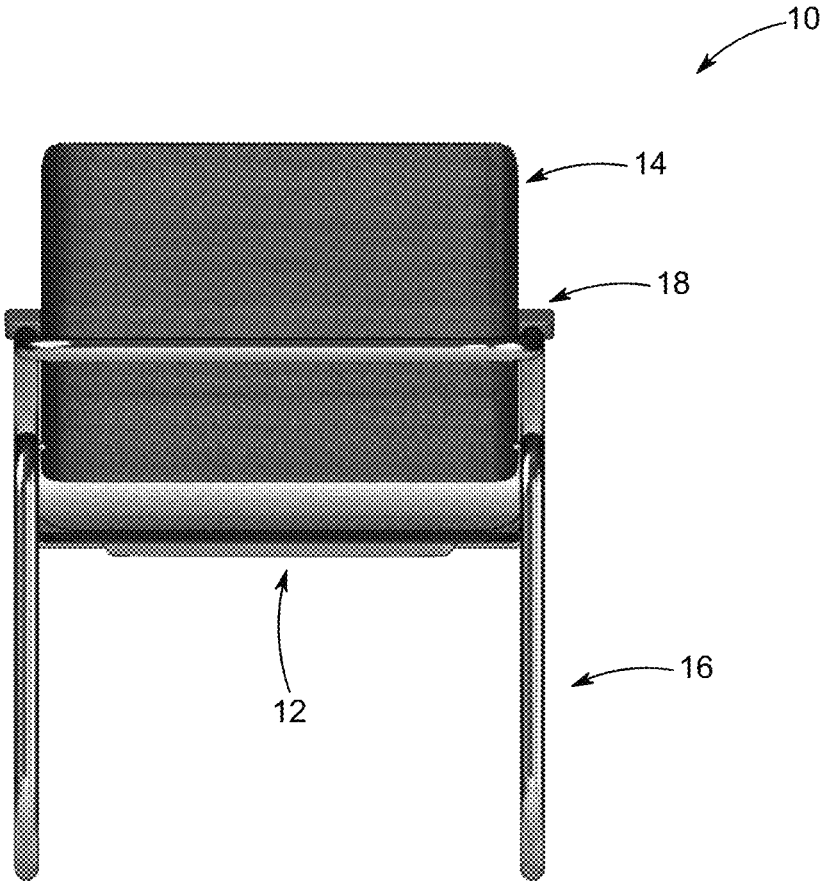
FIG. 58 is a back elevation view of the dining chair in accordance with one or more arrangements, the view showing the dining chair having a backrest, a seat, a frame, and arm covers. The view also showing the dining chair in an upright position.
Figure 59:
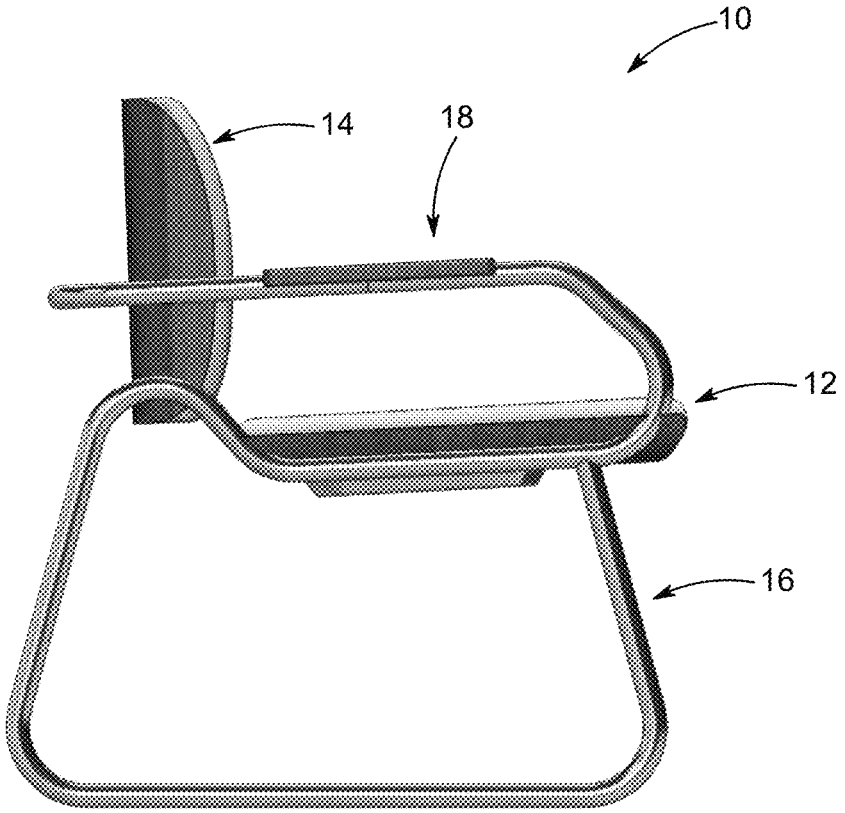
FIG. 59 is a right elevation view of the dining chair in accordance with one or more arrangements, the view showing the dining chair having a backrest, a seat, a frame, and arm covers. The view also showing the dining chair in an upright position.
Figure 60:
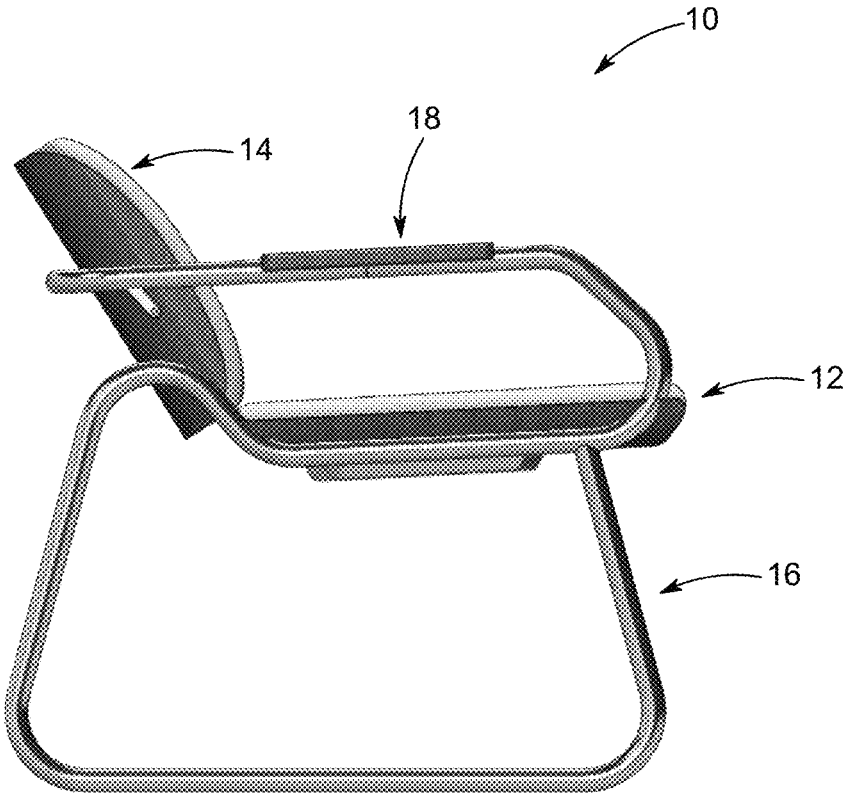
FIG. 60 is a right elevation view of the dining chair in accordance with one or more arrangements, the view showing the dining chair having a backrest, a seat, a frame, and arm covers. The view also showing the dining chair in a reclined position.
Figure 61:
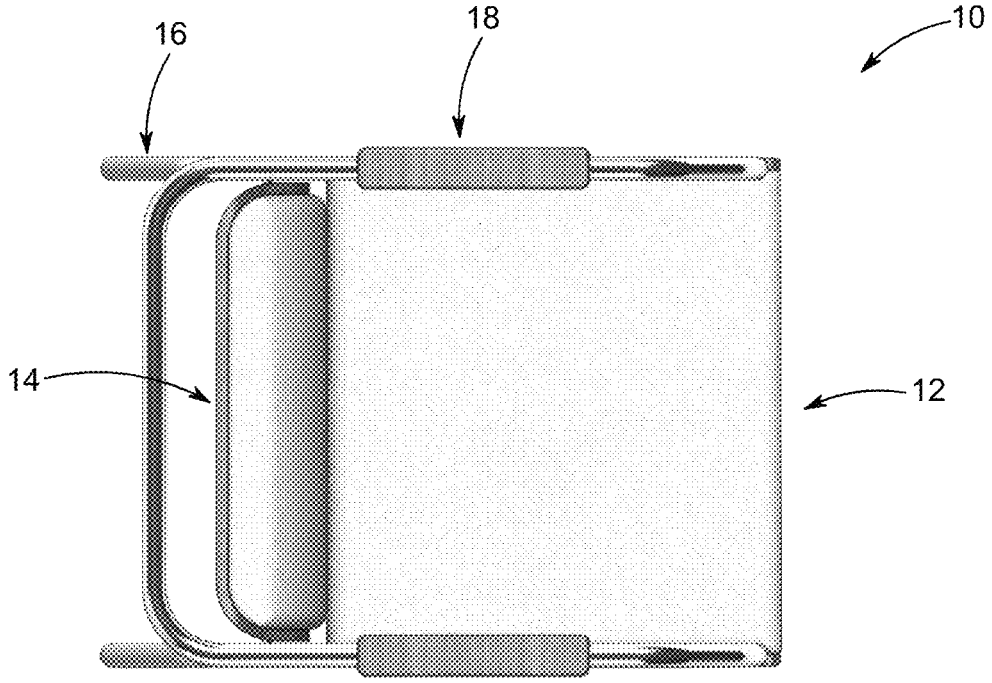
FIG. 61 is a top elevation view of the dining chair in accordance with one or more arrangements, the view showing the dining chair having a backrest, a seat, a frame, and arm covers. The view also showing the dining chair in an upright position.
Figure 62:
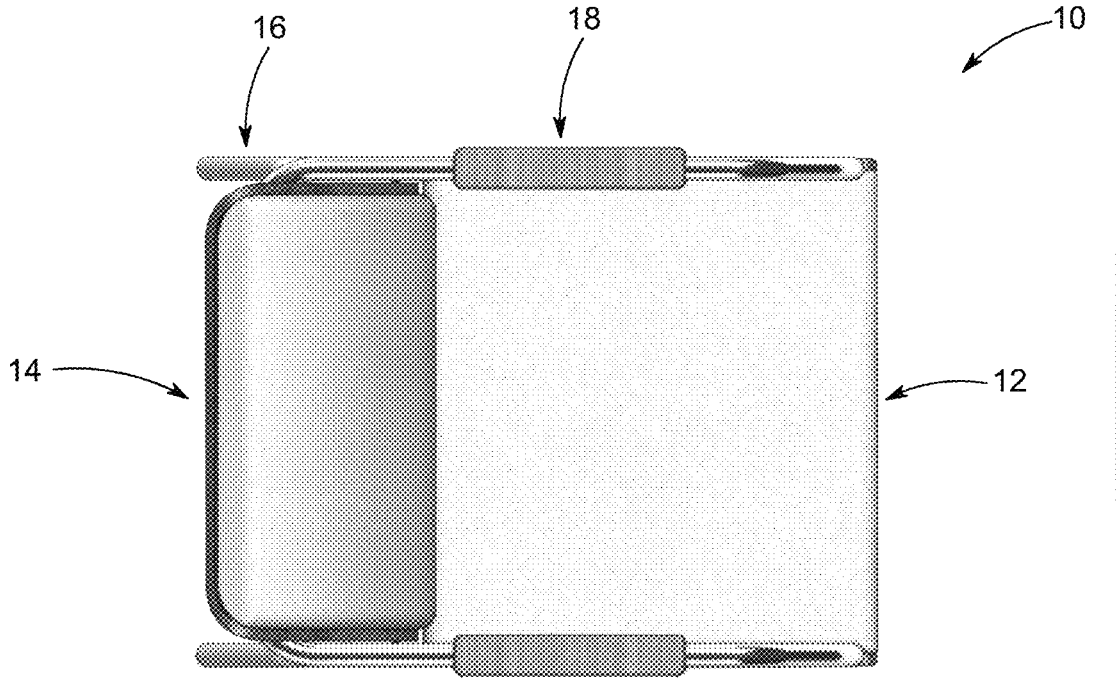
FIG. 62 is a top elevation view of the dining chair in accordance with one or more arrangements, the view showing the dining chair having a backrest, a seat, a frame, and arm covers. The view also showing the dining chair in a reclined position.
Figure 63:
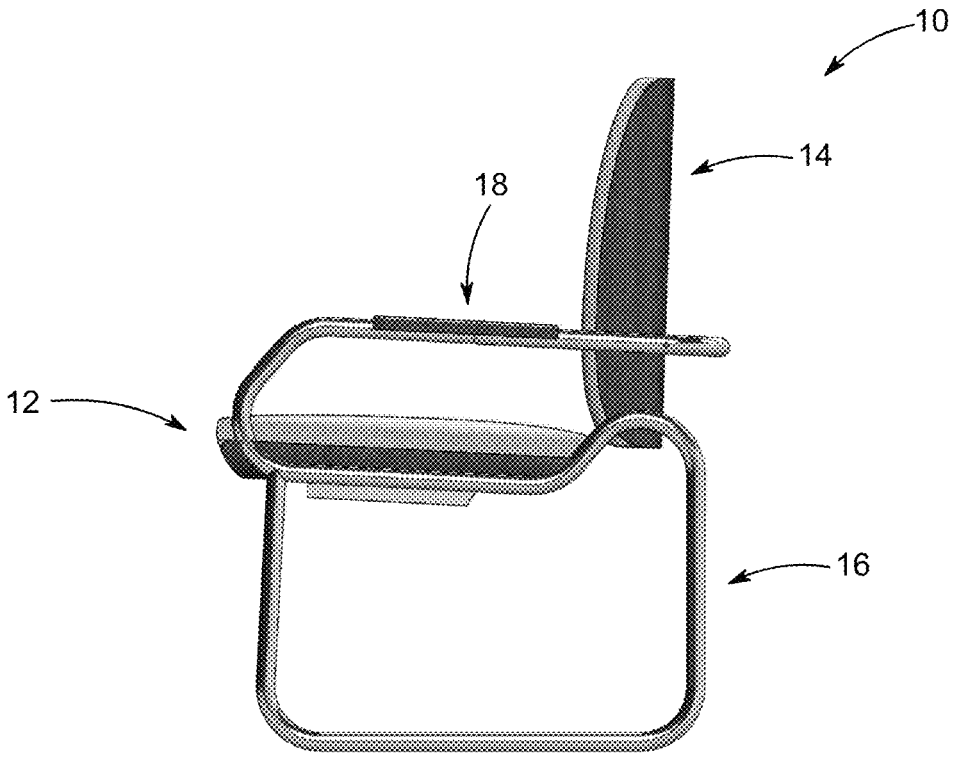
FIG. 63 is a left elevation view of the dining chair in accordance with one or more arrangements, the view showing the dining chair having a backrest, a seat, a frame, and arm covers. The view also showing the dining chair in an upright position.
Figure 64:
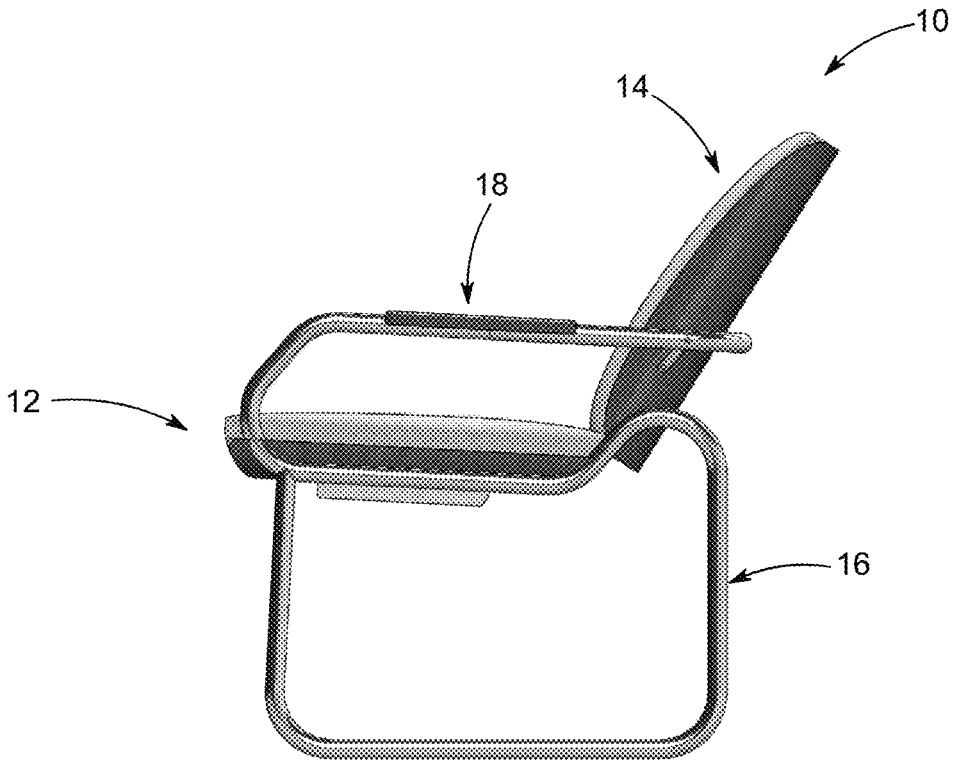
FIG. 64 is a left elevation view of the dining chair in accordance with one or more arrangements, the view showing the dining chair having a backrest, a seat, a frame, and arm covers. The view also showing the dining chair in a reclined position.
Figure 65:
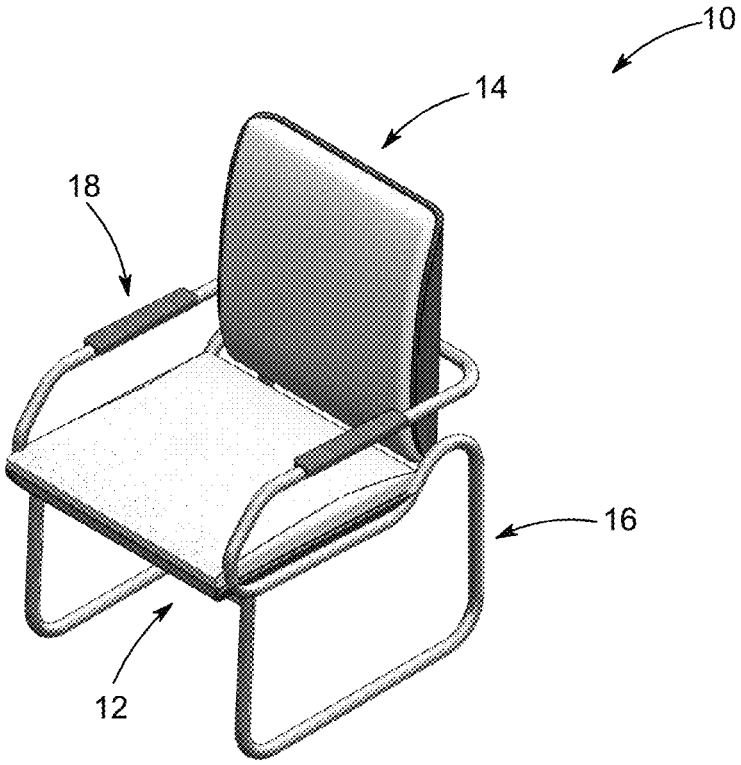
FIG. 65 is a front perspective view of the dining chair in accordance with one or more arrangements, the view showing the dining chair having a backrest, a seat, a frame, and arm covers. The view also showing the dining chair in an upright position.
Figure 66:
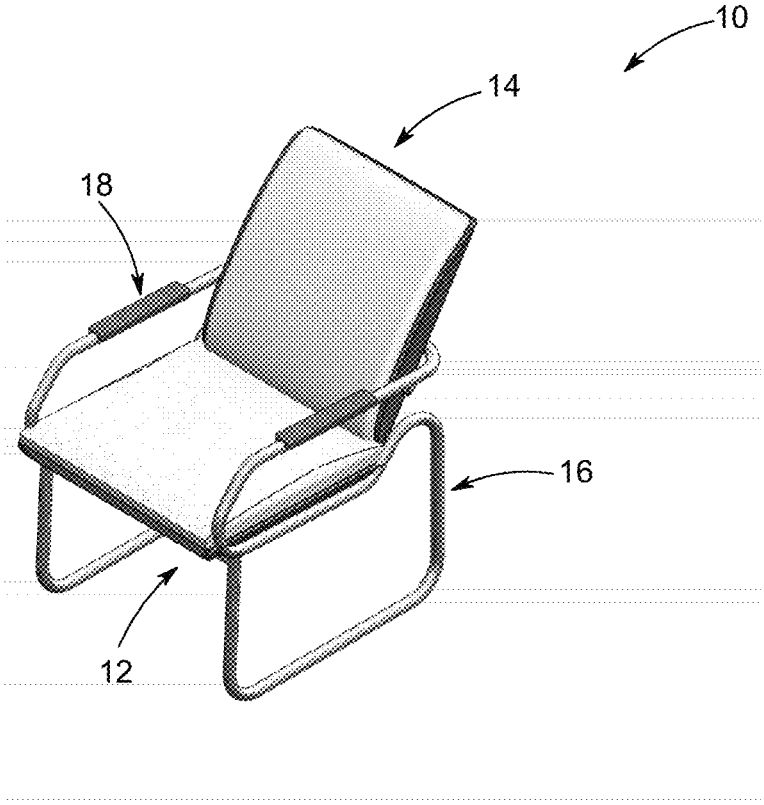
FIG. 66 is a front perspective view of the dining chair in accordance with one or more arrangements, the view showing the dining chair having a backrest, a seat, a frame, and arm covers. The view also showing the dining chair in a reclined position.
Figure 67:
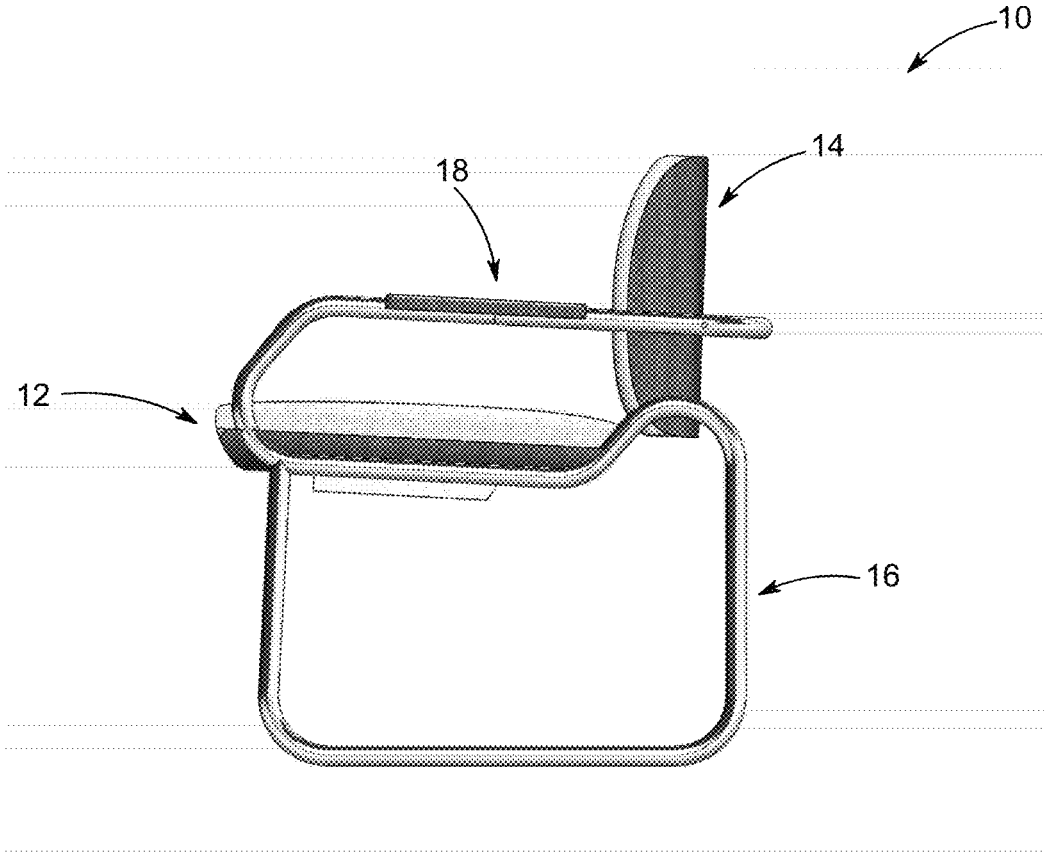
FIG. 67 is a left elevation view of the dining chair in accordance with one or more arrangements, the view showing the dining chair having a backrest, a seat, a frame, and arm covers. The view also showing the dining chair in an upright position.
Figure 68:
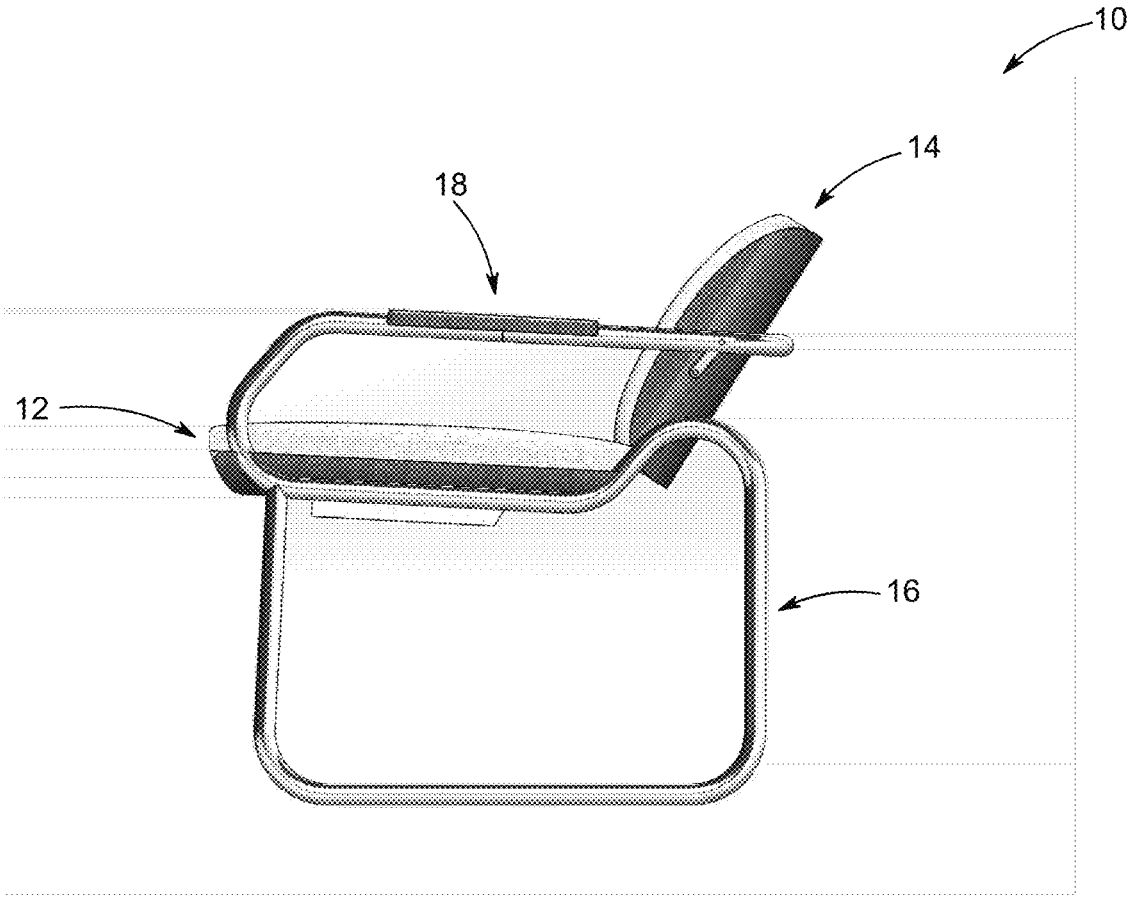
FIG. 68 is a left elevation view of the dining chair in accordance with one or more arrangements, the view showing the dining chair having a backrest, a seat, a frame, and arm covers. The view also showing the dining chair in a reclined position.
Figure 69:
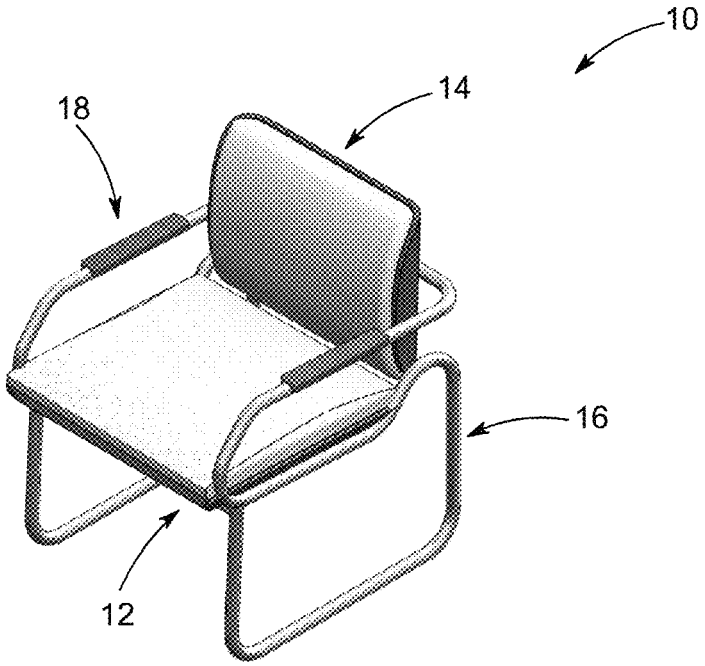
FIG. 69 is a front perspective view of the dining chair in accordance with one or more arrangements, the view showing the dining chair having a backrest, a seat, a frame, and arm covers. The view also showing the dining chair in an upright position.

While some arrangements may be primarily shown or described as having a continuous axle 310 extending across backrest 14 and outward from the sides of backrest 14, the embodiments are not so limited. Rather, it is contemplated that in one or more arrangements, lower guide assembly 300 may include two separate lower axles 310 connected to each side of backrest 14 to facilitate connection with rollers 312 and slotted track 224, for example as shown in FIG. 14.

Rollers 312 are formed of any suitable size, shape, and design and are configured to connect with opposing ends 316 of lower axle 310 and move smoothly within frame 16 along the path of slotted track 224. In one or more various arrangements, rollers 312 may implemented using various means or methods for rolling known in the art including but not limited to, for example, wheels, balls, bearings, or a combination thereof. In one or more various arrangements, rollers 312 may be attached to opposing ends 316 of lower axle 310 using various methods or means for connecting including but not limited to, for example, screws, bolts, clamps, pins, rivets, welding, snap connectors, friction fit connectors, adhesives, chemical bonding, and/or any other process or means that results in a permanent of semi-permanent connection.

Upper Guide Assembly 302:

Upper guide assembly 302 is formed of any suitable size, shape, and design and is configured to connect with and guide an upper portion of backrest 14 along a designated path when backrest 14 is moved from an upright position to a reclined position. In the arrangement shown, as one example, upper guide assembly 302 includes an upper axle 330, links 332, and hinged connections 336, among other components.

In this example arrangement, upper axle 330 has an elongated cylindrical shape extending between opposing ends 338. In this example arrangement, upper axle 330 extends through upper set of holes 136 in side portions 118 of rear support member 102 of backrest 14. In this example arrangement, upper axle 330 extends outward from the sides of backrest 14.

In this example arrangement, links 332 have an elongated generally rectangular planar shape extending between upper ends 342 and lower ends 344. In this example arrangement, lower ends 344 of links 332 are connected to the opposing ends 338 of upper axle 330. In this example arrangement, hinged connections 336 connect upper ends 342 of links 332 to arms 246 at holes 270. In one or more arrangements, edges and/or corners of link 332 are rounded to eliminate sharp edges or corners that may be contacted by an occupant of system 10.

Hinged connections 336 are formed of any suitable size, shape, or design, and are configured to facilitate connection of upper ends 342 of links 332 with arms 246, while permitting links 332 to pivot relative to arms 246. In the arrangement shown, as one example, hinged connections 336 are formed by holes in link 332 which are positioned around opposing ends 338 of upper axle 330 and fasteners (e.g., bolts, screws, or any other fasteners) that are connected to holes of arms 246. However, the embodiments are not so limited. Rather, it is contemplated that hinged connections 336 may be implemented using any various methods or means for providing a hinged connecting known in the art.

Counterbalance Assembly 304:

Counterbalance assembly 304 is formed of any suitable size, shape, and design and is configured to apply a bias force sufficient to move backrest 14 to an upright position in the absence of a sufficient opposing force placed on backrest (e.g., by an occupant leaning backward).

In one arrangement shown, as one example, counterbalance assembly 304 includes a pair of arms 350 connected to first ends of torsion springs 352 positioned on upper axle 330 of upper guide assembly 302. In this example arrangement, arms 350 brace against lower axle 310 to prevent rotation of the first ends of torsion springs 352 when tensioned. In this example arrangement, the other ends of torsion springs 352 are connected to upper axle 330, which is connected to lower ends 344 of links 332 of upper guide assembly 302. When viewed from the left side torsion springs 352 are tensioned to rotate upper axle 330 and links 332 clockwise in absence of a sufficient opposing force, thereby moving backrest 14 to the upright position.

However, embodiments are not so limited. Rather, it is contemplated that in various different arrangements counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

As an alternative example, in one or more arrangements, counterbalance assembly 304 includes torsion springs 352 and a tensioner assembly 348 operably connected to upper axle 330.

In this example arrangement, torsion springs 352 each have a first end 354 connected to upper axle 330 and a second end 356 connected to a tensioner assembly 348. When viewed from the left side, torsion springs 352 are tensioned to rotate upper axle 330 and links 332 clockwise in absence of a sufficient opposing force, thereby moving backrest 14 to the upright position.

Tensioner assembly 348 is formed of any suitable size, shape, and design and is configured to apply tension to torsion springs 352 so as to cause torsion springs 352 to apply the bias force, by rotating upper axle 330, to move backrest 14 to an upright position in the absence of a sufficient opposing force placed on backrest 14. In the arrangement shown, as one example, tensioner assembly 348 includes a generally cylindrical tube 368 shape extending between opposing ends 370, where tube 368 is operably connected to second ends 356 of torsion springs 352, a tensioner gear mechanism 374, and a housing 366 among other components.

In this example arrangement, upper axle 330 extends through tube 368 and is configured to freely rotate relative to tube 368. In this example arrangement, tube 368 has a set of teeth 372 formed on an exterior surface of the tube 368.

In this example arrangement, tensioner assembly 348 includes a tensioner gear mechanism 374. Tensioner gear mechanism 374 is formed of any suitable size, shape, and design and is configured to engage teeth 372 of tube 368 and facilitate rotation of tube 368 to tension torsion springs 352. In the arrangement shown, as one example, tensioner gear mechanism 374 includes a worm gear 376 positioned to engage teeth 372 and cause tube 368 to rotate when the worm gear 376 is rotated by a user. In this example arrangement, worm gear 376 has a generally cylindrical shape extending from a forward end 378 to a rearward end 380 and has helical features 382 extending along an exterior surface of worm gear 376.

In this example arrangement, helical features 382 engage teeth 372 so as to cause tube 368 to rotate when worm gear 376 is rotated. In this example arrangement, worm gear 376 has a set of contact features 384 at forward end 378 to facilitate operable connection with a tool (e.g., a socket, wrench, screwdriver, or any other tool) for rotation of worm gear 376 by a user. In this example arrangement, features 384 at forward end 378 are accessible by a user via a hole 434 in backrest 14. For example, in one or more arrangements, features 384 at forward end 378 of worm gear 376 may be accessible from a hole 434 positioned in rear support member 102 of backrest support assembly 100. Additionally or alternatively, in one or more arrangements, features 384 at forward end 378 of worm gear 376 may be accessible from a hole 434 positioned in front support member 104 of backrest support assembly 100, which is accessible by removing cushion 106 from front support member 104. Additionally or alternatively, in one or more arrangements, features 384 at forward end 378 of worm gear 376 may be accessed by removing front support member 104 from rear support member 102 to expose tensioner assembly 348. However, the embodiments are not limited to these example arrangements. Rather it is contemplated that in various different arrangements may provide access for adjustment of tensioner assembly 348 using various other methods of means known in the art.

However, the arrangements are not so limited. Rather, it is contemplated that tensioner assembly 348 may be implemented using various different arrangements of components and/or may be positioned at various locations within system 10 to facilitate tensioning of torsion springs 352 of counterbalance assembly 304.

However, embodiments are not so limited. Rather, it is contemplated that in various different arrangements counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

Housing 366:

Housing 366 is formed of any suitable size, shape, and design and is configured to house cylindrical tube 368 and tensioner gear mechanism 374 and connect counterbalance assembly 304 with backrest 14. In the arrangement shown, as one example, housing 366 includes a front plate 400 and a back plate 402 forming a hollow interior 404 for housing cylindrical tube 368 and tensioner gear mechanism 374.

In this example arrangement, front plate 400 has a generally rectangular shape having a front surface 406 and a back surface 408, extending between a top 410, a bottom 412, and opposing sides 414. In this example arrangement, back plate 402 also has a generally rectangular shape having a front surface 418 and a back surface 420, extending between a top 422, a bottom 424, and opposing sides 426.

In this example arrangement, front surface 418 of back plate 402 and back surface 408 of front plate 400 each have a set of semi-cylindrical recesses 430 configured to receive and hold tube 368 of tensioner assembly 348. In this example arrangement, tube 368 is positioned in an opening defined by recesses 450, which extends between opposing sides 414/426 of front plate 400 and back plate 402. In this example arrangement, front surface 418 of back plate 402 and back surface 408 of front plate 400 also have circular recesses 432 configured to receive and hold worm gear 376. In this example arrangement, circular recesses 432 are positioned proximate to semi-cylindrical recesses 430 so helical features 382 of worm gear 376 engage teeth 372 of tube 368. More specifically, rearward end 380 of worm gear 376 is positioned within circular recess 432 of back plate 402 and forward end 378 of worm gear 376 is positioned in circular recess 432 of front plate 400. In this example arrangement, front plate 400 has an access hole 434 extending from front surface 406 into circular recess 432 of front plate 400 to provide access to contact features 384 of worm gear 376 to facilitate tensioning of torsion springs 352.

In one or more arrangements, front plate 400 and back plate 402 of tensioner assembly 348 are connected together by a set of fasteners 438 (e.g., bolts) that extend though holes 440 in front plate 400 and into back plate 402. However, the embodiments are not so limited. Rather, it is contemplated that in one or more arrangements front plate 400 and back plate 402 of tensioner assembly 348 may be connected using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Stop Features 358:

In one or more arrangements, reclining mechanism 20 includes one or more stop features 358 (not shown) configured to facilitate positioning of seat 12 at one or more intermediate positions between the upright position and the reclined position. In one or more arrangements, as one example, stop feature(s) 358 may be recesses inside frame 16 that rollers 312 roll over when backrest 14 is moved between the upright and reclined positions. Due to a slightly larger amount of force required to move rollers 312 out of such recess, reclining mechanism 20 helps hold backrest 14 at one or more defined intermediate positions, thereby increasing reclining options for the occupant. However, the embodiments are not so limited. Rather, it is contemplated that reclining mechanism 20 may utilize various methods and means for holding backrest 14 at one or more intermediate positions including but not limited to, for example, recesses, protrusions, indents, detents, holes, compressive fittings, frictional stops, magnetic components, gears, latches, non-linear springs, non-linear cams and pulleys and/or any other suitable means or methods known in the art.

In Operation:

In operation, when backrest 14 is moved to an upright position, rollers 312 are moved within frame 16 upward and rearward along slotted track 224 to an upper end of slotted track 224, thereby moving a lower end of backrest 14 upward and rearward. At the same time, link 332 of upper guide assembly 302 moves an upper end of backrest 14 upward and forward. Conversely, when backrest 14 is moved to a reclined upright position, rollers 312 are moved downward and forward along slotted track 224 to a lower end of slotted track 224, thereby moving a lower end of backrest 14 downward and forward. At the same time, link 332 of upper guide assembly 302 moves the upper end of backrest 14 downward and rearward. This guided movement of backrest 14 between upright and reclined positioned facilitates a more natural movement of an occupant between upright and reclined positions.

ALTERNATIVE ARRANGEMENT

Figure 70:
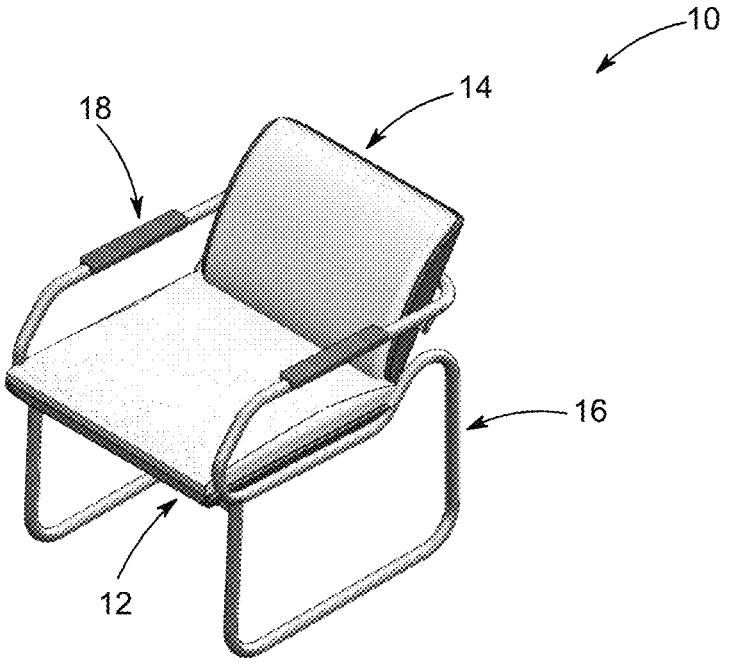
FIG. 70 is a front perspective view of the dining chair in accordance with one or more arrangements, the view showing the dining chair having a backrest, a seat, a frame, and arm covers. The view also showing the dining chair in a reclined position.
Figure 71:
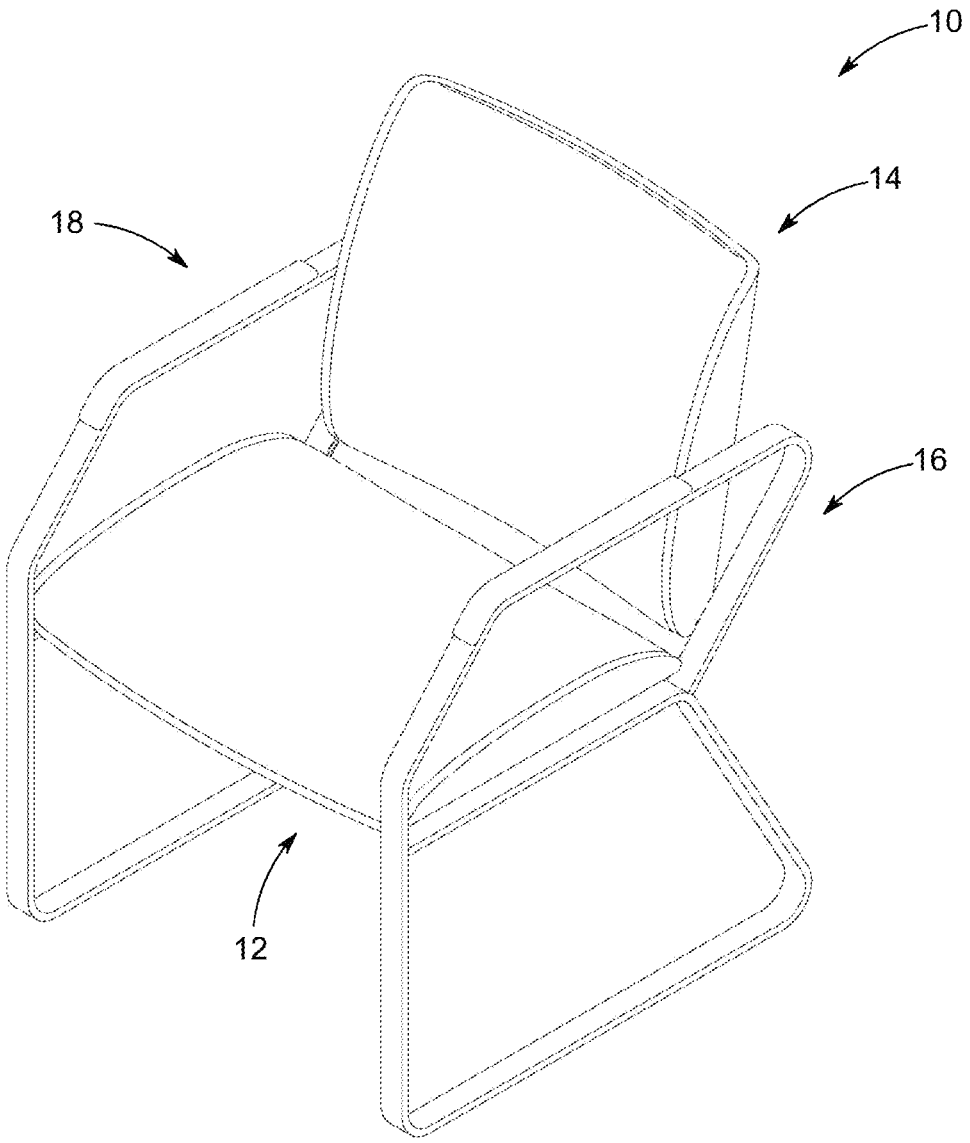
FIG. 71 is a front perspective view of the dining chair in accordance with one or more arrangements, the view showing the dining chair having a backrest, a frame, and arm covers. The view also showing the dining chair in an upright position.
Figure 72:
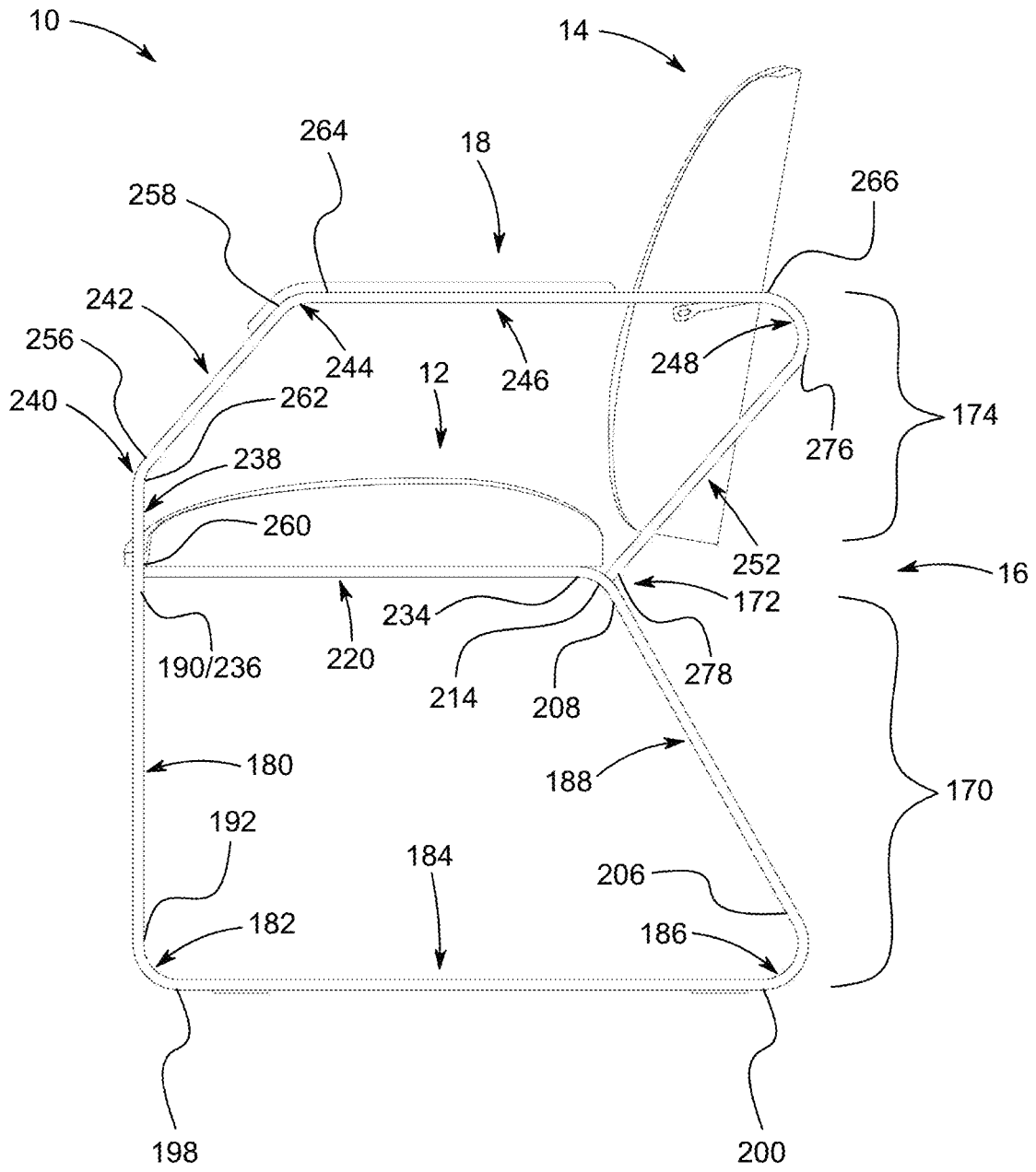
FIG. 72 is a left elevation view of the dining chair in accordance with one or more arrangements, the view showing the dining chair having a seat assembly, a backrest, and a frame. The view also showing the frame having a base section, a seat support section, and an arm support section; the view showing the dining chair backrest in an upright position.
Figure 73:
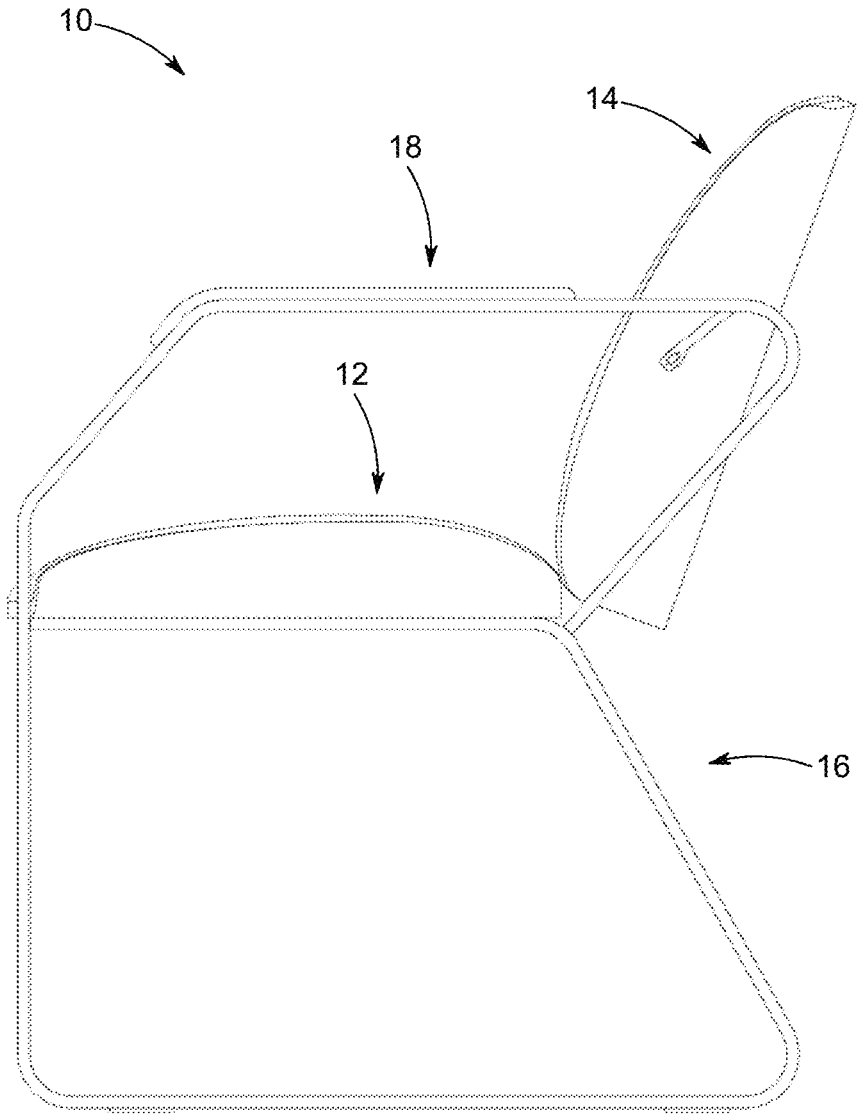
FIG. 73 is a left elevation view of the dining chair in accordance with one or more arrangements, the view showing the dining chair having a backrest, a seat, a frame, and arm covers. The view also showing the dining chair in a reclined position.
Figure 74:
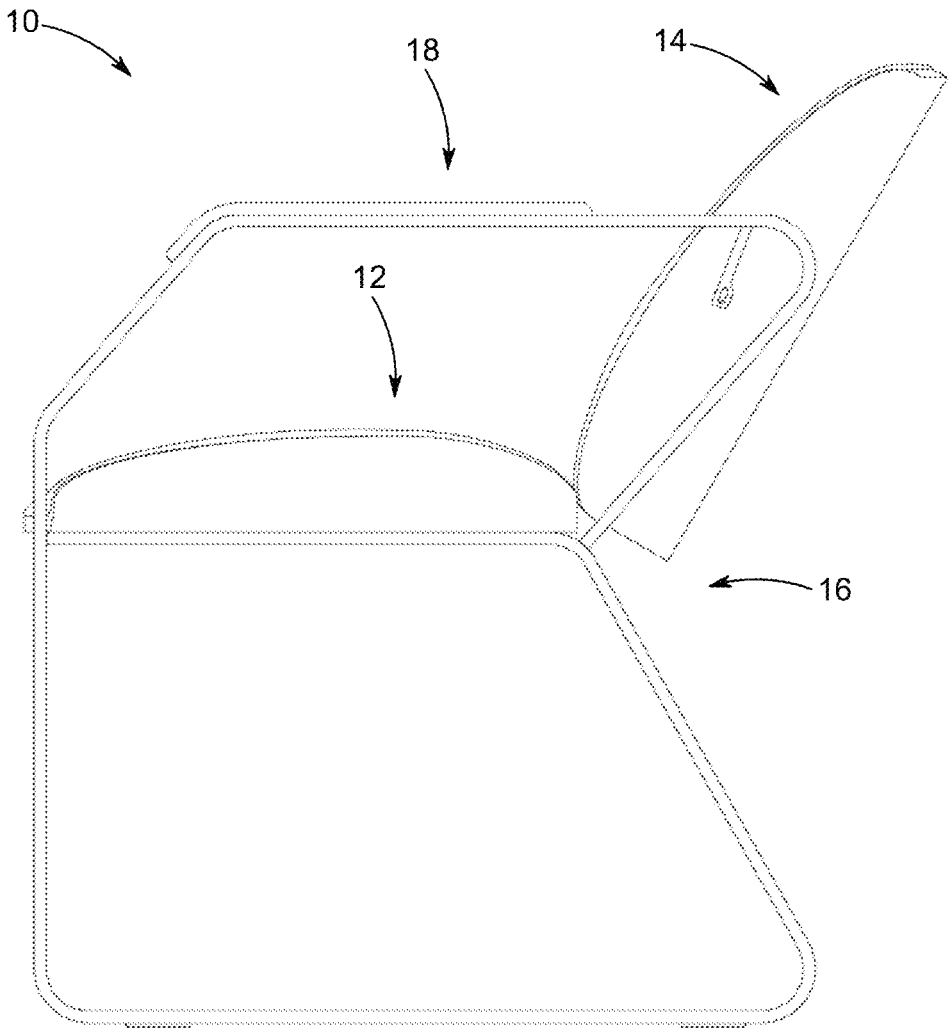
FIG. 74 is a left elevation view of the dining chair in accordance with one or more arrangements, the view showing the dining chair having a backrest, a seat, a frame, and arm covers. The view also showing the dining chair in a reclined position.
Figure 75:
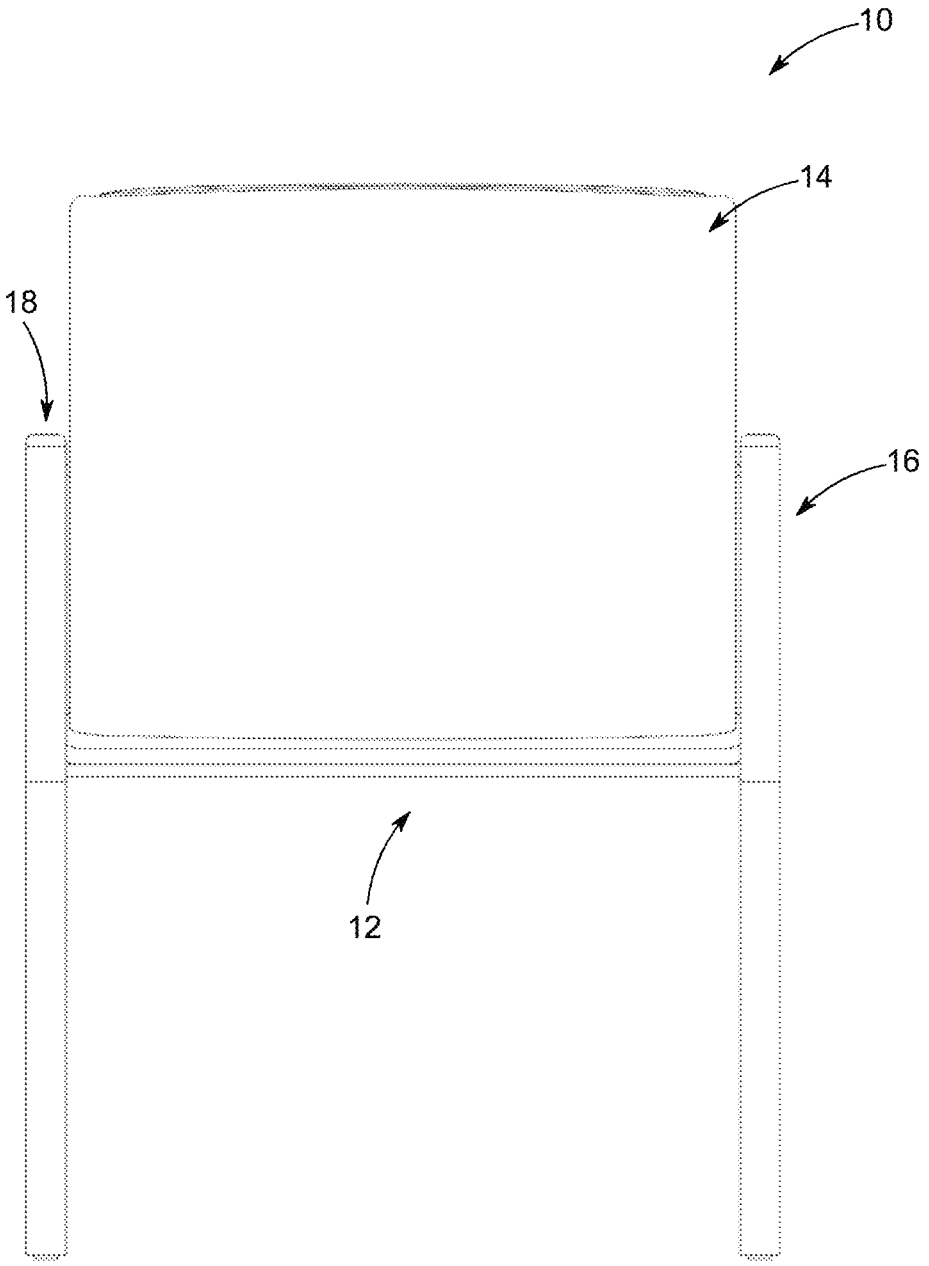
FIG. 75 is a back elevation view of the dining chair in accordance with one or more arrangements, the view showing the dining chair having a backrest, a seat, a frame, and arm covers.
Figure 76:
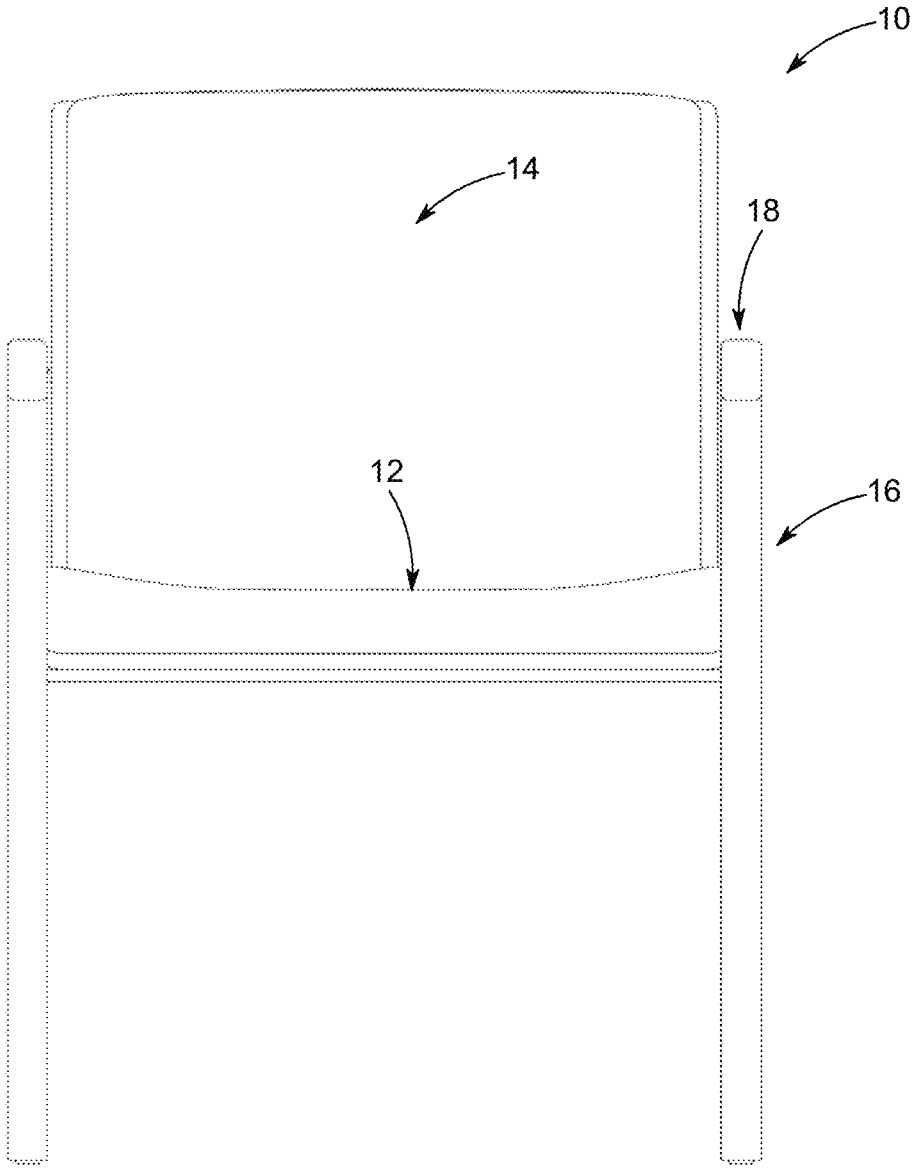
FIG. 76 is a front elevation view of the dining chair in accordance with one or more arrangements, the view showing the dining chair having a backrest, a seat, a frame, and arm covers. The view also showing the dining chair in an upright position.
Figure 77:
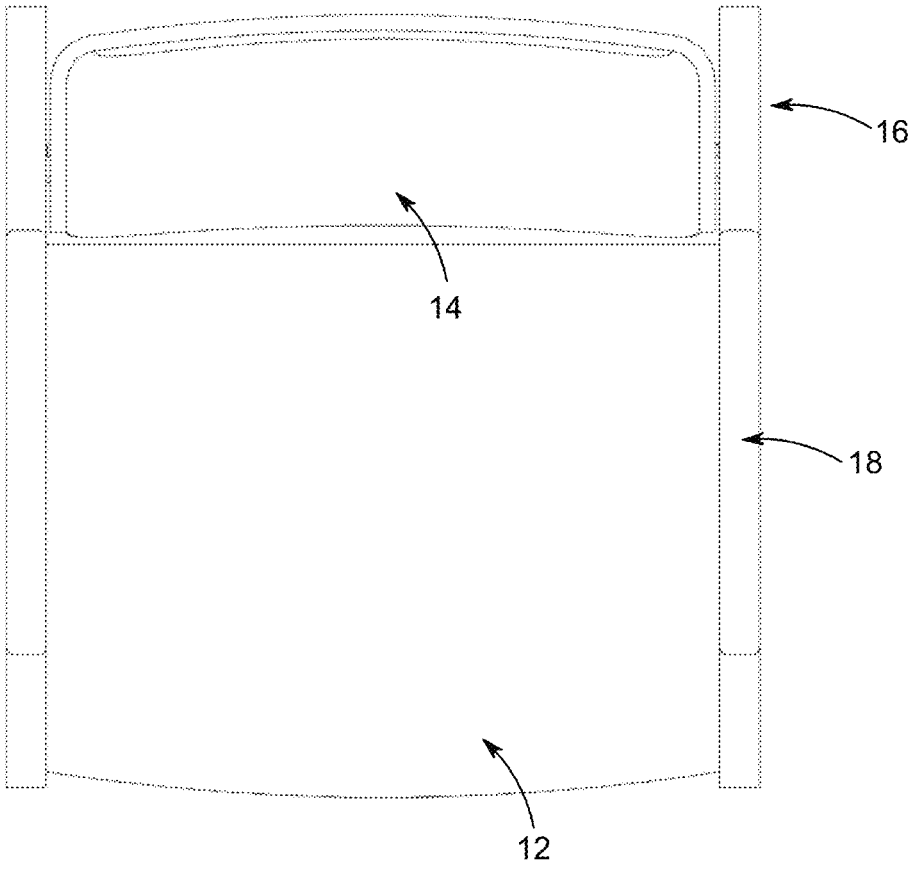
FIG. 77 is a top elevation view of the dining chair in accordance with one or more arrangements, the view showing the dining chair having a backrest, a seat, a frame, and arm covers.
Figure 78:
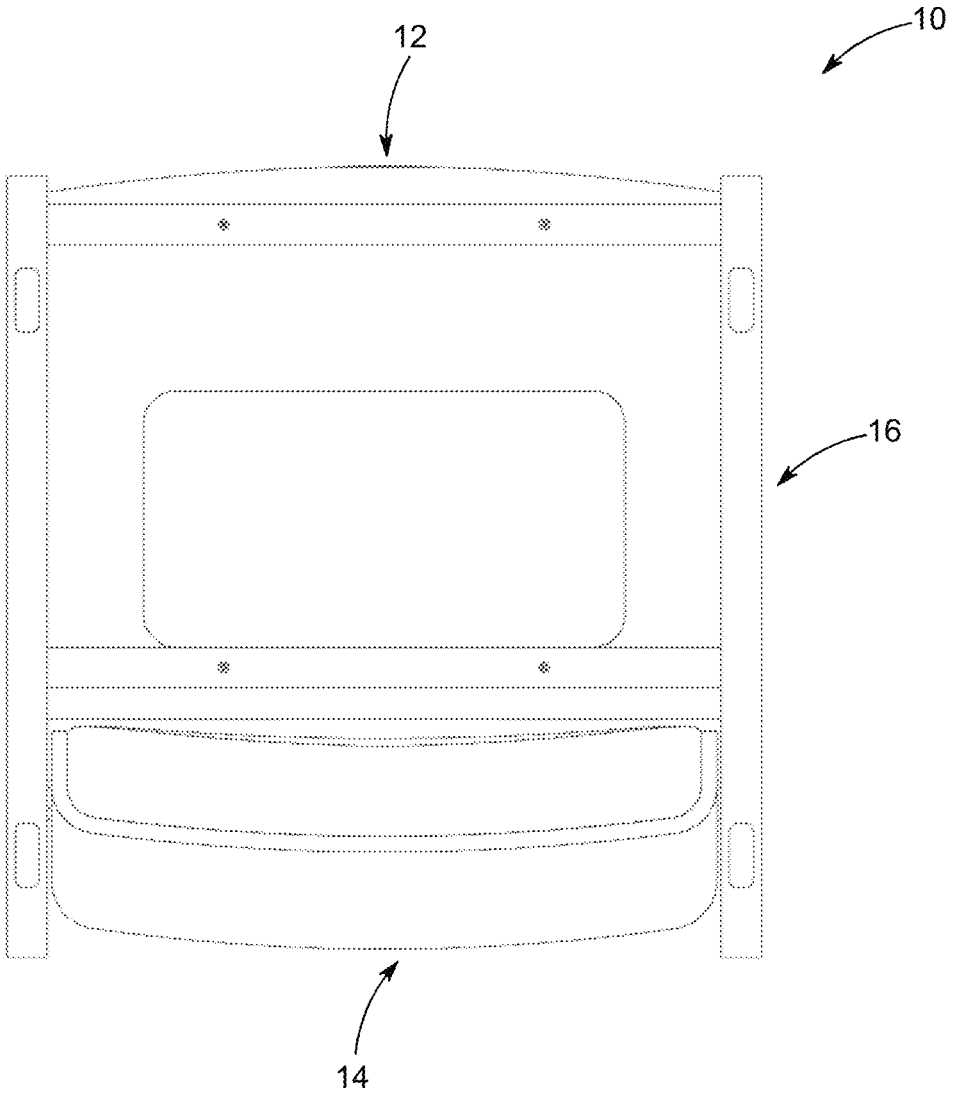
FIG. 78 is a bottom elevation view of the dining chair in accordance with one or more arrangements, the view showing the dining chair having a backrest, a seat, and a frame. The view also showing the dining chair in an upright position.
Figure 79:
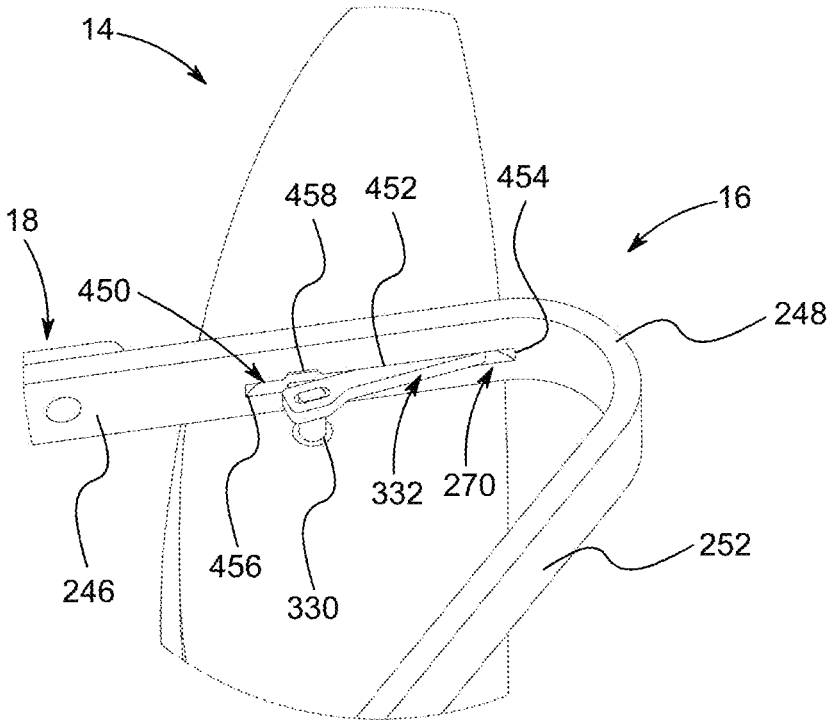
FIG. 79 is a section view of the dining chair in accordance with one or more arrangements, the view showing the dining chair having a frame, an upper guide assembly, and a counterbalance assembly.
Figure 80:
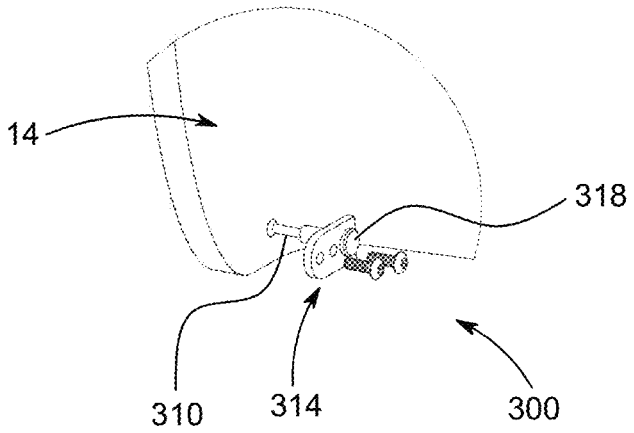
FIG. 80 is a section view of the dining chair in accordance with one or more arrangements, the view showing the dining chair having a reclining assembly with a lower guide assembly.
Figure 81:
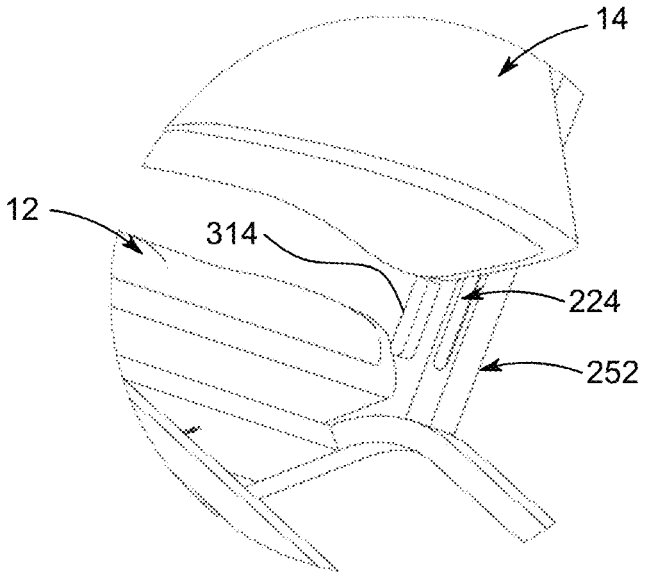
FIG. 81 is a section view of the dining chair in accordance with one or more arrangements, the view showing the dining chair having a slotted track with a guide member.
Figure 82:
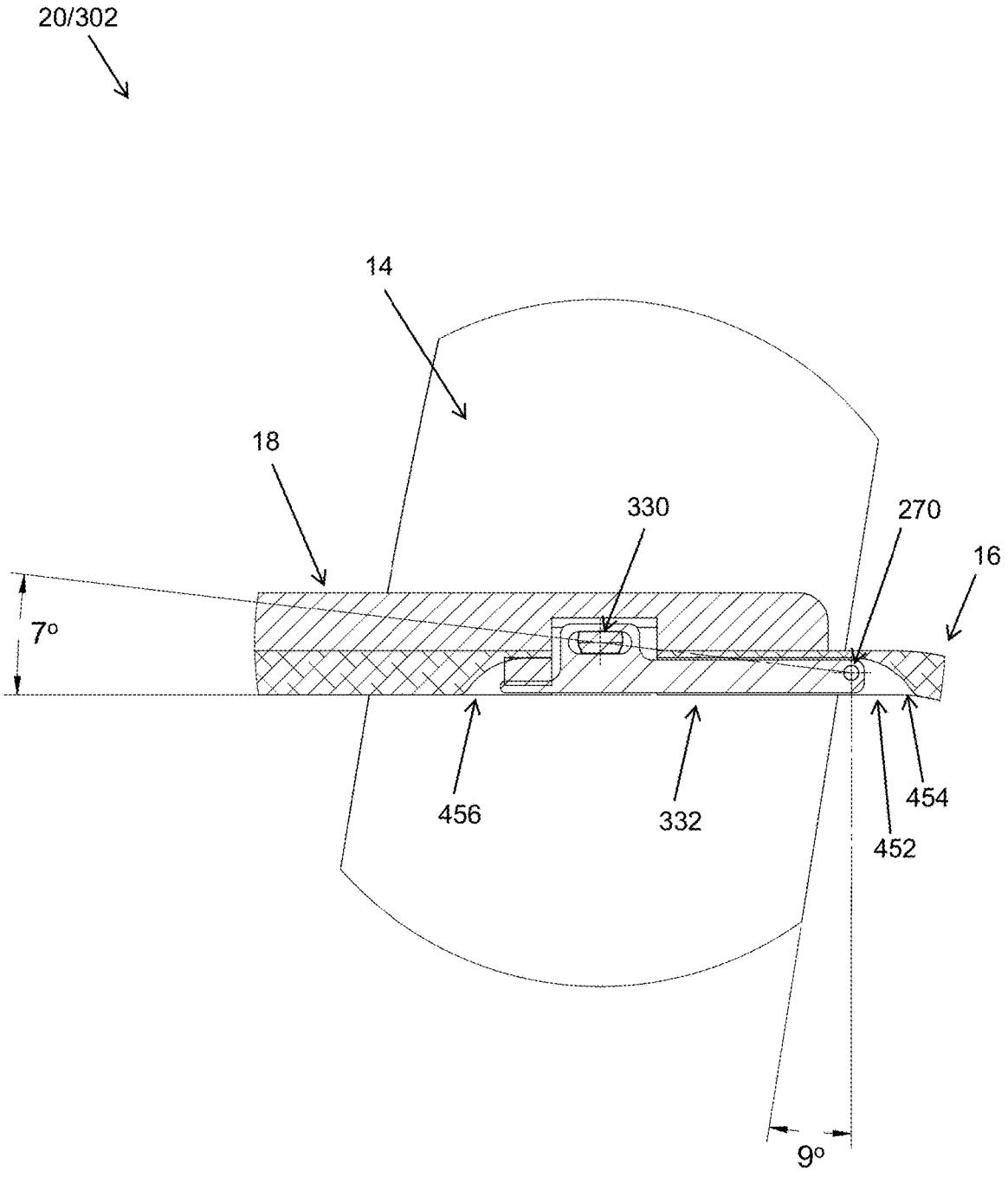
FIG. 82 is a section view of the dining chair in accordance with one or more arrangements, the view showing the dining chair having a reclining assembly with an upper guide assembly. The view also showing the upper axle of the upper guide assembly connected to the second channel of the recesses of the arms of the dining chair.
Figure 83:
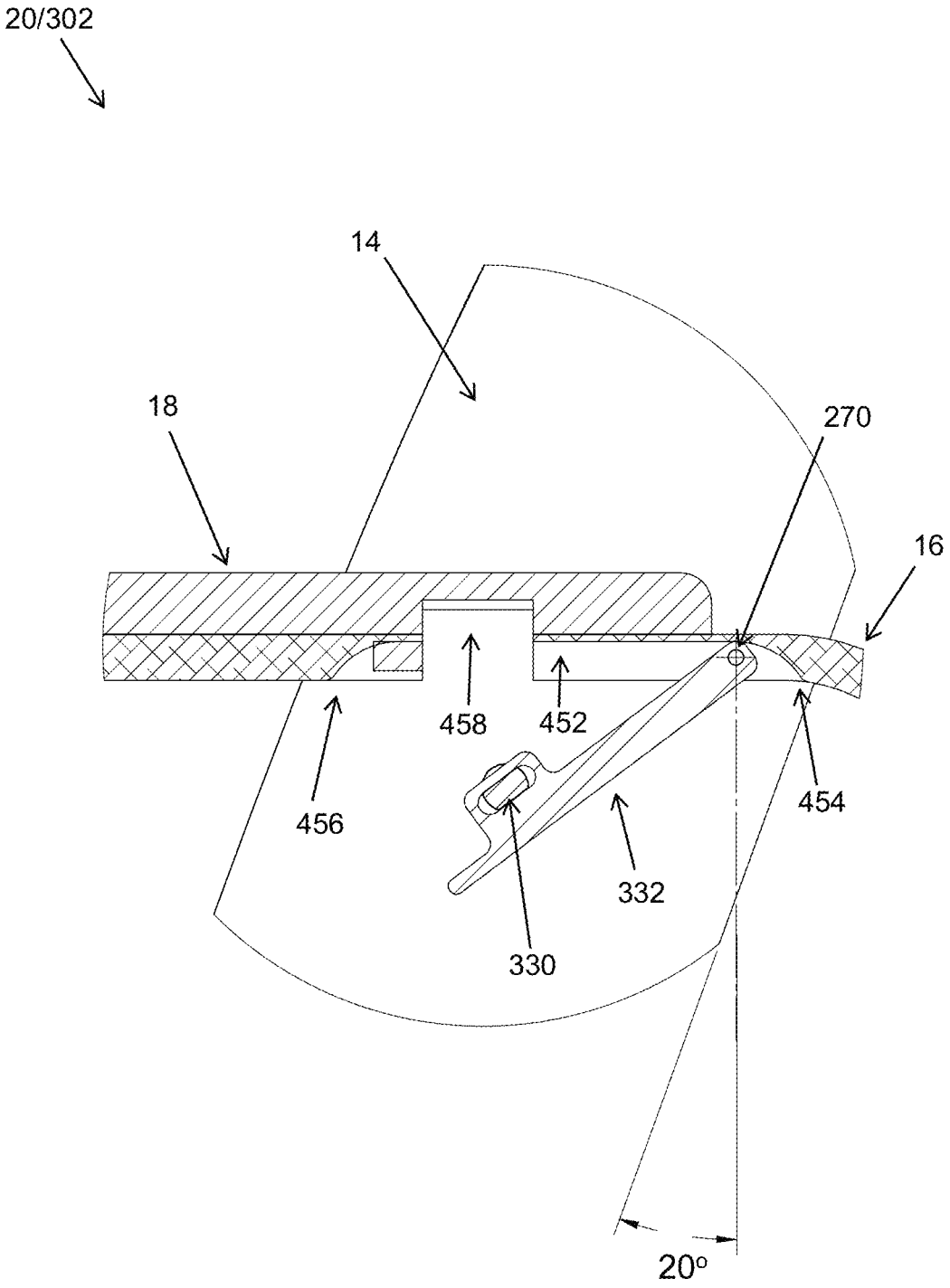
FIG. 83 is a section view of the dining chair in accordance with one or more arrangements, the view showing the dining chair having a reclining assembly with an upper guide assembly. The view also showing the upper axle of the upper guide assembly extended away from the second channel of the recesses of the arms of the dining chair.
Figure 84:
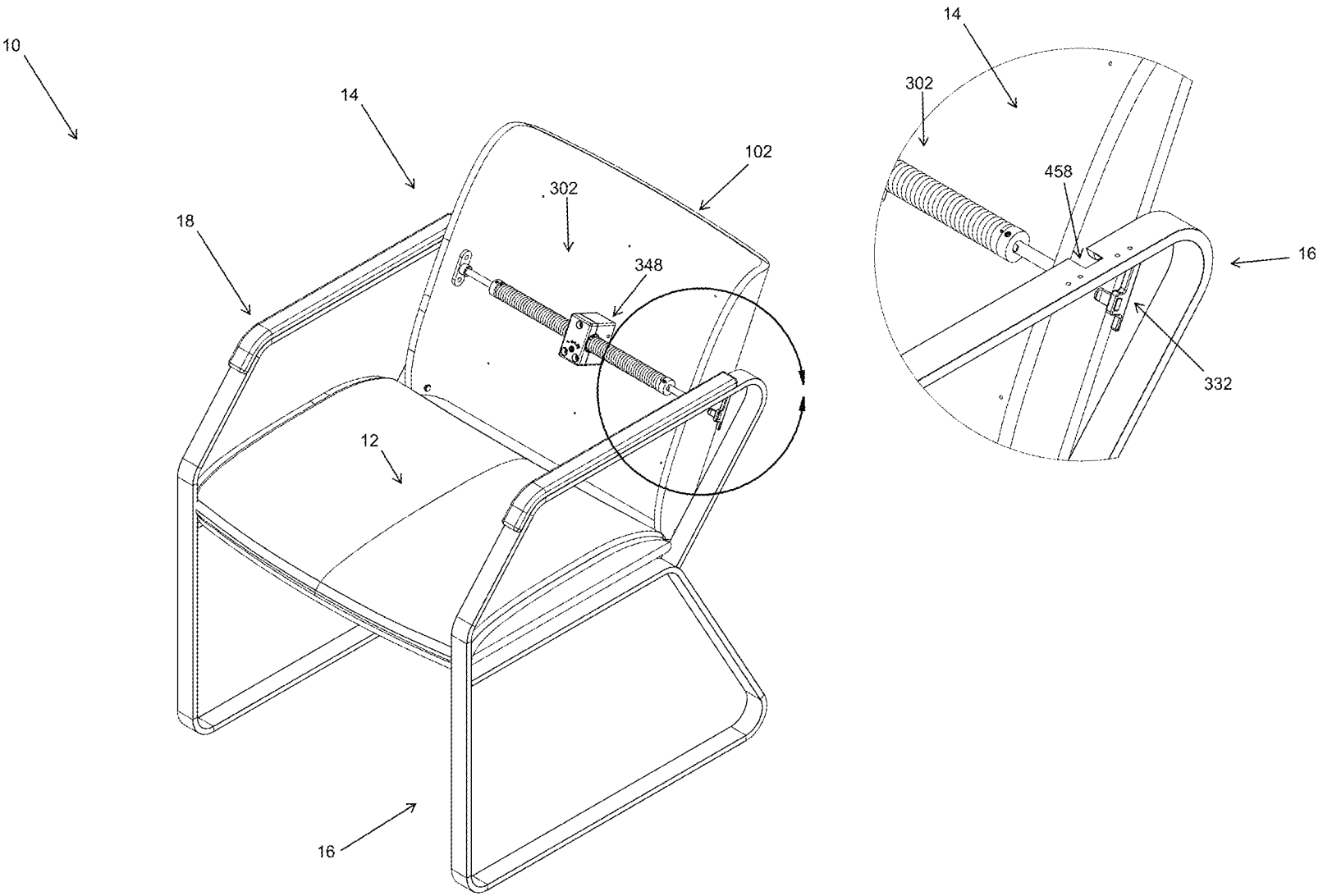
FIG. 84 is a front perspective view of the dining chair in accordance with one or more arrangements, the view showing the dining chair having a backrest, a frame, a seat, and arm covers. The view showing the dining chair having a reclining assembly having an upper guide assembly and a tensioner assembly. The view also showing the dining chair having recesses in the arms.
Figure 85:
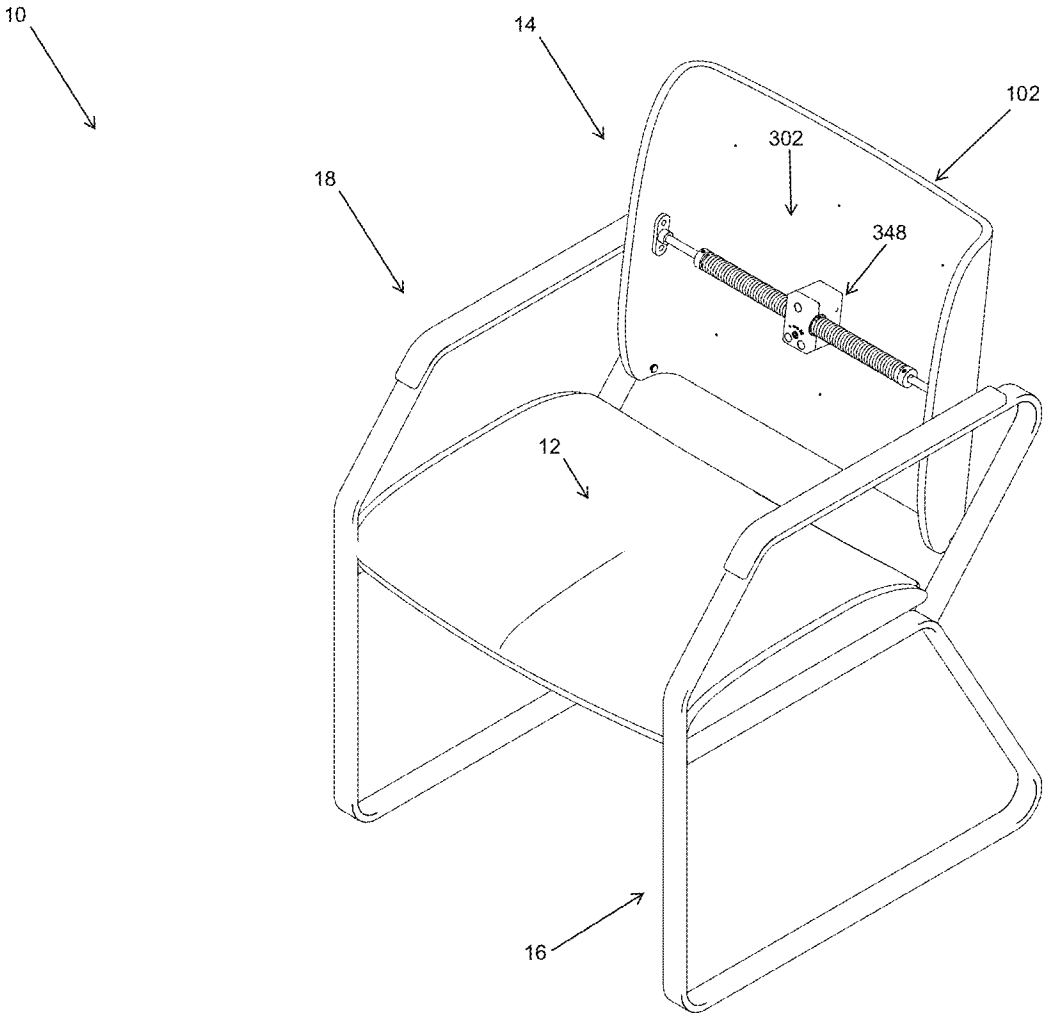
FIG. 85 is a front perspective view of the dining chair in accordance with one or more arrangements, the view showing the dining chair having a backrest, a frame, a seat, and arm covers. The view showing the dining chair having a reclining assembly having an upper guide assembly and a tensioner assembly.
Figure 86:
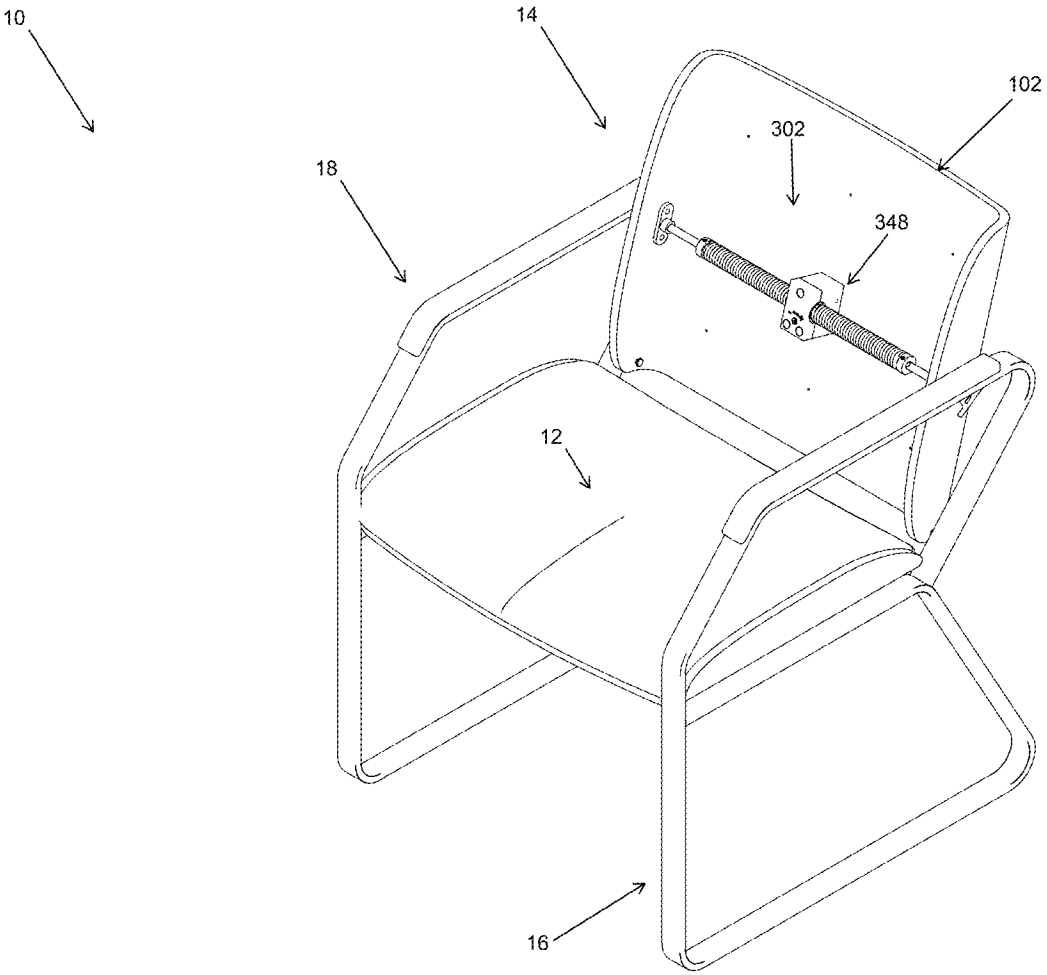
FIG. 86 is a front perspective view of the dining chair in accordance with one or more arrangements, the view showing the dining chair having a backrest, a frame, a seat, and arm covers. The view showing the dining chair having a reclining assembly having an upper guide assembly and a tensioner assembly. The view also showing the dining chair in an upright position.
Figure 87:
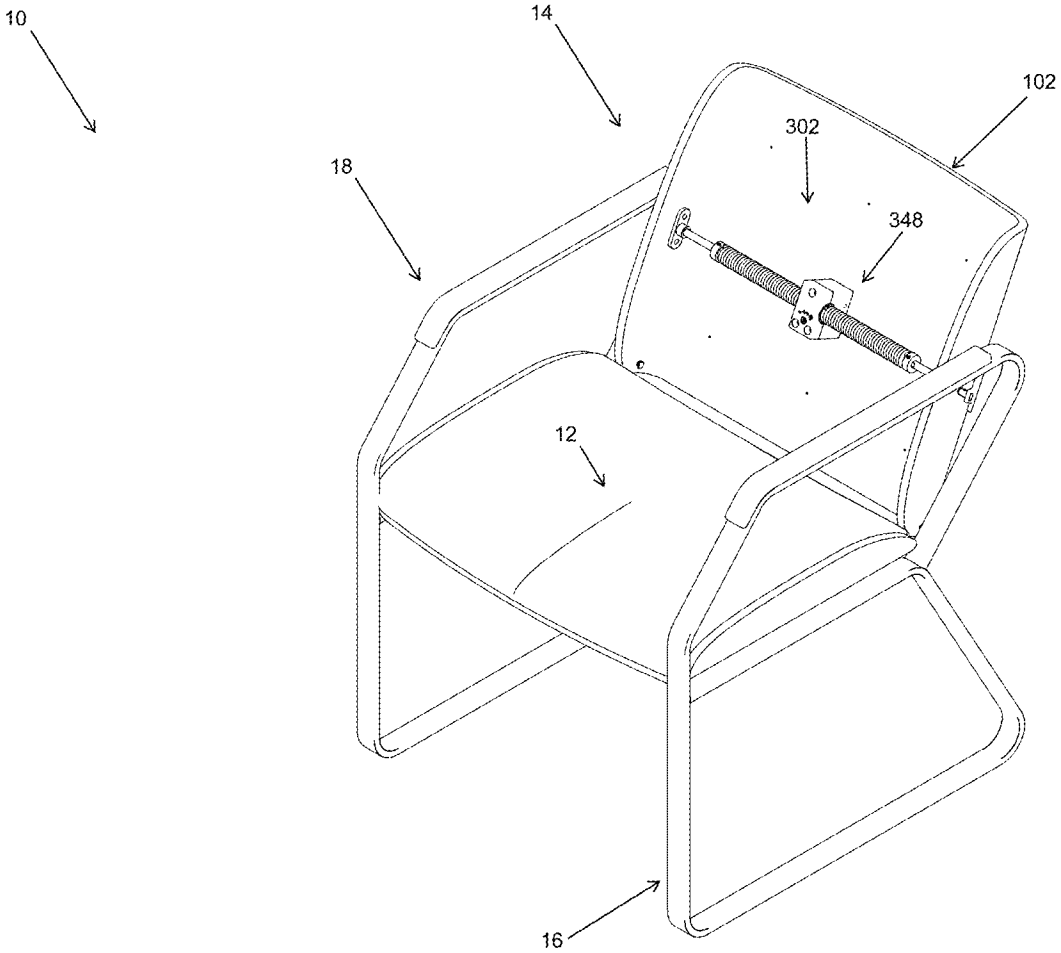
FIG. 87 is a front perspective view of the dining chair in accordance with one or more arrangements, the view showing the dining chair having a backrest, a frame, a seat, and arm covers. The view showing the dining chair having a reclining assembly having an upper guide assembly and a tensioner assembly. The view also showing the dining chair in a reclined position.
Figure 88:
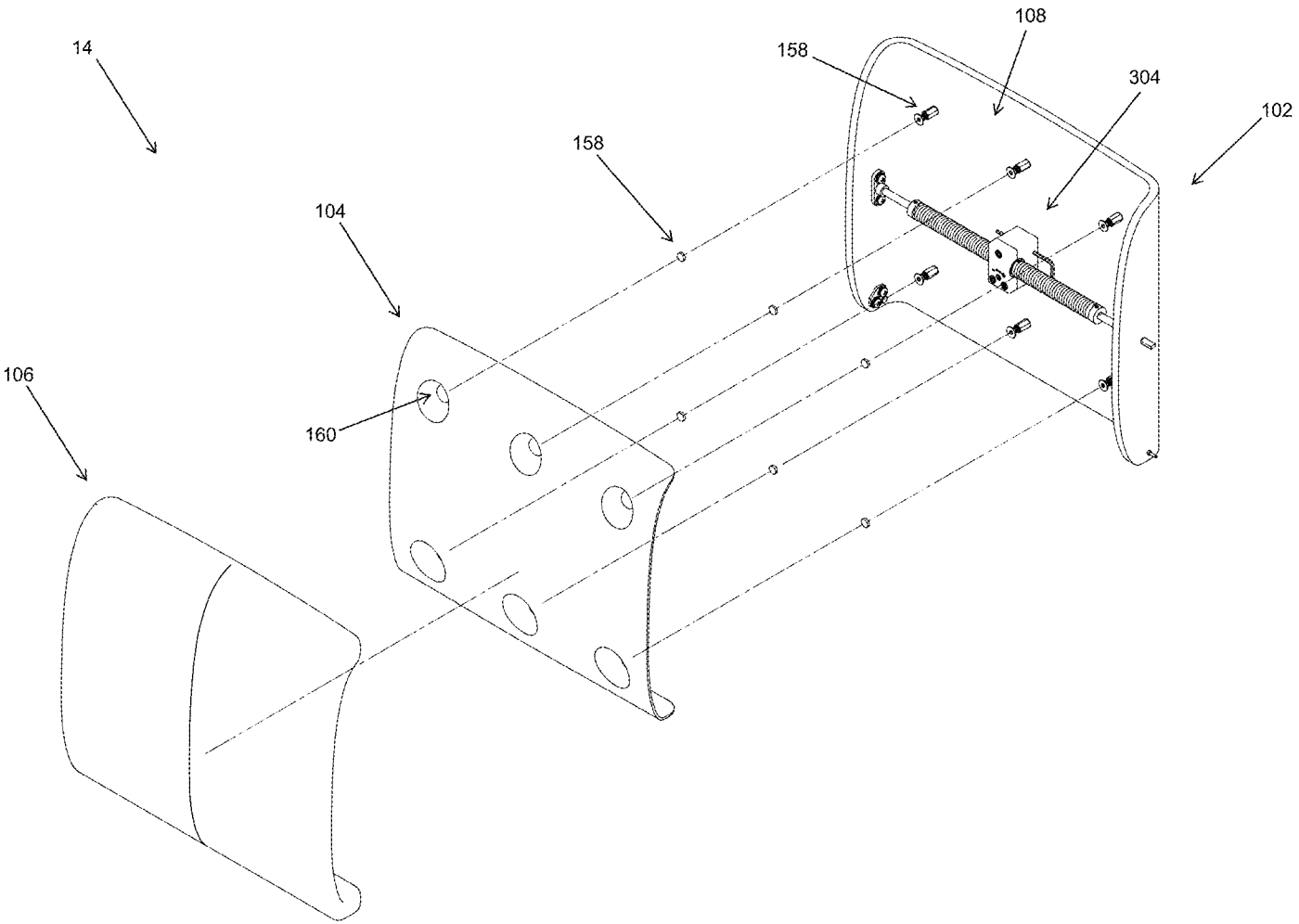
FIG. 88 is an exploded perspective view of the reclining assembly of the dining chair. The view also showing the cushion of the dining chair.
Figure 89:
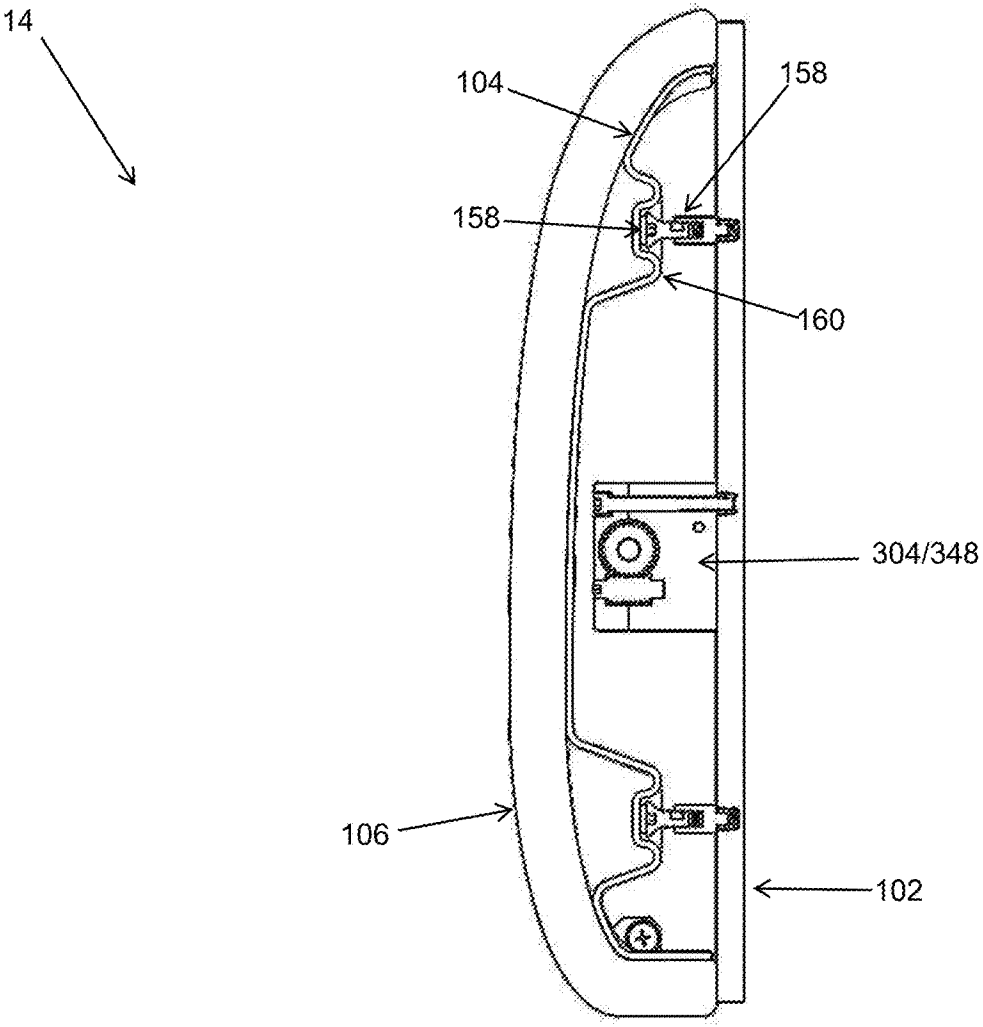
FIG. 89 is a side elevation section view of the dining chair in accordance with one or more arrangements, the view showing the dining chair having a backrest with a cushion. The view also showing a backrest support assembly and a counterbalance assembly having a tensioner assembly.
Figure 90:
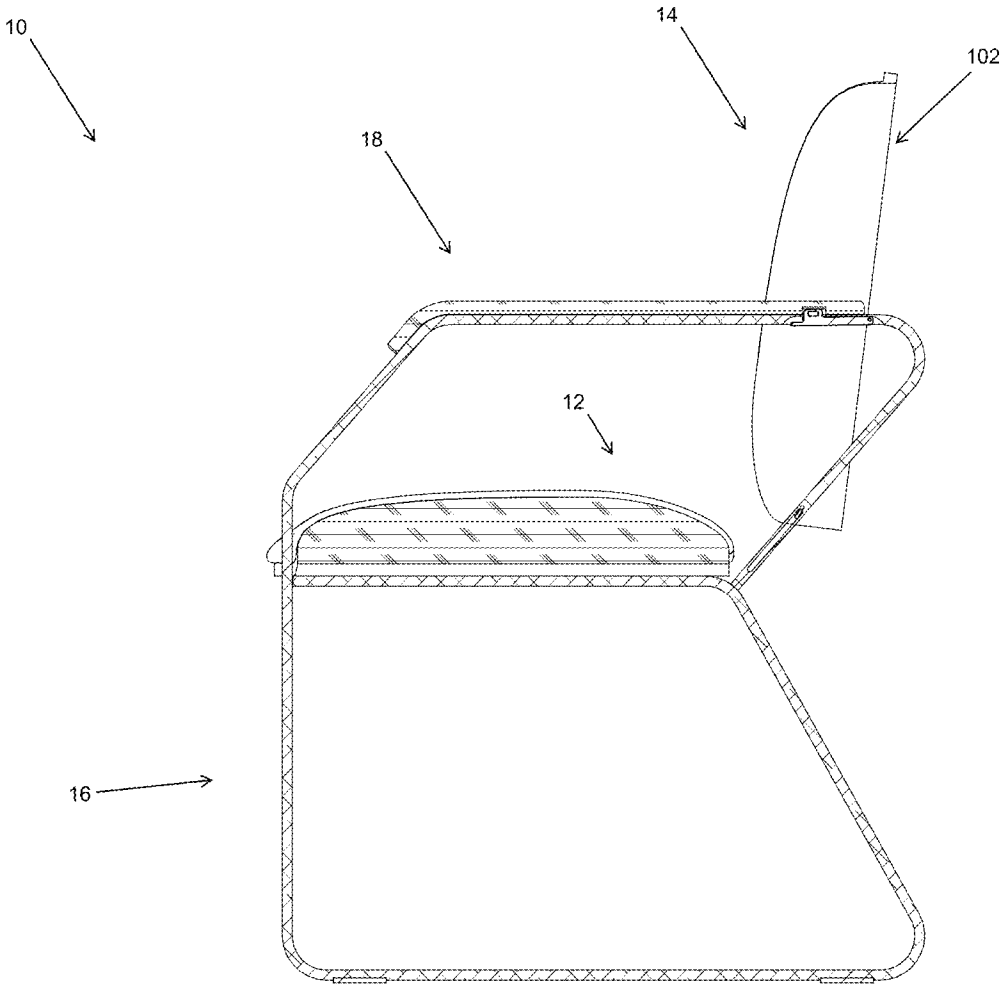
FIG. 90 is a left elevation view of the dining chair in accordance with one or more arrangements, the view showing the dining chair having a backrest, a seat, a frame, and arm covers. The view also showing the dining chair in an upright position.
Figure 91:
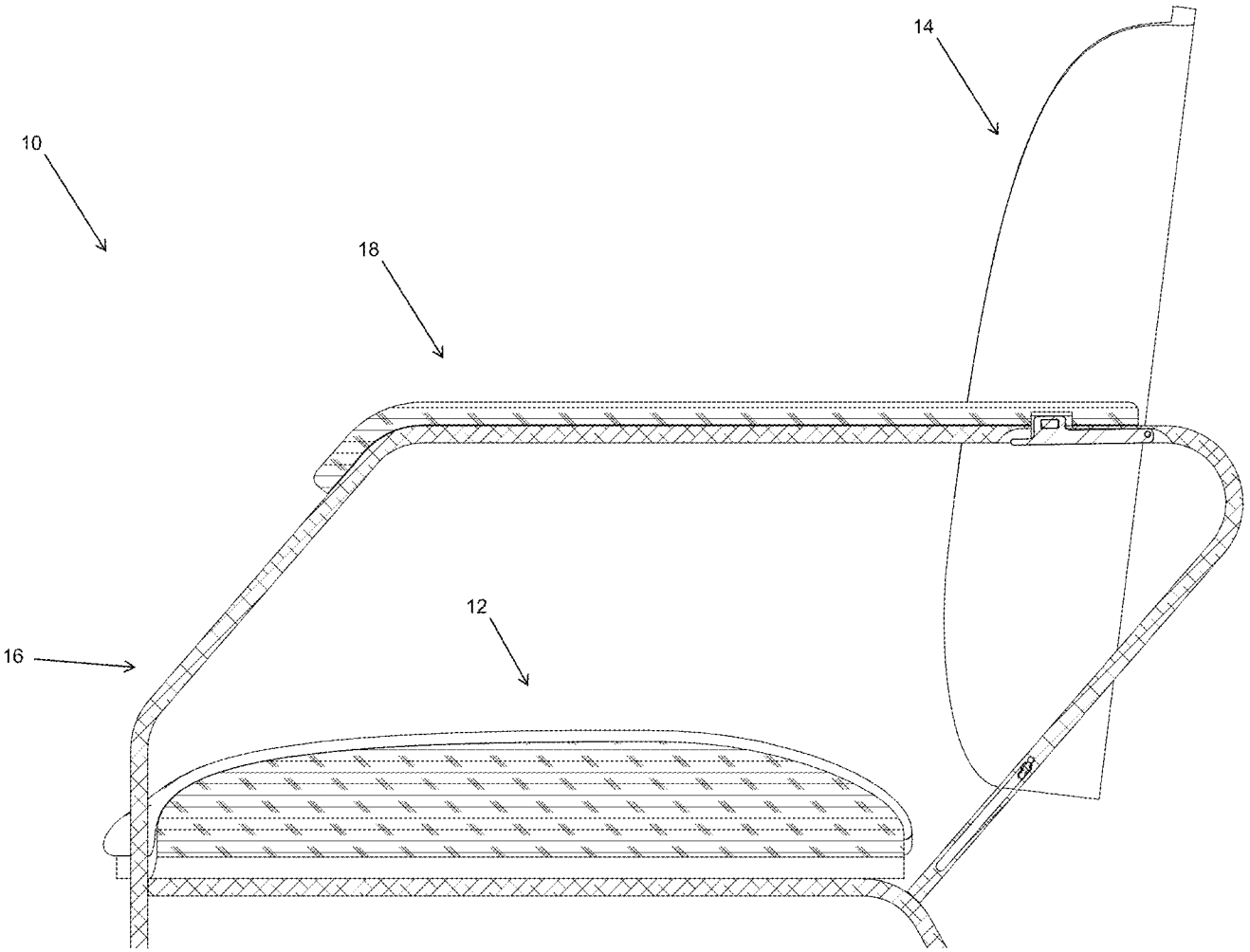
FIG. 91 is a left elevation view of the dining chair in accordance with one or more arrangements, the view showing the dining chair having a backrest, a seat, a frame, and arm covers. The view also showing the dining chair in an upright position.
Figure 92:
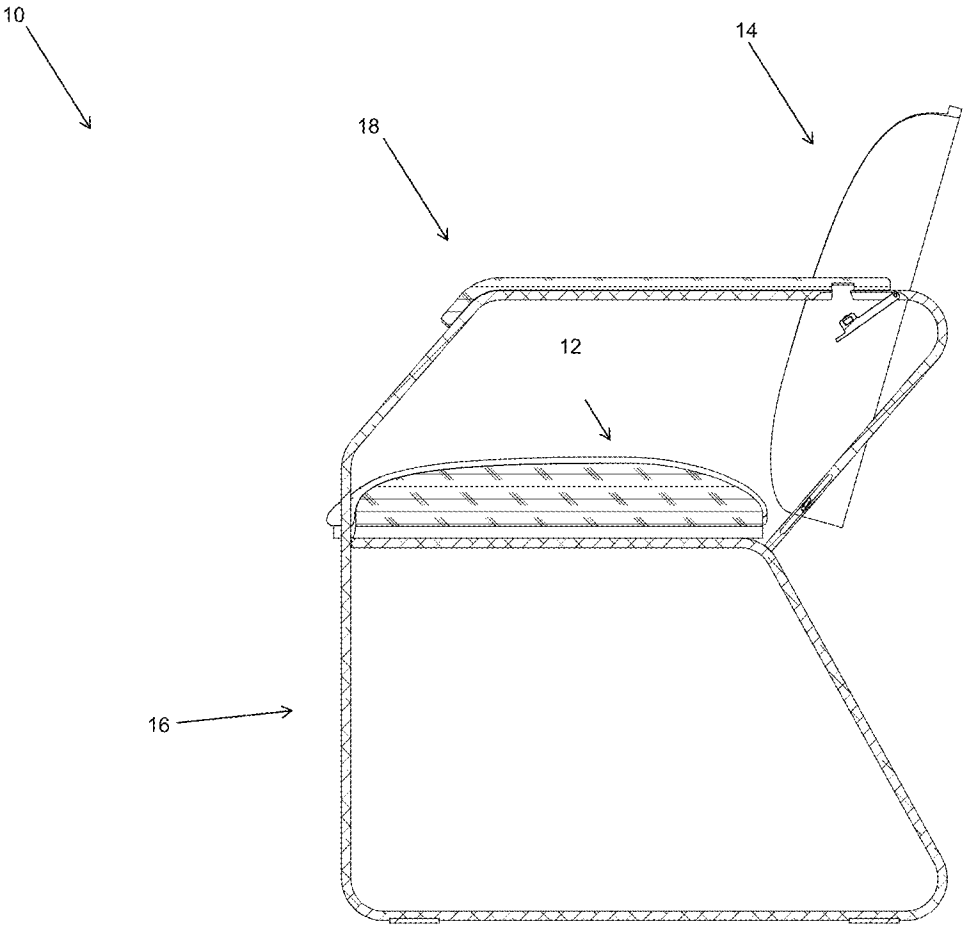
FIG. 92 is a left elevation view of the dining chair in accordance with one or more arrangements, the view showing the dining chair having a backrest, a seat, a frame, and arm covers. The view also showing the dining chair in a reclined position.
Figure 93:
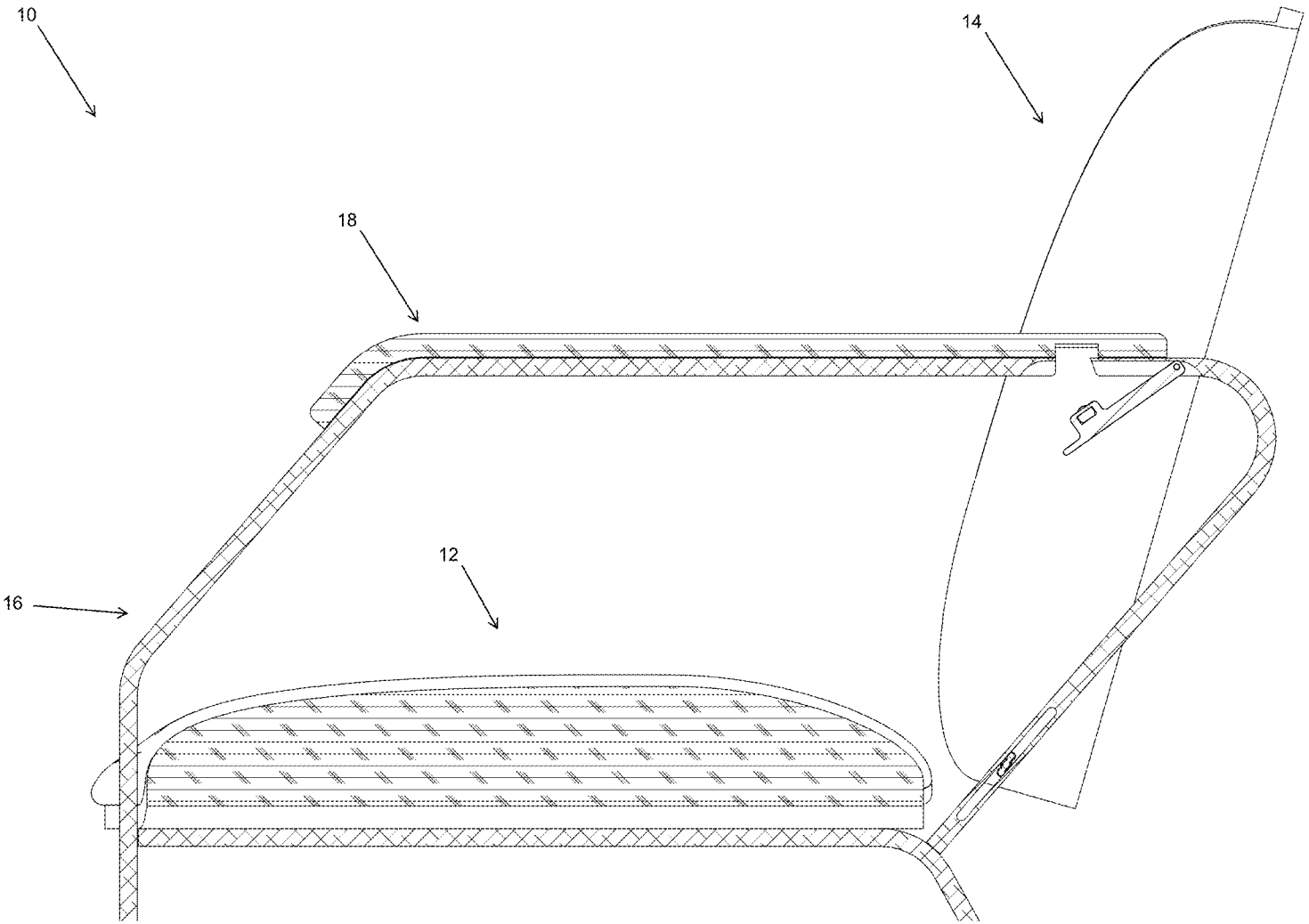
FIG. 93 is a left elevation view of the dining chair in accordance with one or more arrangements, the view showing the dining chair having a backrest, a seat, a frame, and arm covers. The view also showing the dining chair in a reclined position.
Figure 94:
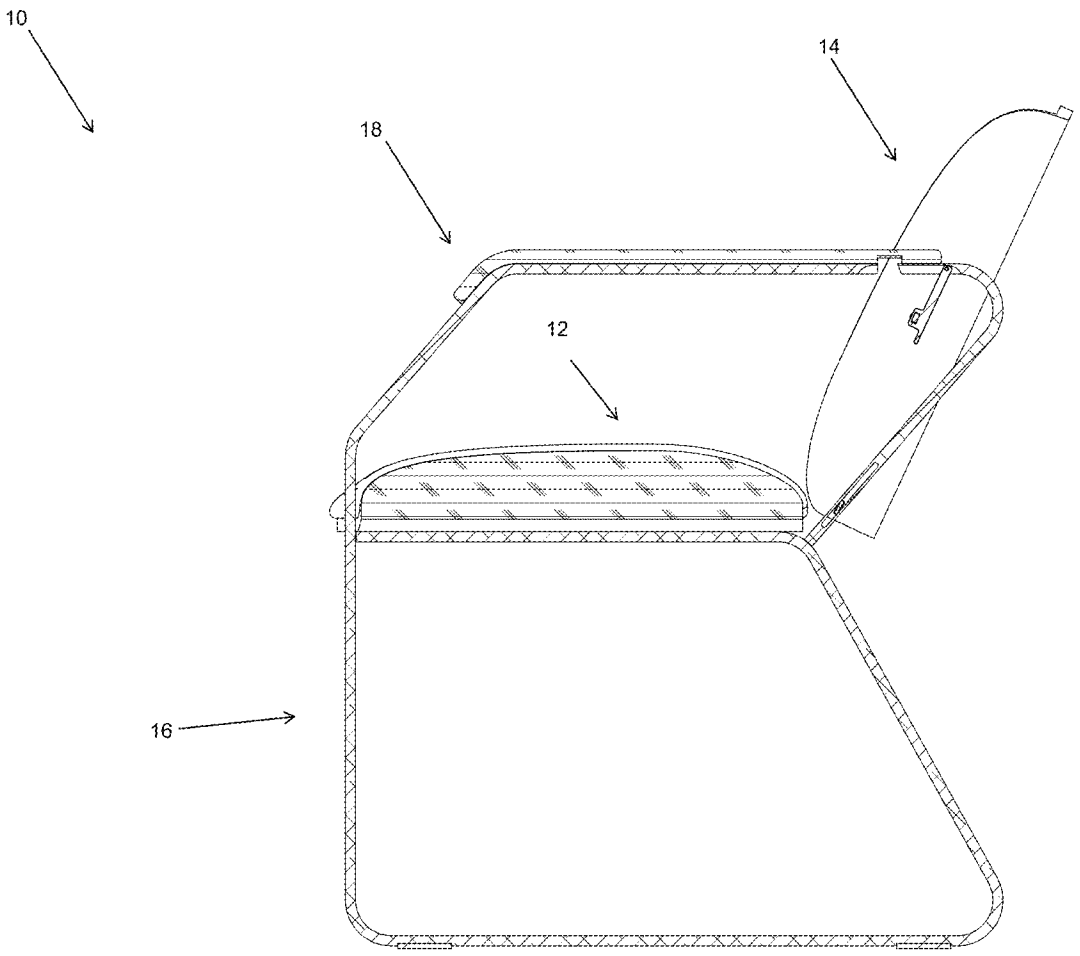
FIG. 94 is a left elevation view of the dining chair in accordance with one or more arrangements, the view showing the dining chair having a backrest, a seat, a frame, and arm covers. The view also showing the dining chair in a reclined position.
Figure 95:
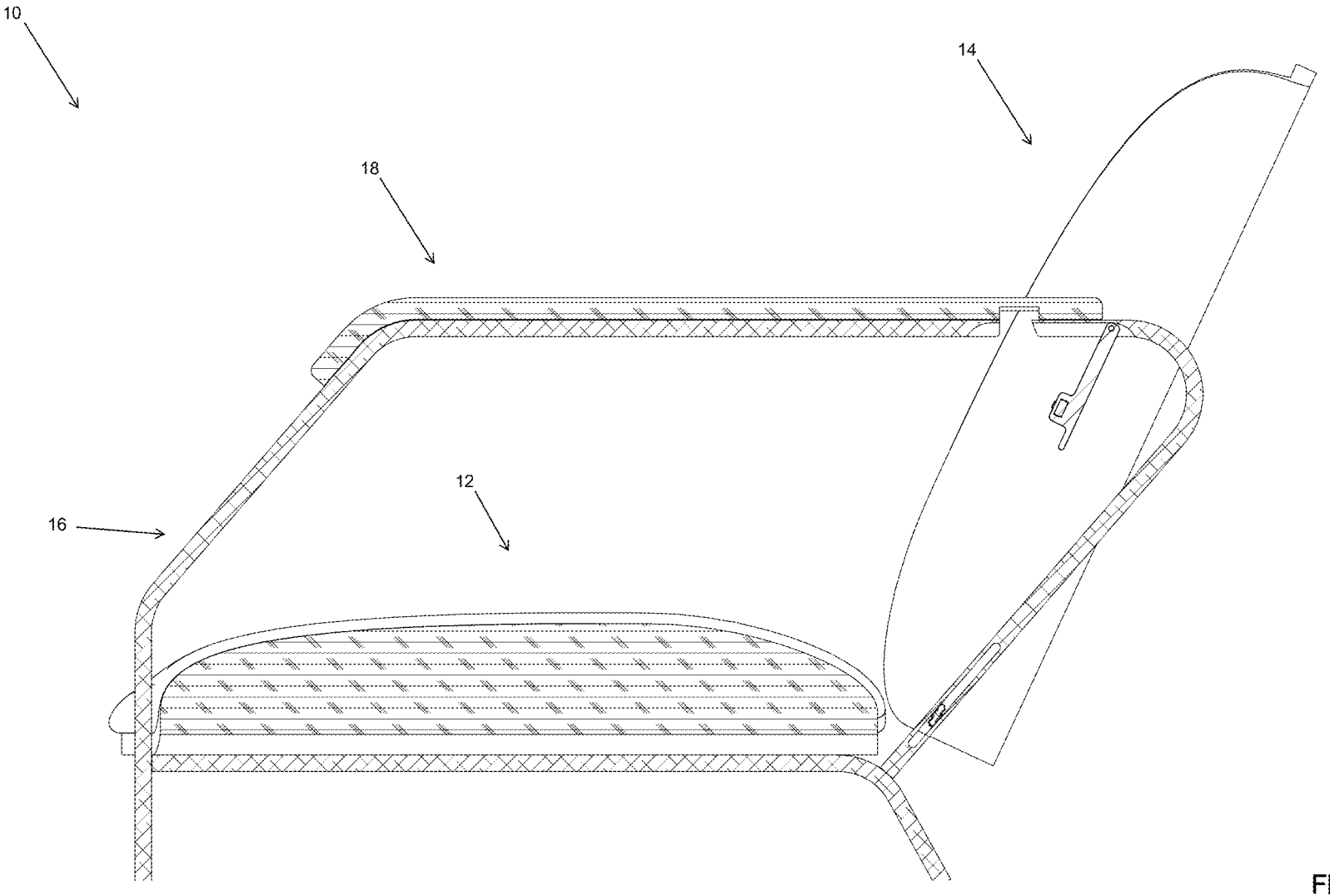
FIG. 95 is a left elevation view of the dining chair in accordance with one or more arrangements, the view showing the dining chair having a backrest, a seat, a frame, and arm covers. The view also showing the dining chair in a reclined position.
Figure 96:
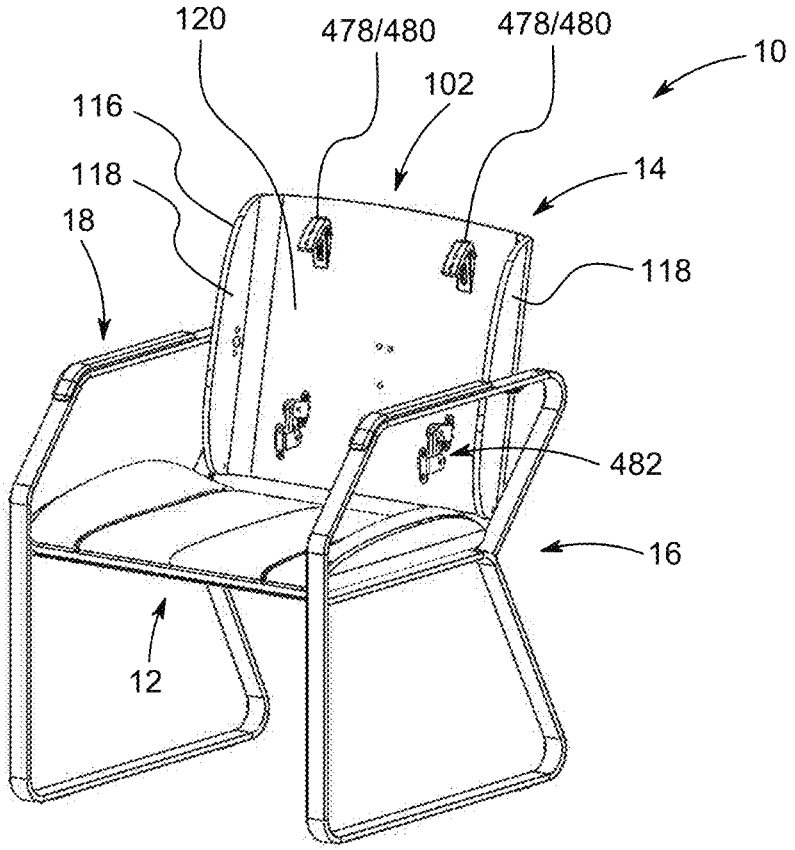
FIG. 96 is a front perspective view of the dining chair in accordance with one or more arrangements, the view showing the dining chair having a backrest, a seat, a frame, and arm covers; the view showing the dining chair having an access assembly with hook brackets and a hinge mechanism. The view also showing the dining chair in an upright position.
Figure 97:
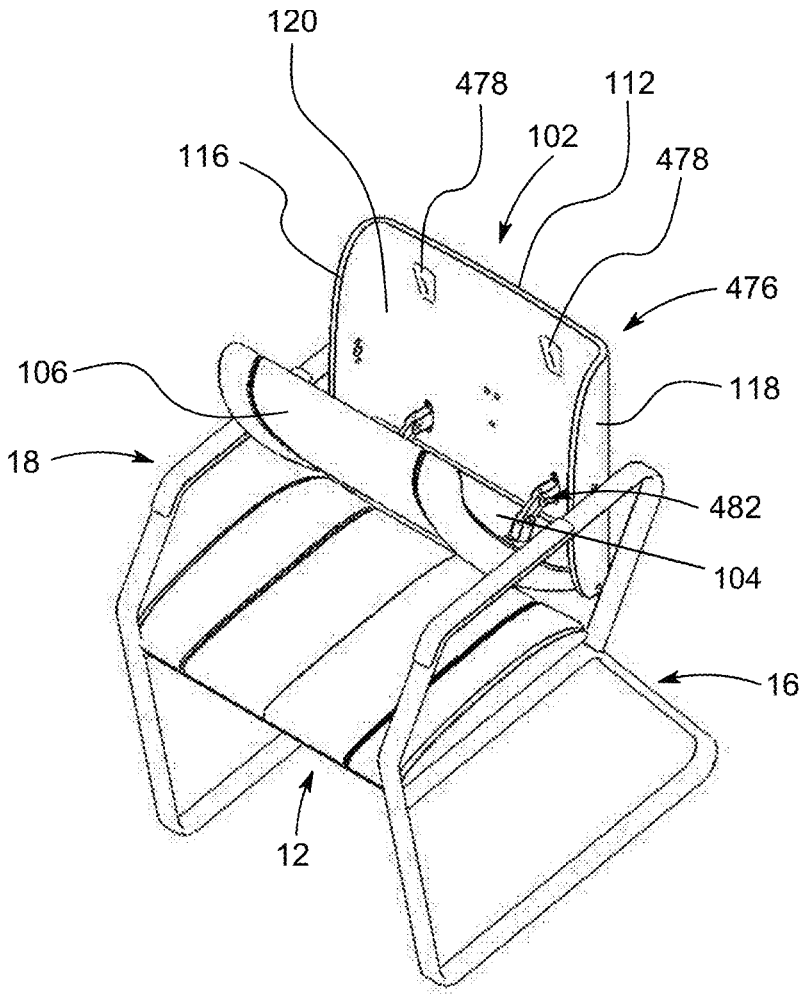
FIG. 97 is a front perspective view of the dining chair in accordance with one or more arrangements, the view showing the dining chair having a backrest, a seat, a frame, a cushion, and arm covers; the view showing the dining chair having an access assembly with a hinge mechanism connected to the cushion. The view also showing the dining chair in an upright position.
Figure 98:
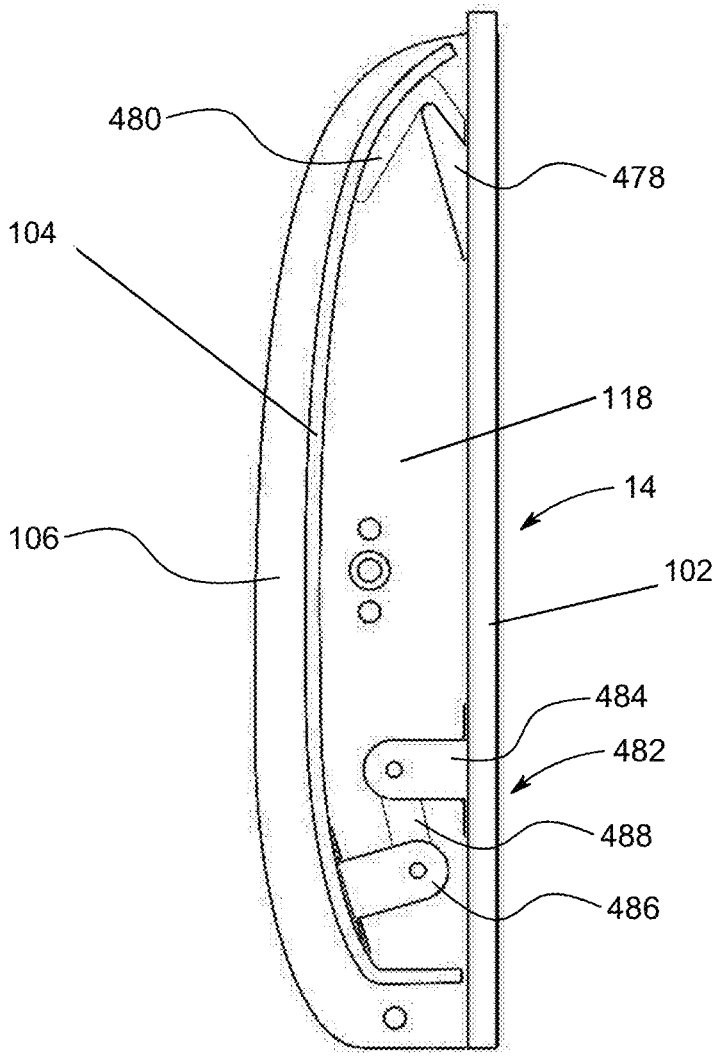
FIG. 98 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a closed position.
Figure 99:
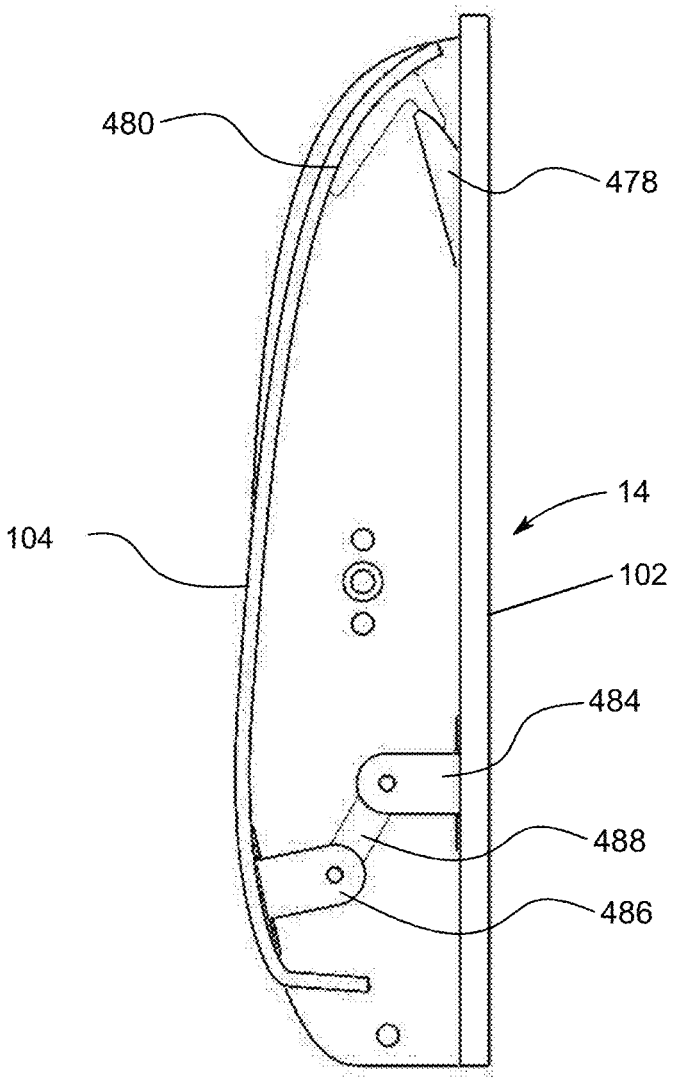
FIG. 99 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially closed position.
Figure 100:
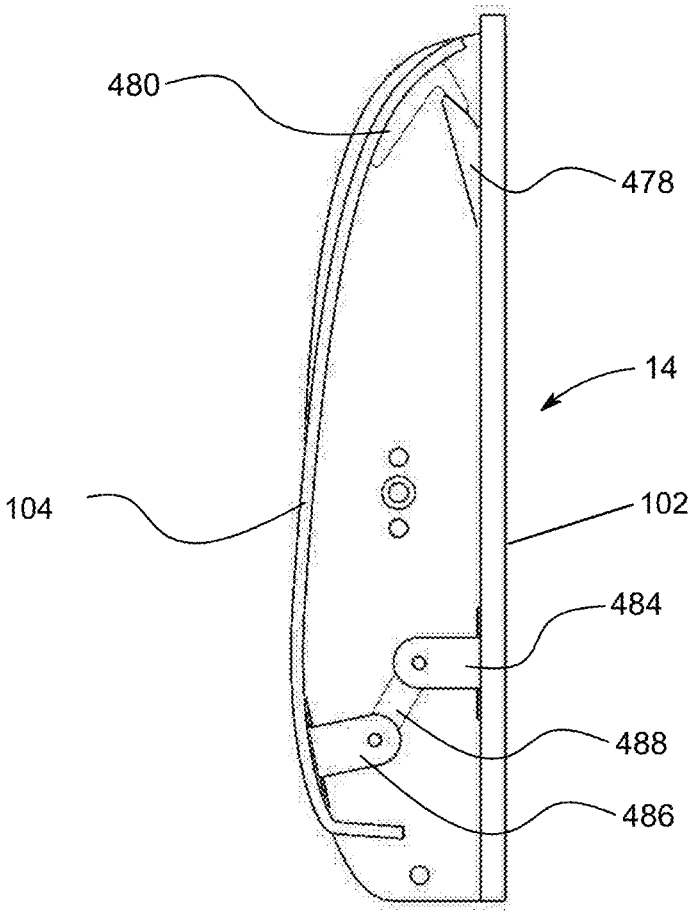
FIG. 100 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially open position.
Figure 101:
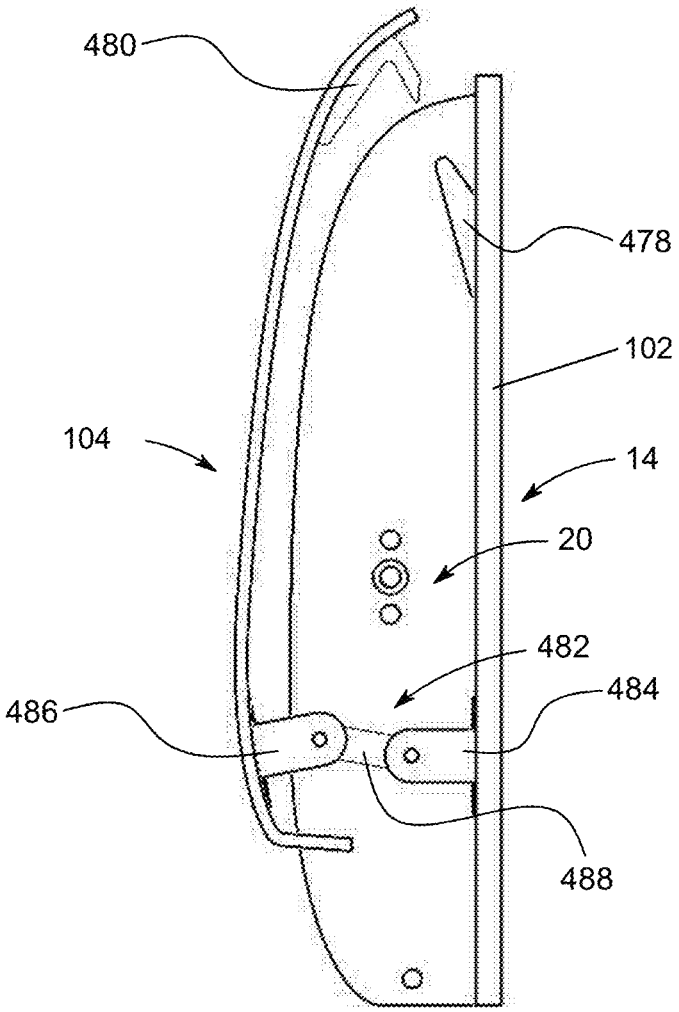
FIG. 101 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially open position.
Figure 102:
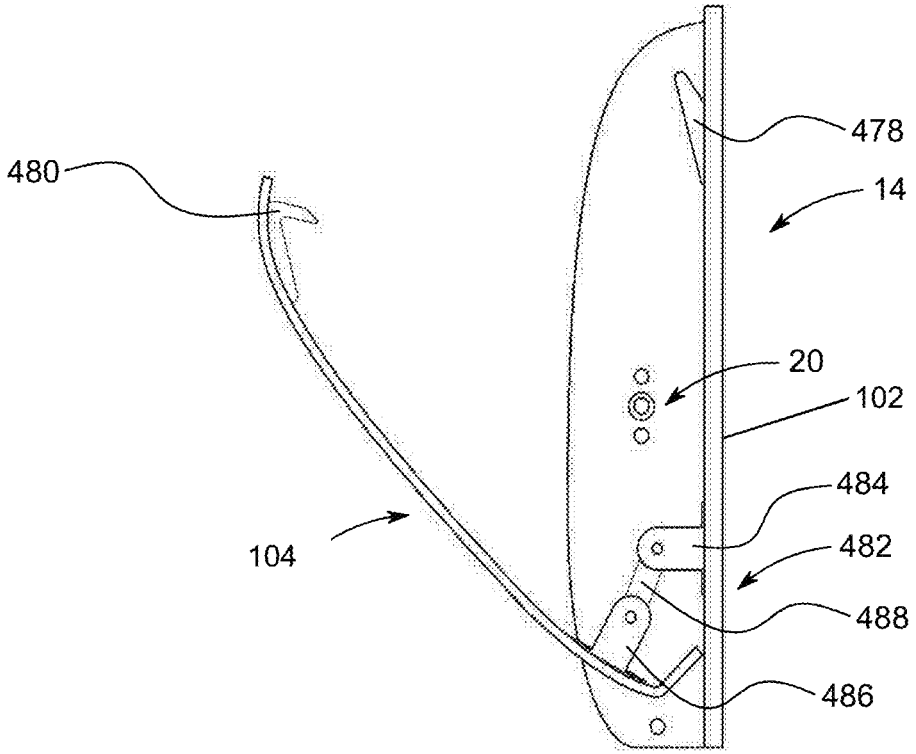
FIG. 102 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in an open position.
Figure 103:
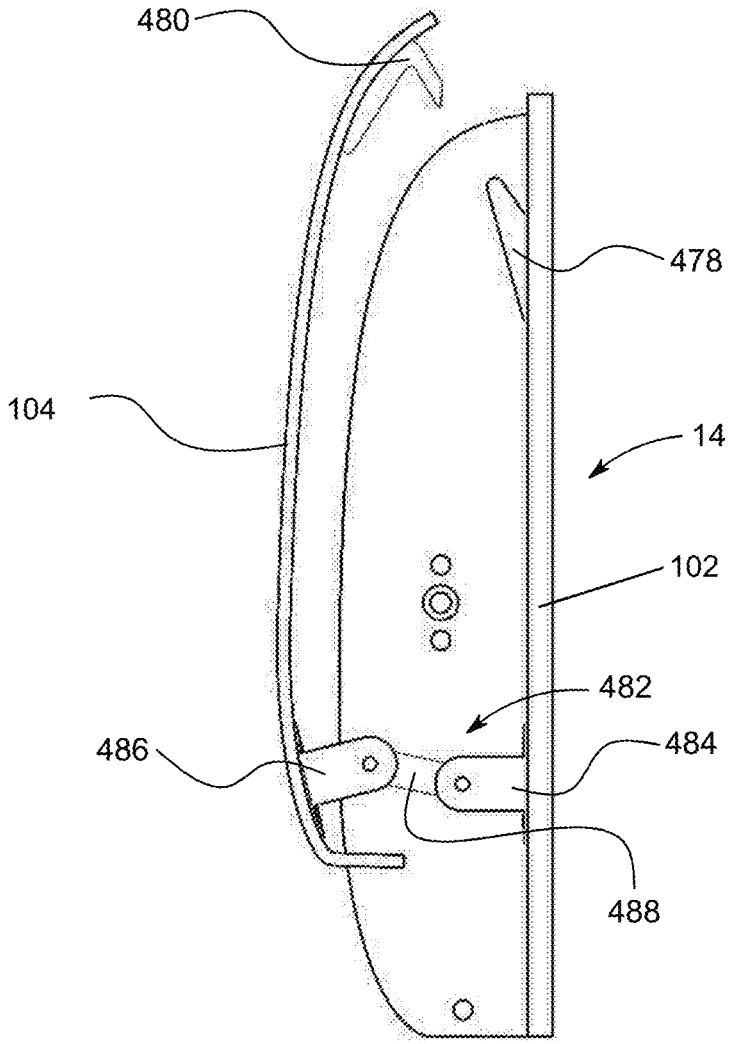
FIG. 103 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially open position.
Figure 104:
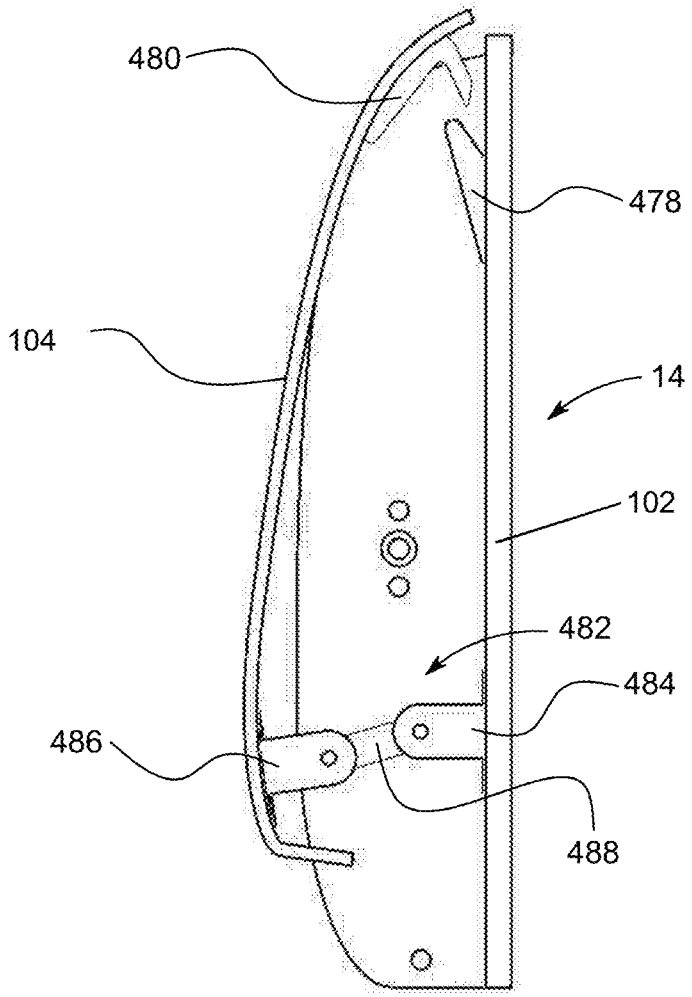
FIG. 104 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially open position.
Figure 105:
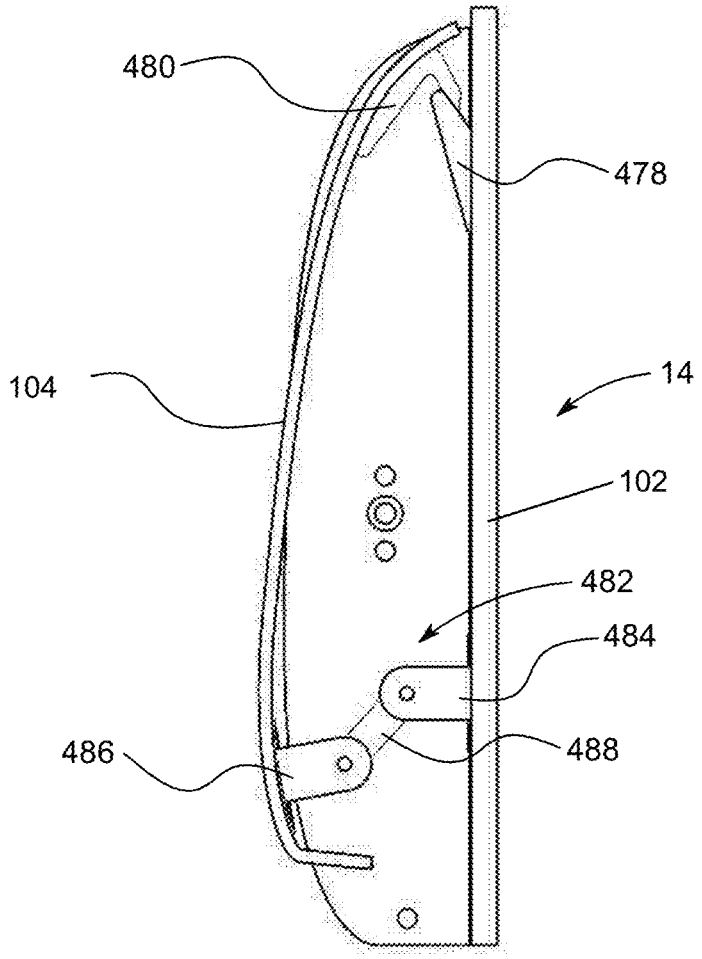
FIG. 105 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a partially closed position.
Figure 106:
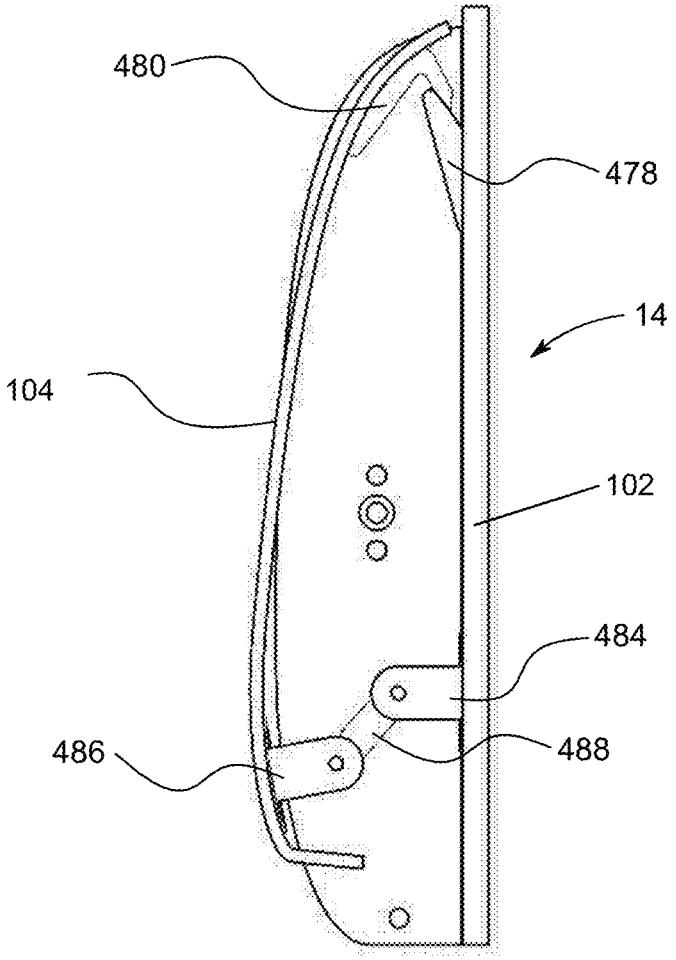
FIG. 106 is a side elevation section view of the dining chair in accordance with one or more arrangements, the view showing the dining chair having a backrest with a cushion. The view also showing an access assembly with a receiving bracket, a hook bracket, and a hinge mechanism. The view also showing the access assembly in a closed position.
Figure 107:
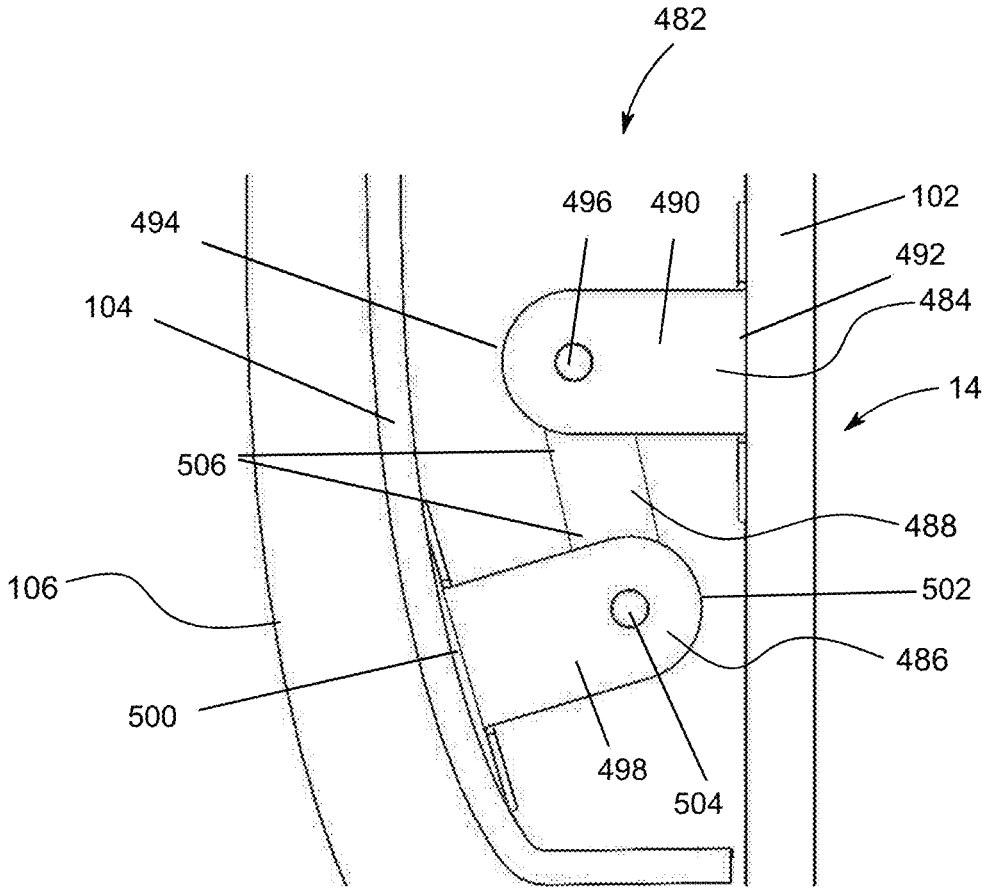
FIG. 107 is a section view of the dining chair in accordance with one or more arrangements, the view showing the hinge mechanism of the access assembly in a closed position.
Figure 108:
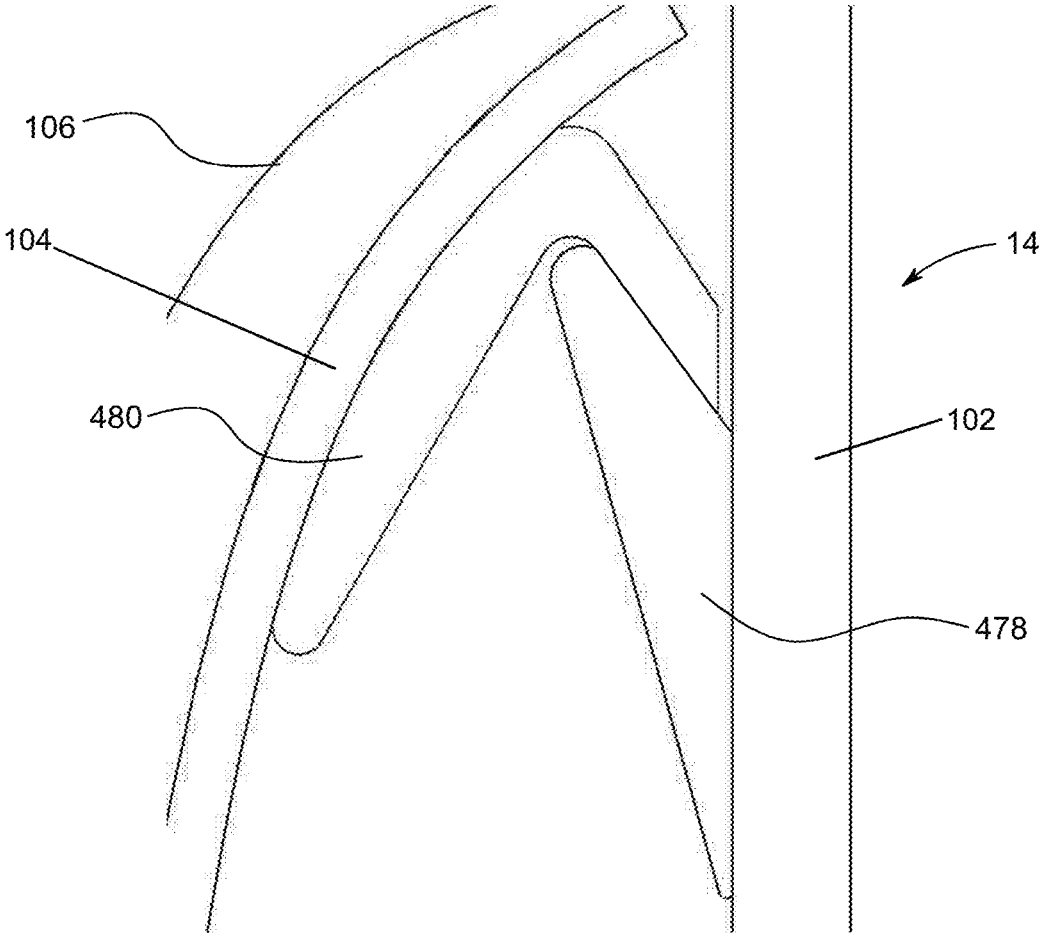
FIG. 108 is a section view of the dining chair in accordance with one or more arrangements, the view showing a hook bracket and receiving bracket of the access assembly in a closed position.
Figure 109:
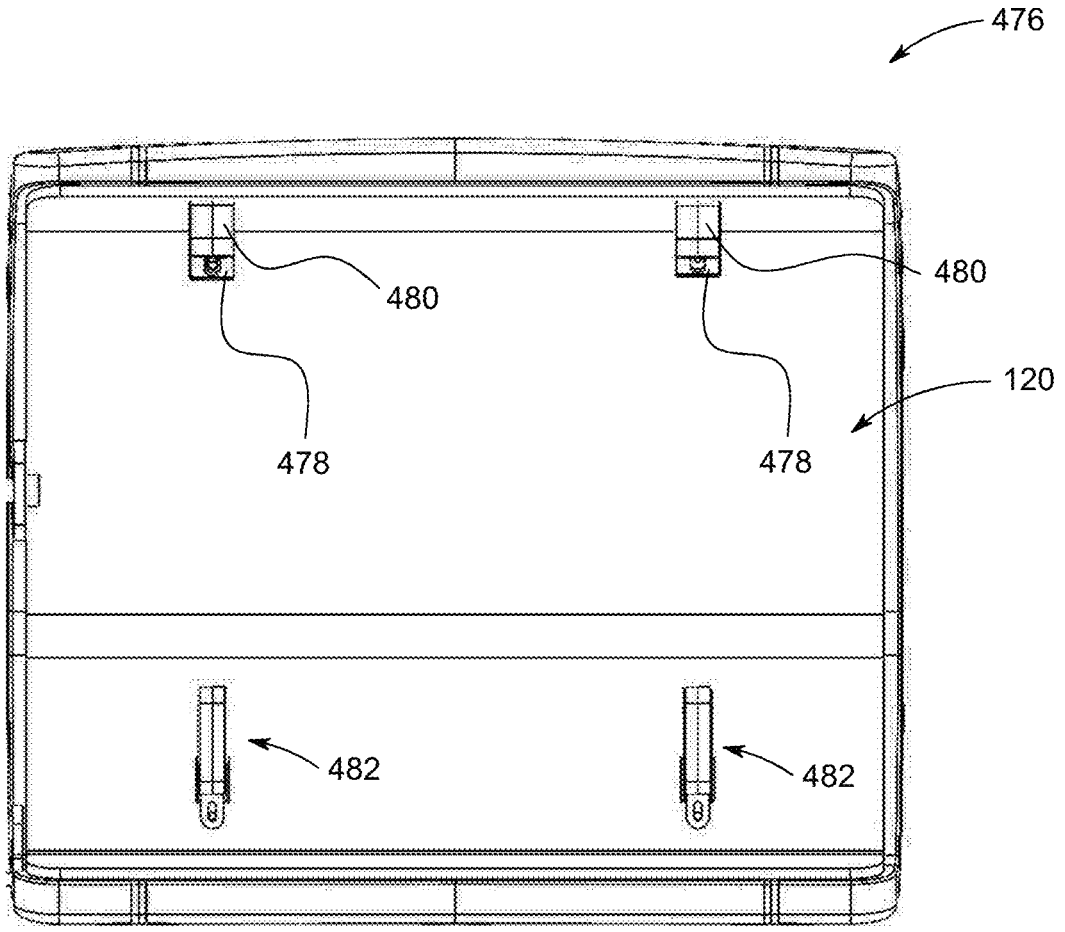
FIG. 109 is a front elevation view of the dining chair in accordance with one or more arrangements, the view showing the dining chair having a backrest with a front surface. The view also showing the position of the access assembly.
Figure 110:
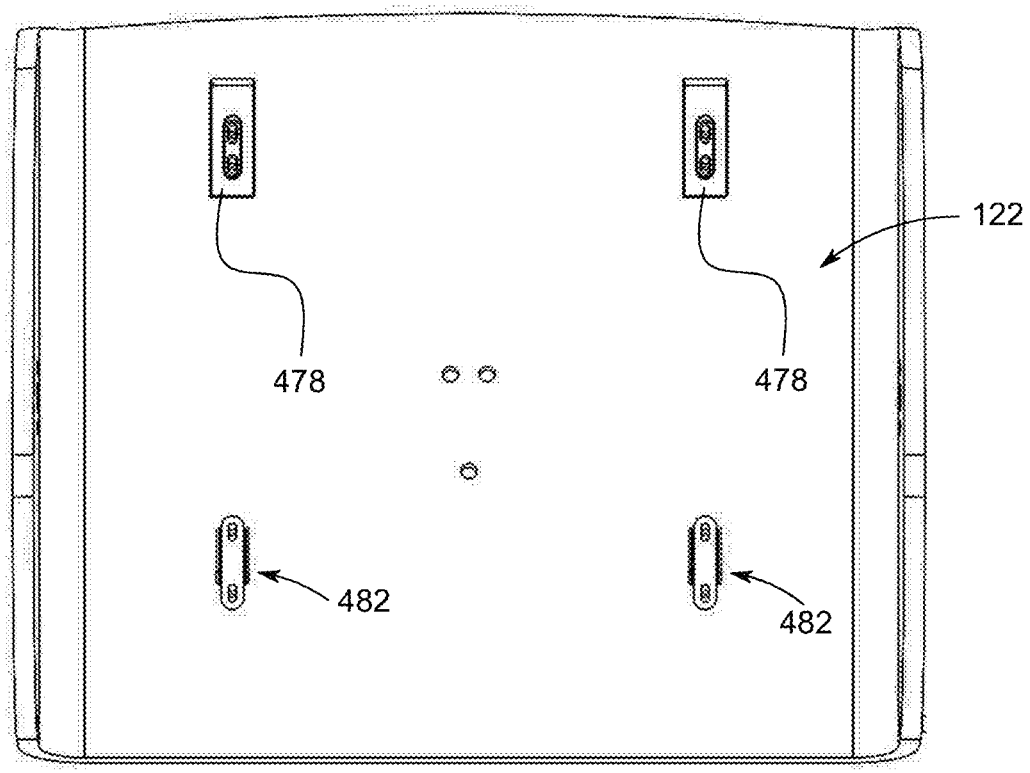
FIG. 110 is a back elevation view of the dining chair in accordance with one or more arrangements, the view showing the dining chair having a backrest with a rear surface. The view also showing the position of the access assembly.
Figure 111:
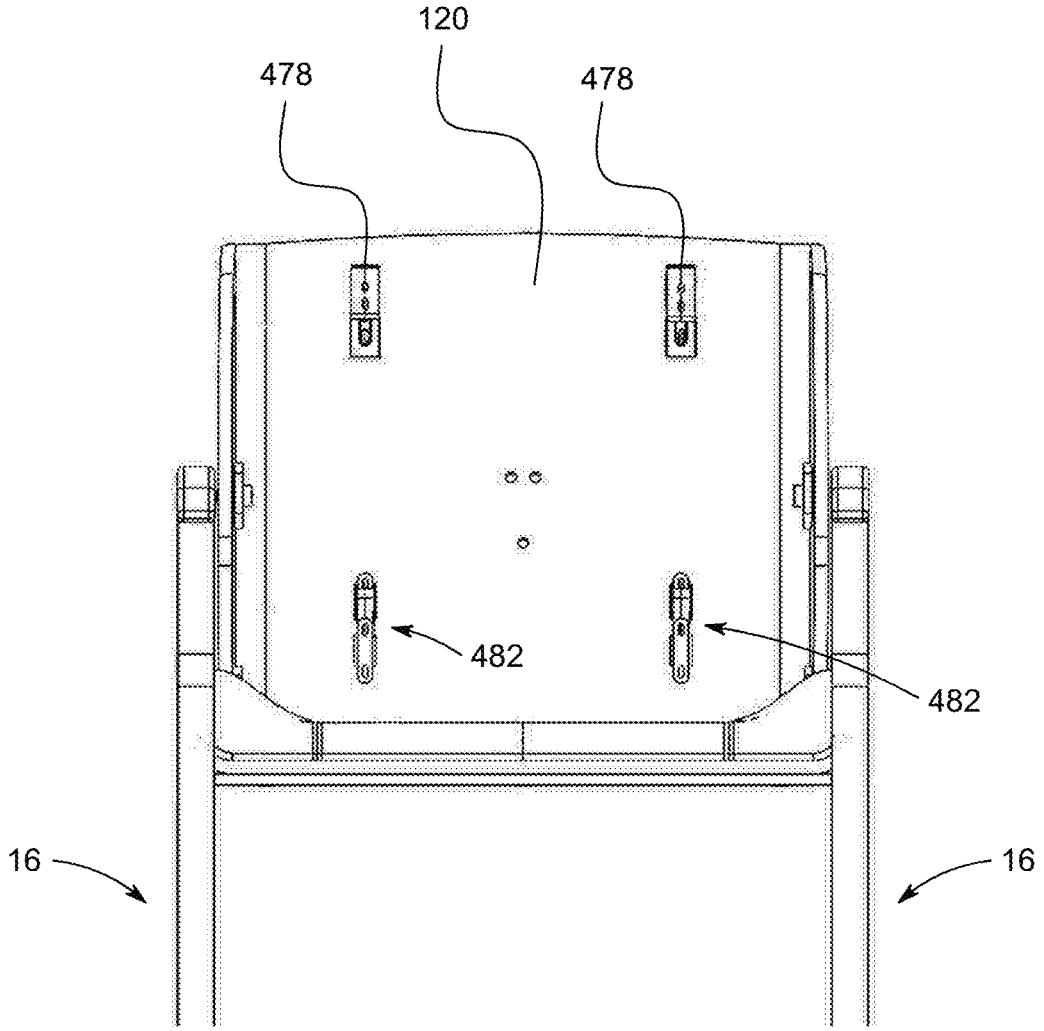
FIG. 111 is a front elevation view of the dining chair in accordance with one or more arrangements, the view showing the dining chair having a seat, a frame, and a backrest with a front surface. The view also showing the position of the access assembly.

With reference to FIGS. 71-95 an alternative arrangement of system 10 is presented. This alternative arrangement presented in FIGS. 71-95 is similar to the system 10 presented in FIGS. 1-70 and therefore unless specifically stated otherwise herein, the prior teaching and disclosure shown in FIGS. 1-70 applies equally to the alternative arrangement shown in FIGS. 71-95. That is, the arrangement shown in FIGS. 71-95 is configured to be used with the same or similar seat 12, backrest 14, arm covers 18, and reclining mechanism 20 and the like with the primary difference relating to frame 16 as is described herein.

Frame 16:

In the arrangement shown in FIGS. 71-95, as one example, frame 16 is formed of any suitable size, shape, and design and is configured to operably connect with and support seat 12, backrest 14, and reclining mechanism 20 of system 10 to provide seating for an occupant of system 10. In the arrangement shown, as one example, frame 16 is a chair frame formed of elongated bar stock and having a base section 170, a seat support section 172, and an arm support section 174, among other components.

Base Section 170:

Base Section 170 of frame 16 is formed of any suitable size, shape, and design and is configured to provide stable support of system 10 on a floor. In the arrangement shown, as one example, base section 170 includes front legs 180, lower front corners 182, side bars 184, lower rear corners 186, and rear legs 188, among other components.

In this example arrangement, front legs 180 have a generally elongated rectangular shape extending from upper ends 190, connected to seat support section 172, to lower ends 192 connected to lower front corners 182. In this example arrangement, lower front corners 182 have a generally elongated rectangular shape extending from lower ends 192 and curving rearward before connecting to front ends 198 of side bars 184. In this example arrangement, side bars 184 each have an elongated rectangular shape extending from front end 198, where side bars 184 are connected to lower front corner 182, to a rear end 200, where side bars 184 are connected to lower rear corner 186. In this example arrangement, lower rear corners 186 have a generally elongated rectangular shape extending from rear ends 200 of side bars 184 and curving upward before connecting to lower ends 206 of rear legs 188. In this example arrangement, rear legs 188 have an elongated rectangular shape extending from lower ends 206, where rear legs 188 are connected to lower rear corners 186, to upper ends 208, where rear legs 188 connect with seat support section 172. In this example arrangement, rear legs 188 extend forward at an angle as rear legs 188 extend from lower ends 206 to upper ends 208.

Seat Support Section 172:

Seat support section 172 of frame 16 is formed of any suitable size, shape, and design and is configured to support and facilitate connection of frame 16 with seat 12, while operably connecting arm support section 174 to base section 170. In the arrangement shown, as one example, seat support section 172 includes upper rear corners 214 and side bars 220, among other components.

In this example arrangement, upper rear corners 214 have a generally elongated rectangular shape extending from upper ends 208 of rear legs 188 and curving forward before connecting to rear ends 234 of side bars 220. In this example arrangement, side bars 220 each have an elongated rectangular shape extending from rear ends 234, where side bars 220 are connected to center corners 218, to a front end 236, where side bars 220 are connected to upper ends 190 of front legs 180.

Arm Support Section 174:

Arm support section 174 of frame 16 is formed of any suitable size, shape, and design and is configured to provide an arm rest for an occupant seated in seat 12 while operably connecting backrest 14 with frame 16. In the arrangement shown, arm support section 174 includes front vertical sections 238, lower front bends 240, front sloped sections 242, upper front bends 244, a pair of arms 246, rear bends 248, and rear sloped sections 252.

In this example arrangement, front vertical sections 238 have a generally elongated rectangular shape extending from a lower end 260 connected to upper ends 190 of front legs 180 to an upper end 262.

In this example arrangement, front sloped sections 242 each have a contoured elongated shape extending rearward at an angle from a lower end 256, where front sloped sections 242 connect to upper end 262 of front vertical section 238, to an upper end 258, where front sloped sections 242 connect to upper front bend 244.

In this example arrangement, front bends 244 have a generally elongated rectangular shape extending from upper end 258 of front sloped sections 242 and curving rearward before connecting to front end 264 of arms 246.

In this example arrangement, arms 246 each have an elongated rectangular shape extending from front end 264 to rear ends 266, where arms 246 are connected to rear bends 248.

In this example arrangement, arms 246 include holes 270 located proximate to rear ends 266 and extending sideways through arms 246 to facilitate connection with link 332 of upper guide assembly 302 of reclining mechanism 20.

In this example arrangement, arms 246 have recesses 450 in a bottom surface proximate to rear ends 266. Recesses 450 are formed of any suitable size, shape, and design and are configured to receive and conceal link 332 of upper guide assembly 302 when backrest 14 is moved to the upright position. In the arrangement shown, as one example implementation, recesses 450 in each arm 246 includes a first channel 452 extending upward from a bottom surface of arms 246 from a rearward end 454 to a forward end 456. In this example arrangement, recesses 450 in each arm 246 also include a second channel 458 extending from first channel 452 proximate to forward end 456 to an inner side edge of arm 246. The second channel 458 is configured to receive an end 338 of upper axle 330, where upper axle 330 connects with link 332, when backrest 14 is moved to the upright position. In this manner upper guide assembly 302 is concealed from view when backrest is not reclined, thereby giving system a more aesthetically pleasing appearance.

In this example arrangement, rear bends 248 connect arms 246 to rear sloped sections 252. In this example arrangement, rear bends 248 have a generally elongated rectangular shape extending from rear end 266 of arms 246 and curving downward and then forward before connecting to an upper end 276 of rear sloped section 252.

In this example arrangement, rear sloped sections 252 have an elongated rectangular shape extending from upper end 276 to a lower end 278, where rear sloped sections 252 connect with upper rear corners 214 of seat support section 172.

In this example arrangement, rear sloped sections 252 include a slotted track 224 positioned on an inner side of upper rear corners 214. As discussed in more detail with reference to reclining mechanism 20, slotted track 224 is configured to facilitate guiding a lower end of backrest 14 along a designated path when being moved from an upright position to a reclined position. In the example arrangement shown, slotted track 224 is configured to receive a guide member 314 operably connected to an end 316 of lower axle 310 within slotted track 224. Guide member 314 is formed of any suitable size, shape, and design, and is configured to operably hold and guide end 316 of lower axle 310 along slotted track 224 as backrest 14 is moved between reclined and upright positions. In the arrangement shown, guide member 314 is an elongated generally rectangular shaped member configured to be received and move smoothly within slotted track 224 with minimal binding. In the arrangement shown, guide member 314 is connected to end 316 of lower axle 310 by a fastener extending through a hole 318 and into end 316 of lower axle 310. However, the embodiments are not so limited. Rather, it is contemplated that in one or more arrangements guide member 314 may be connected to end 316 of lower axle 310 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Adjustable Restriction of Movement by Inserts 460:

In one or more arrangements, the range of movement of backrest may be restricted using inserts 460 (not shown). Inserts 460 are formed of any suitable size, shape, and design, and are configured to be inserted into and held within slotted track 224 to restrict the range of motion of guide member 314 within slotted track 224. As an illustrative example, in one or more arrangements, a user may insert an insert 460 into a lower end of slotted track 224 to restrict the distance that guide member 314 can travel downward, and thereby restrict the amount that backrest can be reclined. Conversely, as another example, in one or more arrangements, the user may insert an insert 460 into an upper end of slotted track 224 to restrict the distance that guide member 314 can travel upward, and thereby restrict the amount that backrest can be moved toward the fully upright position. In this manner, positioning and range of motion of backrest 14 may be customized to suit the preferences of a user.

Locking Upper Guide Assembly 302:

In one or more arrangements, upper guide assembly 302 of reclining mechanism 20 has link 332 positioned to move backrest 14 into a locked upright position when force is applied to a rear portion of backrest 14, where force is typically applied to backrest when a user is seated upright. In this example arrangement, link 332 of upper guide assembly 302 is configured to permit reclining mechanism 20 to be moved to the reclined position when force is applied to an upper portion of backrest 14, where force is typically applied o backrest when a user leans backward while seated.

In one or more arrangements, upper guide assembly 302 of reclining mechanism 20 has link 332 configured to form an over-center latch that holds backrest 14 in the upward position when an occupant leans backward into backrest 14. In one arrangement shown, upper axle 330, where forward end of link 332 is pivotally connected to backrest 14, is positioned higher than holes 270, where rearward end of link 332 is pivotally connected to in arms 246 when backrest 14 is in the upright position. In this position, when an occupant leans backward into backrest 14, force is placed on link 332 to push the forward end of link 332 and upper axle 330 upward into recess 450 in arms 350. In this position, link 332 of upper guide assembly 302 forms an over-center latch that prevents backrest 14 from reclining.

To recline backrest 14, user may shift backrest 14 somewhat downward to a position where upper axle 330 is positioned lower than holes 270, where the rearward end of link 332 is pivotally connected to in arms 246. When an occupant leans backward with backrest 14 in this position, upper guide assembly 302 of reclining mechanism 20 guides an upper edge 112/124 of backrest 14 downward and rearward while lower guide assembly 300 guides lower edge 114/126 of backrest 14 downward and forward, as previously described.

In one or more arrangements shown, components of frame 16 are described as separate components and/or sections that are connected together. However, the embodiments are not so limited. Rather, it is contemplated that, in one or more arrangements, multiple portions of frame 16 may be formed as a unitary piece, for example, formed by bending a single piece of stock.

ALTERNATIVE ARRANGEMENT

With reference to FIGS. 96-111 an alternative arrangement of system 10 is presented. This alternative arrangement presented in FIGS. 96-111 is similar to the system 10 presented in FIGS. 71-95 and therefore unless specifically stated otherwise herein, the prior teaching and disclosure shown in FIGS. 71-95 applies equally to the alternative arrangement shown in FIGS.

96-111. That is, the arrangement shown in FIGS. 96-111 is configured to be used with the same or similar seat 12, backrest 14, arm covers 18, and reclining mechanism 20 and the like with the primary difference relating to the connection between the front support member 104 and rear support member 102 of backrest 14 as is described herein.

Access Assembly 476:

In one or more arrangements, backrest includes an access assembly 476. Access assembly 476 is formed of any suitable size, shape, and design and is configured to facilitate disconnection between front support member 104 and rear support member 102 of backrest 14 and thereby provide access to counterbalance assembly 304 of backrest 14. In the arrangement shown, as one example, access assembly 476 is configured to separate front support member 104 and cushion 106 from backrest 14 by disengaging hook bracket 480 from receiving bracket 478 and extending hinge mechanism 482 to an extended position. In the arrangement shown, as one example, access assembly 476 includes one or more hook brackets 480, receiving brackets 478, and hinge mechanisms 482.

Hook Bracket 480:

Hook bracket 480 is formed of any suitable size, shape, and design and is configured to connect with a receiving bracket 478 of backrest 14 when cushion 106 and front support member 104 are moved closer to backrest 14 and access assembly 476 is in a closed position. In one or more arrangements shown, as one example, hook bracket 480 has an elongated hook shape and is formed of a metallic material such as steel, titanium, or nickel. However, the hook bracket 480 may also be formed of any other metallic material or non-metallic material that is capable of forming the hook shape. In this example arrangement, the hook of hook bracket 480 extends away from front support member 104 towards backrest 14 and connects with receiving bracket 478 located on backrest 14. In some various arrangements, hook bracket 480 may be connected to front support member 104 using various methods or means that provides a secure connection including, but not limited to, adhesive, glue, screws, bolts, clamps, pins, rivets, welding, snap connectors, friction fit connectors, chemical bonding, and/or any other process or means of secure connection.

Receiving Bracket 478:

Receiving bracket 478 is formed of any suitable size, shape, and design and is configured to connect with a hook bracket 480 of front support member 104 when front support member 104 is moved closer to backrest 14 and access assembly 476 is in a closed position. In one or more arrangements shown, as one example, receiving bracket 478 extends away from backrest 14 and has a shape which compliments the hook shape of hook bracket 480. In one or more arrangements, receiving bracket 478 is formed of a metallic material such as steel, titanium, or nickel. However, the receiving bracket 478 may additionally or alternatively be formed of any other metallic material or non-metallic material that is capable of connecting to hook bracket 480 securely. In this example arrangement, receiving bracket 478 is connected to the front surface 120 of backrest 14 using any method or means that provides a secure connection including, but not limited to, adhesive, glue, screws, bolts, clamps, pins, rivets, welding, snap connectors, friction fit connectors, chemical bonding, and/or any other process or means of secure connection. In this example arrangement, the receiving end of the receiving bracket 478 extends away from the front surface 120 of backrest 14 towards front support member 104 and connects with hook bracket 480 located on front support member 104.

Hinge Mechanism 482:

Hinge Mechanism 482 is formed of any suitable size, shape, and design and is configured to allow access assembly 476 to move between an open and closed position by moving cushion 106. In one or more arrangements shown, as one example, hinge mechanism 482 is a multi-axial hinge having a first bracket 484, a second bracket 486, and a link 488 pivotally connected between the first bracket 484 and the second bracket 486. However, the embodiments are not so limited. Rather, it is contemplated that hinge mechanism 482 may be implemented using any various methods or means for providing a hinged connection known in the art.

In one or more arrangements shown, as one example, the components of hinge mechanism 482 are formed of a metallic material such as steel, titanium, or nickel. However, the components of hinge mechanism 482 may additionally or alternatively be formed of any other metallic material or non-metallic material that is capable of moving front support member 104 between an open and closed position.

First Bracket 484:

In this example arrangement, hinge mechanism 482 includes a first bracket 484. First bracket 484 is formed of any suitable size, shape, and design and is configured to operably connect to rear support member 102 of backrest 14 and facilitate hinged connection with link 488. In the arrangement shown, as one example, first bracket 484 has a pair of generally parallel arms 490 that extend forward from a rearward end 492, where first bracket 484 is operably connected to the interior side of rear support member 102, to a forward end 494, where first bracket 484 is pivotally connected with link 488. In this example arrangement, an end of link 488 is positioned between forward end 494 of arms 490, where arms 490 are pivotally connected with link 488.

In the arrangement shown, as one example, arms 490 are pivotally connected with link 488 by fasteners 496 that extend through holes in arms 490 and an end of link 488. However, the arrangements are not so limited. Rather, it is contemplated that arms 490 may be pivotally connected with link 488 using various methods and/or means including but not limited to, for example, fasteners, axles, bearings, hinges, joints, and/or any other method or mean for providing a hinged connection.

Similarly, it is contemplated that, in some various arrangements, first bracket 484 may be operably connected to backrest 14 using various methods or means that provide a secure connection including, but not limited to, adhesive, glue, fasteners (e.g., screws, bolts, clamps, pins, rivets, and the like), welding, snap connectors, friction fit connectors, chemical bonding, and/or any other method or means of secure connection.

Second Bracket 486:

In this example arrangement, hinge mechanism 482 also includes a second bracket 486. Second bracket 484 is formed of any suitable size, shape, and design and is configured to operably connect to front support member 104 of backrest 14 and facilitate hinged connection with link 488. In the arrangement shown, as one example, second bracket 486 has a pair of generally parallel arms 498 that extend rearward from a forward end 502, where second bracket 486 is operably connected to the interior side of front support member 104, to a rearward end 500, where second bracket 486 is pivotally connected with link 488. In this example arrangement, an end of link 488 is positioned between rearward ends 500 of arms 498 of second bracket 486, where arms 498 are pivotally connected with link 488.

In the arrangement shown, as one example, arms 498 are pivotally connected with link 488 by fasteners 504 that extend through holes in arms 498 and an end of link 488. However, the arrangements are not so limited. Rather, it is contemplated that arms 498 may be pivotally connected with link 488 using various methods and/or means including but not limited to, for example, fasteners, axles, bearings, hinges, joints, and/or any other method or mean for providing a hinged connection.

Similarly, it is contemplated that, in some various arrangements, second bracket 486 may be operably connected to front support member 104 using various method or means that provides a secure connection including, but not limited to, adhesive, glue, fasteners (e.g., screws, bolts, clamps, pins, rivets, and the like), welding, snap connectors, friction fit connectors, chemical bonding, and/or any other method or means of secure connection.

Link 488:

In this example arrangement, hinge mechanism 482 also includes a link 488. Link 488 is formed of any suitable size, shape, and design and is configured to operably connect to both the first bracket 484 and the second bracket 486. In the arrangement shown, as one example, link 488 has opposing ends 506 and extends between the forward end 494 of first bracket 484 and the forward end 502 of second bracket 486. In this example arrangement, opposing ends 506 of link 488 are positioned between forward end 494 of first bracket 484 and forward end 502 of second bracket 486, where each forward end is pivotally connected with link 488.

In the arrangement shown, as one example, the forward end 494 of first bracket 484 and forward end 502 of second bracket 486 are pivotally connected with link 488 by fasteners 496 and fasteners 504 that extend through holes in arms 490 of first bracket 484, arms 498 of second bracket 486, and opposing ends 506 of link 488. However, the arrangements are not so limited. Rather, it is contemplated that the forward end 494 of first bracket 484 and forward end 502 of second bracket 486 may be pivotally connected with link 488 using various methods and/or means including but not limited to, for example, fasteners, axles, bearings, hinges, joints, and/or any other method or mean for providing a hinged connection. Link 488 allows first bracket 484 and second bracket 486 to move and pivot around one another using link 488 when access assembly 476 is moved between an open and closed position.

In Operation:

In operation, a user may want to access the counterbalance assembly 304 of system 10 for any reason including but not limited to, for example, repairs or replacement of parts and/or to adjust force applied by counterbalance assembly 304. In one or more arrangements, access assembly 476 has hinge mechanism 482 positioned to move front support member 104 into an open position when force is applied to a bottom portion of cushion 106 and front support member 104.

In one or more arrangements, access assembly 476 has hinge mechanism 482 configured to hold front support member 104 in the closed position when an occupant is seated in the seating system 10. In one arrangement shown, the forward end 494 of first bracket 484 extends over the forward end 502 of second bracket 486 when front support member 104 is in a closed position. In this position, when a user applies forward force to a bottom portion of front support member 104, the forward end 502 of second bracket 486 is moved away from the forward end 494 of first bracket 484, towards front support member 104, thereby moving front support member 104 away from rear support member 102. In this position, a user may then move front support member 104 upward to disengage hook bracket 480 from receiving bracket 478 and permit upper edge 124 of front support member 104 to be moved forward and downward away from rear support member 102 to an open position. In this open position, the counterbalance assembly 304 may be accessed by a user.

To close front support member 104, a user may move front support member 104 towards rear support member 102. In this position, the user may engage hook bracket 480 and receiving bracket 478 by lifting the hook portion of hook bracket 480 over receiving bracket 478. In this position, the user may apply force to a lower edge 126 of front support member 104 to move front support member 104 towards rear support member 102 and into a closed position.

As lower edge 126 of front support member 104 is moved rearward, hinged connections of link 488 with first bracket 484 and second bracket 486 causes front support member 104 to be pulled downward, thereby tightening the engagement between receiving brackets 478 and hook brackets 480. Link continues to increase downward force applied to front support member 104 as lower edge 126 of front support member 104 is moved rearward until front support member is oriented vertically. As lower edge 126 of front support member 104 is moved further rearward closer to rear support member 102, link moves front support member 104 upward slightly, reducing the downward force applied to front support member 104. Due to the reduction in downward force, front support member 104 is held in this rearward closed position until a user purposefully applies forward force to move lower edge 126 of front support member 104 forward. In this manner, link 488, first bracket 484, and second bracket 486 operate as an over-center lever to hold lower edge 126 of front support member 104 in a rearward closed position, where front support member 104 is securely attached to rear support member 102.

From the above discussion it will be appreciated that the described system improves upon the state of the art. Specifically, one or more embodiments provide an improved seating system: that has a compact reclining mechanism concealed within the chair that is configured to support an occupant in upright and reclined positions; that is strong, robust, and durable; that is comfortable; that is easy and intuitive to use; that is easy to manufacture; that is cost effective; that is high quality; that has a long useful life; and/or that is aesthetically pleasing among various other features and/or advantages.

It will be appreciated by those skilled in the art that other various modifications could be made to the device without parting from the spirit and scope of this disclosure. All such modifications and changes fall within the scope of the claims and are intended to be covered thereby.

What is claimed:

1. A seating system, comprising:
a frame;
a seat;
the seat operably connected to the frame;
a backrest;
the backrest operably connected to the frame;
the backrest having a hollow interior;
a counterbalance assembly;
the counterbalance assembly positioned within the hollow interior of the backrest;
wherein the backrest is configured to move between an upright position and a reclined position relative to the frame;
the counterbalance assembly having at least one torsion spring configured to provide a counterbalance force to the backrest;
wherein the tension of the at least one torsion spring is adjustable;
a reclining mechanism;
wherein the backrest is operably connected to the frame by the reclining mechanism;
wherein the reclining mechanism includes an axle that extends through the backrest from side to side;
wherein opposing ends of the axle are configured to move along tracks within the frame.

2. The system of claim 1,
wherein the reclining mechanism includes a pair of rollers connected to opposite ends of the axle; wherein the pair of rollers are configured to roll within the frame.

3. The system of claim 1, wherein the at least one torsion spring is configured to move the backrest to the upright position in absence of an opposing force.

4. The system of claim 1, wherein the backrest includes an access assembly
configured to provide access to the counterbalance assembly.

5. The system of claim 1, wherein
the reclining mechanism includes an upper axle that extends across the backrest from side to side;
wherein the reclining mechanism includes a pair of links connected to opposite sides of the upper axle;
wherein the pair of links are operably connected to the frame.

6. The system of claim 1, wherein
the reclining mechanism includes an upper axle that extends across the backrest from side to side;
wherein the reclining mechanism includes a pair of links connected to opposite sides of the upper axle;
wherein the pair of links are operably connected to the frame;
wherein the counterbalance assembly is configured to rotate the pair of links.

7. A seating system, comprising:
a frame;
a seat;
the seat operably connected to the frame;
a backrest;
a reclining mechanism;
wherein the reclining mechanism operably connects the backrest to the frame;
wherein the reclining mechanism is configured to move the backrest between an upright position and a reclined position relative to the frame;
a counterbalance assembly;
wherein the counterbalance assembly is configured to provide a counterbalance force to the backrest to move the backrest to the upright position in absence of an opposing force;
wherein the counterbalance force provided by the counterbalance assembly is adjustable;
wherein the reclining mechanism includes an axle that extends through the backrest from side to side;
wherein opposing ends of the axle are configured to move along tracks within the frame.

8. A seating system, comprising:
a frame;
a seat;
the seat operably connected to the frame;
a backrest;
a reclining mechanism;
wherein the reclining mechanism operably connects the backrest to the frame;
wherein the reclining mechanism is configured to move the backrest between an upright position and a reclined position relative to the frame;
a counterbalance assembly;
wherein the counterbalance assembly is configured to provide a counterbalance force to the backrest to move the backrest to the upright position in absence of an opposing force;
wherein the reclining mechanism includes a lower guide assembly;

wherein the lower guide assembly extends through the backrest from side to side;

wherein opposing ends of the lower guide assembly are configured to move along tracks within the frame;

wherein the lower guide assembly is configured to move a lower end of the backrest upward and rearward when the backrest is moved to the upright position;

wherein the lower guide assembly is configured to move the lower end of the backrest downward and forward when the backrest is moved to the reclined position.

9. A seating system, comprising:

a frame;

a seat;

the seat operably connected to the frame;

a backrest;

the backrest operably connected to the frame;

the backrest having a hollow interior;

a counterbalance assembly;

the counterbalance assembly positioned within the hollow interior of the backrest;

wherein the backrest is configured to move between an upright position and a reclined position relative to the frame;

the counterbalance assembly having at least one torsion spring configured to provide a counterbalance force to the backrest;

wherein the backrest is operably connected to the frame by a reclining mechanism;

wherein the reclining mechanism includes a lower axle that extends through the backrest from side to side;

wherein opposing ends of the lower axle are configured to move along slotted tracks within the frame.

10. A seating system, comprising:

a frame;

a seat;

the seat operably connected to the frame;

a backrest;

a reclining mechanism;

wherein the reclining mechanism operably connects the backrest to the frame;

wherein the reclining mechanism is configured to move the backrest between an upright position and a reclined position relative to the frame;

a counterbalance assembly;

wherein the counterbalance assembly is configured to provide a counterbalance force to the backrest to move the backrest to the upright position in absence of an opposing force;

wherein the backrest has a front support member and a rear support member;

the front support member and the rear support member forming a hollow interior when connected together;

wherein the counterbalance assembly is positioned within the hollow interior;

wherein the front support member of the backrest is removable from the rear support member to provide access to the counterbalance assembly;

wherein the reclining mechanism includes a lower axle that extends through the backrest from side to side;

wherein opposing ends of the lower axle are configured to move along slotted tracks within the frame.

11. A seating system, comprising:

a frame;

a seat;

the seat operably connected to the frame;

a backrest;

the backrest operably connected to the frame;

the backrest having a hollow interior;

a counterbalance assembly;

the counterbalance assembly positioned within the hollow interior of the backrest;

wherein the backrest is configured to move between an upright position and a reclined position relative to the frame;

wherein the counterbalance assembly having at least one torsion spring configured to provide a counterbalance force to the backrest;

wherein the tension of the at least one torsion spring is adjustable;

wherein the backrest is operably connected to the frame by a reclining mechanism;

wherein the reclining mechanism includes a lower axle that extends through the backrest from side to side;

wherein ends of the lower axle are configured to move along a slotted track within the frame.

12. A seating system, comprising:

a frame;

a seat;

the seat operably connected to the frame;

a backrest;

a reclining mechanism;

wherein the reclining mechanism operably connects the backrest to the frame;

wherein the reclining mechanism is configured to move the backrest between an upright position and a reclined position relative to the frame;

a counterbalance assembly;

wherein the counterbalance assembly is configured to provide a counterbalance force to the backrest;

wherein the reclining mechanism includes an upper guide assembly and a lower guide assembly;

wherein the upper guide assembly is configured to move an upper end of the backrest upward and forward when the backrest is moved to the upright position;

wherein the upper guide assembly is configured to move the upper end of the backrest downward and rearward when the backrest is moved to the reclined position;

wherein the lower guide assembly js configured to move a lower end of the backrest upward and rearward when the backrest is moved to the upright position;

wherein the lower guide assembly is configured to move the lower end of the backrest downward and forward when the backrest is moved to the reclined position;

wherein the backrest has a hollow interior;

wherein the counterbalance assembly is positioned within the hollow interior of the backrest.

13. A seating system, comprising:

a frame;

a seat;

the seat operably connected to the frame;

a backrest;

a reclining mechanism;

wherein the reclining mechanism operably connects the backrest to the frame;

wherein the reclining mechanism is configured to move the backrest between an upright position and a reclined position relative to the frame;

a counterbalance assembly;

wherein the counterbalance assembly is configured to provide a counterbalance force to the backrest to move the backrest to the upright position in absence of an opposing force;

wherein the reclining mechanism includes an upper guide assembly;

wherein the upper guide assembly is configured to move an upper end of the backrest upward and forward when the backrest is moved to the upright position;

wherein the upper guide assembly is configured to move the upper end of the backrest downward and rearward when the backrest is moved to the reclined position;

wherein the reclining mechanism includes a lower axle that extends through the backrest from side to side;

wherein opposing ends of the lower axle are configured to move along slotted tracks within the frame.

14. The system of claim 13, wherein the backrest has a front support member and a rear support member;

wherein the backrest includes an access assembly configured to operably connect the front support member with the rear support member to form a hollow interior;

wherein the counterbalance assembly is positioned within the hollow interior;

wherein the access assembly includes one or more hook brackets, receiving brackets, and a set of hinge mechanisms;

wherein the set of hinge mechanisms includes a first bracket, a second bracket, and a link.

15. The system of claim 13, wherein the backrest has a front support member and a rear support member;

wherein the backrest includes an access assembly configured to operably connect the front support member with the rear support member to form a hollow interior;

wherein the counterbalance assembly is positioned within the hollow interior;

wherein the access assembly includes one or more hook brackets, receiving brackets, and a set of hinge mechanisms;

wherein the set of hinge mechanisms includes a first bracket, a second bracket, and a link;

wherein the first bracket, second bracket, and link are configured to permit the front support member to be moved away from the rear support member to provide access to the counterbalance assembly.

16. The system of claim 13, wherein the upper guide assembly includes a pair of links connected to opposite sides of the backrest;

wherein the pair of links operably connect the backrest to the frame;

wherein the counterbalance assembly is configured to rotate the pair of links to move the backrest between the upright position and the reclined position.

17. The system of claim 13, wherein the backrest has a front support member and a rear support member;

wherein the backrest includes an access assembly configured to operably connect the front support member with the rear support member to form a hollow interior;

wherein the counterbalance assembly is positioned within the hollow interior;

wherein the access assembly includes one or more hook brackets, receiving brackets, and a set of hinge mechanisms.

18. The system of claim 13, wherein the reclining mechanism includes a lower guide assembly;

wherein the lower guide assembly is configured to move a lower end of the backrest upward and rearward when the backrest is moved to the upright position;

wherein the lower guide assembly is configured to move the lower end of the backrest downward and forward when the backrest is moved to the reclined position;

wherein the lower guide assembly includes a pair of rollers connected to opposite ends of the lower axle;

wherein the pair of rollers are configured to move along the sloted tracks within the frame.

19. The system of claim 13, wherein the backrest has a front support member and a rear support member;

wherein the backrest includes an access assembly configured to operably connect the front support member with the rear support member to form a hollow interior;

wherein the access assembly operably connects the front support member with the rear support member with a hinged connection;

wherein the hinged connection is configured to permit the front support member to be moved away from the rear support member to provide access to the counterbalance assembly.

20. The system of claim 13, wherein the backrest has a hollow interior;

wherein the counterbalance assembly is positioned within the hollow interior of the backrest.

21. The system of claim 13, wherein the backrest has a hollow interior;

wherein the counterbalance assembly includes at least one torsion spring;

wherein the at least one torsion spring of the counterbalance assembly is positioned within the hollow interior of the backrest.

22. The system of claim 13, wherein the backrest has a front support member and a rear support member;

wherein the backrest includes an access assembly configured to operably connect the front support member with the rear support member to form a hollow interior;

wherein the counterbalance assembly is positioned within the hollow interior;

wherein the access assembly is configured to permit the front support member to be moved away from the rear support member to provide access to the counterbalance assembly.

23. A seating system, comprising:

a frame;

a seat;

the seat operably connected to the frame;

a backrest;

the backrest having a hollow interior;

a reclining mechanism;

wherein the reclining mechanism operably connects the backrest to the frame;

wherein the reclining mechanism is configured to move the backrest between an upright position and a reclined position relative to the frame;

a counterbalance assembly;

wherein the counterbalance assembly is positioned within the hollow interior of the backrest;

wherein the counterbalance assembly is configured to provide a counterbalance force to the backrest;

wherein the reclining mechanism is configured to move an upper end of the backrest upward and forward when the backrest is moved to the upright position;

wherein the reclining mechanism is configured to move the upper end of the backrest downward and rearward when the backrest is moved to the reclined position;

wherein the reclining mechanism is configured to move a lower end of the backrest upward and rearward along a downward concave curve when the backrest is moved to the upright position;

wherein the reclining mechanism is configured to move the lower end of the backrest downward and forward along the downward concave curve when the backrest is moved to the reclined position.

24. The system of claim 23, wherein the counterbalance force provided by the counterbalance assembly is adjustable.

25. A seating system, comprising:

a frame;

a seat;

the seat operably connected to the frame;

a backrest;

the backrest operably connected to the frame;

the backrest having a hollow interior;

a reclining mechanism;

wherein the reclining mechanism is configured to move the backrest between an upright position and a reclined position relative to the frame;

wherein the reclining mechanism includes one or more over-center latches configured to prevent reclining of the backrest when an occupant leans back into the backrest;

a counterbalance assembly;

the counterbalance assembly positioned within the hollow interior of the backrest;

wherein the counterbalance assembly is configured to provide a counterbalance force to the backrest.

26. The system of claim 25, wherein the counterbalance force provided by the counterbalance assembly is adjustable.

27. The system of claim 25, wherein the reclining mechanism includes a pair of links, each extending from a forward end that is pivotally connected to opposite sides of an upper end of the backrest, to a rearward end that is pivotally connected to the frame.

28. The system of claim 25, wherein the reclining mechanism includes a pair of links;

wherein the pair of links form the one or more over-center latches.

29. The system of claim 25, wherein the reclining mechanism includes a pair of links, each extending from a forward end that is pivotally connected to opposite sides of an upper end of the backrest, to a rearward end that is pivotally connected to the frame;

wherein when the backrest is in the upright position, the forward end of the each of the pair of links is positioned above the rearward end of the each of the pair of links.

30. The system of claim 25, wherein the reclining mechanism includes a pair of links, each extending from a forward end that is pivotally connected to opposite sides of an upper end of the backrest, to a rearward end that is pivotally connected to the frame;

wherein when the backrest is in the upright position, the forward end of the each of the pair of links is positioned above the rearward end of the each of the pair of links;

wherein the pair of links form the one or more over-center latches and prevent the backrest from reclining while the forward end of the each of the pair of links is positioned above the rearward end of the each of the pair of links.

31. The system of claim 25 wherein the one or more over-center latches prevent reclining of the backrest unless a threshold amount of rearward force is applied to the backrest.

32. A seating system, comprising:

a frame;

a seat;

the seat operably connected to the frame;

a backrest;

the backrest operably connected to the frame;

the backrest having a hollow interior;

a counterbalance assembly;

the counterbalance assembly positioned within the hollow interior of the backrest;

wherein the backrest is configured to move between an upright position and a reclined position relative to the frame;

the counterbalance assembly having at least one torsion spring configured to provide a counterbalance force to the backrest;

a reclining mechanism;

wherein the backrest is operably connected to the frame by the reclining mechanism;

wherein the reclining mechanism includes an axle that extends through the backrest from side to side;

wherein opposing ends of the axle are configured to move along tracks within the frame.

* * * * *